US006820927B2

(12) United States Patent
Isom et al.

(10) Patent No.: US 6,820,927 B2
(45) Date of Patent: Nov. 23, 2004

(54) COLLAPSIBLE SUPPORT AND METHODS OF USING THE SAME

(75) Inventors: Matthew Isom, Baltimore, MD (US); Brian Edward Le Gette, Baltimore, MD (US); David Reeb, Columbia, MD (US); Alan Tipp, Baltimore, MD (US); Justin Saul Werner, Millersville, MD (US); Ronald L. Wilson, II, Catonsville, MD (US)

(73) Assignee: Kelsyus, LLC, Virginia Beach, VA (US)

( * ) Notice: Subject to any disclaimer, the term of this patent is extended or adjusted under 35 U.S.C. 154(b) by 0 days.

(21) Appl. No.: 10/233,784

(22) Filed: Sep. 4, 2002

(65) Prior Publication Data

US 2003/0080592 A1 May 1, 2003

Related U.S. Application Data

(63) Continuation-in-part of application No. PCT/US02/06695, filed on Mar. 5, 2002, which is a continuation-in-part of application No. 09/797,948, filed on Mar. 5, 2001, now Pat. No. 6,698,827, application No. 10/233,784, which is a continuation-in-part of application No. 09/797,948.

(51) Int. Cl.[7] ..... A47C 4/30

(52) U.S. Cl. ..... 297/16.2; 297/17; 297/45; 297/129

(58) Field of Search ..... 297/16.2, 184.1, 297/184.11, 17, 45, 129

(56) References Cited

U.S. PATENT DOCUMENTS

| | | | | |
|---|---|---|---|---|
| 180,610 A | | 8/1876 | Lungren | |
| 244,216 A | | 7/1881 | Fenby | |
| 291,062 A | | 1/1884 | Latour | |
| 1,035,823 A | | 8/1912 | Hay | |
| 1,979,278 A | | 11/1934 | McMurry | |
| 2,243,984 A | * | 6/1941 | Singewald | 297/184.11 X |
| 2,473,090 A | | 6/1949 | Becker | |
| 2,690,792 A | | 10/1954 | Moss | |
| 2,691,410 A | | 10/1954 | Boucher | |
| 2,973,888 A | | 3/1961 | Beardsley | |
| 3,124,387 A | | 3/1964 | MacLaren | |
| 3,662,932 A | | 5/1972 | Kerschner | |
| 3,838,883 A | | 10/1974 | Machen | |
| 4,014,591 A | | 3/1977 | Gittings | |
| 4,047,753 A | | 9/1977 | Uchida | |
| 4,148,520 A | | 4/1979 | Miller | |
| 4,258,951 A | | 3/1981 | Groom | |
| 4,300,707 A | | 11/1981 | Kjaer | |
| 4,359,244 A | | 11/1982 | Koehm | |

(List continued on next page.)

FOREIGN PATENT DOCUMENTS

WO WO 02/38009 A1 5/2002

OTHER PUBLICATIONS

Shakespeare Deluxe High Back Lounge Chair *Outdoor World of California* http://www.outdoorworldca.com/products/specs/dixhilou.htm.
Sand Chair, *The Crate and Barrel 1993 Spring and Summer Catalogu.*
Portable Chair, *MotorHome*, Sep. 1994 p. 106.
Lafuma Sport/Travel Chair *Campmor Late Spring 1994.*
Wertand's Handcrafted Rocking Chairs pamphlet, Austin Texas.
Product label for "Undercover the Sunshade" manufactured by Della USA.

*Primary Examiner*—Rodney B. White
(74) *Attorney, Agent, or Firm*—Cooley Godward LLP

(57) ABSTRACT

A support including a frame having a tension member coupled to the frame is disclosed. The frame has a collapsed configuration and an expanded configuration. The tension member is disposable in a first position to provide support for an arm of a user and a second position to be carried on a shoulder of the user.

40 Claims, 53 Drawing Sheets

U.S. PATENT DOCUMENTS 4,595,232 A 6/1986 Glenn et al.
4,605,261 A 8/1986 Lee
4,671,566 A 6/1987 Knapp et al.
4,673,211 A 6/1987 Hoffman
4,676,548 A 6/1987 Bradbury
4,717,201 A 1/1988 Barras
4,807,930 A 2/1989 Helfrich
4,836,601 A 6/1989 Cone
4,836,938 A 6/1989 Kobasic
4,889,383 A 12/1989 Jones
5,016,792 A 5/1991 Jay
5,054,849 A 10/1991 Hoff
5,139,308 A 8/1992 Ziman
5,150,945 A 9/1992 Aupperlee et al.
5,332,283 A 7/1994 Gray
5,409,291 A 4/1995 Lamb et al.
5,429,413 A 7/1995 Levy et al.
5,499,760 A 3/1996 Pielocik
5,499,857 A 3/1996 Lynch, Jr.
5,527,088 A 6/1996 MacLean
5,536,064 A 7/1996 MacLean
5,544,793 A 8/1996 Harrop
5,588,696 A 12/1996 Jay et al.
5,628,437 A 5/1997 Kober
5,718,473 A 2/1998 Lynch, Jr.
5,893,605 A 4/1999 Chang
D411,387 S 6/1999 Zheng
5,944,384 A * 8/1999 Patterson ..... 297/184.1 X
5,984,406 A 11/1999 Lee
5,984,409 A 11/1999 Eakin et al.
6,015,189 A 1/2000 Broadhead et al.
6,030,034 A 2/2000 Plohetski
6,045,177 A 4/2000 Grace
6,048,023 A 4/2000 Lampton
6,056,172 A 5/2000 Welsh
6,082,813 A 7/2000 Chen
6,095,172 A * 8/2000 Trapp et al. ..... 297/184.11 X
6,095,599 A 8/2000 Lambert
D430,976 S 9/2000 Tow
D433,244 S 11/2000 Zheng
D433,574 S 11/2000 Zheng
6,145,716 A 11/2000 Caicedo
6,164,726 A 12/2000 Reeves et al.
6,179,374 B1 1/2001 Tang
6,217,113 B1 4/2001 Knatz
6,231,119 B1 5/2001 Zheng
6,237,993 B1 5/2001 Zheng
6,241,311 B1 6/2001 Zheng
6,247,748 B1 6/2001 Zheng
6,247,749 B1 6/2001 Yu
6,247,750 B1 6/2001 Tsai
6,250,712 B1 6/2001 Livington et al.
6,264,271 B1 7/2001 Munn et al.
6,296,304 B1 10/2001 Zheng
6,302,479 B1 10/2001 Zheng
6,322,138 B1 11/2001 Tang
2003/0011217 A1 1/2003 Le Gene et al.

* cited by examiner

FIG. 49
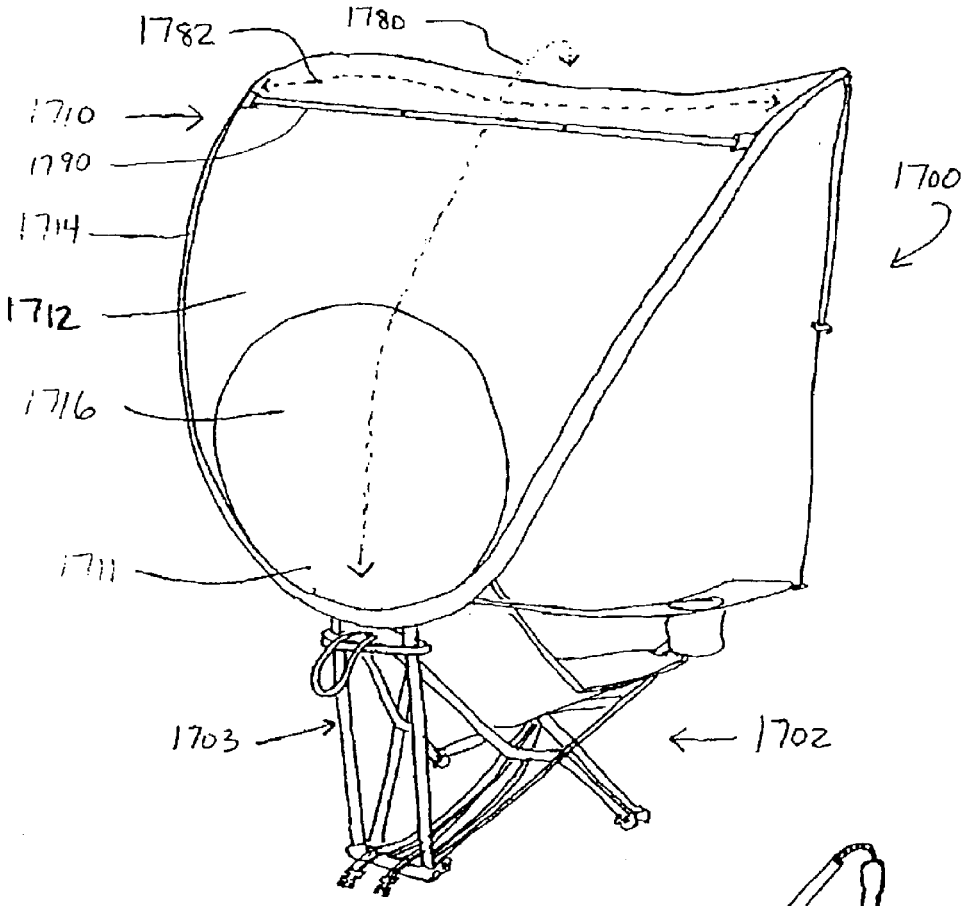
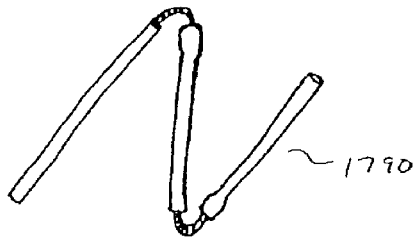
FIG. 50

COLLAPSIBLE SUPPORT AND METHODS OF USING THE SAME

RELATED APPLICATIONS

This application is a continuation-in-part of International Application Ser. No. PCT/US02/06695, entitled "Collapsible Support and Methods of Using the Same," filed Mar. 5, 2002, the disclosure of which is incorporated by reference in its entirety, which is a continuation-in-part of U.S. patent application Ser. No. 09/797,948, entitled "Collapsible Support and Methods of Using the Same," filed Mar. 5, 2001, now U.S. Pat. No. 6,698,827 the disclosure of which is incorporated by reference in its entirety. This application is also a continuation-in-part of U.S. patent application Ser. No. 09/797,948, entitled "Collapsible Support and Methods of Using the Same," filed Mar. 5, 2001.

BACKGROUND OF THE INVENTION

This invention relates generally to a support having multiple configurations, and in particular, to a support that can be positioned in an expanded configuration and a collapsed configuration.

Some conventional supports can be used as chairs to support a user. Such chairs are often transported and used in various outdoor settings. Difficulty exists in transporting a chair. For example, conventional chairs cannot be easily collapsed and transported due to the shape and weight of the chairs.

The need exists for a collapsible support that can be easily transported to various locations.

SUMMARY OF THE INVENTION

A support includes a frame and a tension member. The support can be positioned in a collapsed configuration and an expanded configuration. In one embodiment, the support can be used with a cover that can be positioned around a portion of the frame.

In one embodiment, the support includes a seat portion coupled to the frame. In the open or expanded configuration, a user can sit on the support and the frame is self-supporting.

When the frame is in its expanded configuration, the tension member is coupled to the frame to provide support for an arm of the user. When the frame is in its collapsed configuration, a cover can be placed over a portion of the frame or support. In this configuration, the tension member is not contained by and extends from the cover, thereby enabling a user to place the tension member over the user's shoulder for transporting the support.

BRIEF DESCRIPTION OF THE DRAWINGS

FIGS. 45*a* and 45*b* show a side view of the rear portion of the support shown in FIG. 43 while in an upright position and collapsible position.

FIG. 49 illustrates a rear perspective view of the combination of FIG. 48.

FIG. 50 illustrates a front view of the support member in a collapsed configuration, according to the embodiment shown in FIG. 49.

DETAILED DESCRIPTION OF THE INVENTION

A support includes a seat portion, a frame, and a tension member. The frame can be positioned in a collapsed configuration and an expanded configuration in which the frame is self-supporting. The tension member is disposable in a first position to provide support for an arm of a user and a second position to be carried on a shoulder of a user. When the frame is in its collapsed configuration, the tension member can be placed over a user's shoulder to transport the support. When the frame is in its expanded configuration, the tension member can be disposed in its first position to support an arm of a user.

Figure 1:
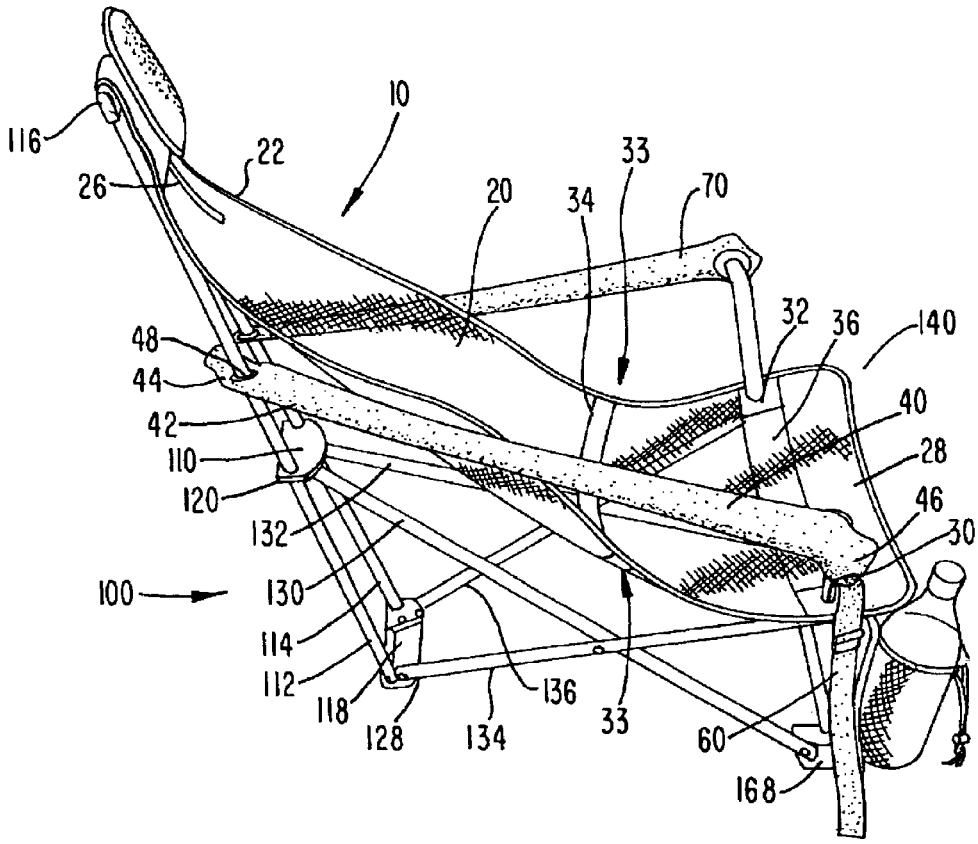
FIG. 1 illustrates a side view of a support according to an embodiment of the invention.

A support according to an embodiment of the invention is illustrated in FIGS. 1–5. FIG. 1 illustrates a side view of the support or support assembly 10 in a deployed or expanded configuration. In one embodiment, support 10 can be used as a chair in its expanded configuration.

In the illustrated embodiment, the support 10 includes a seat portion 20, tension members 40, 70, and a frame 100. The seat portion 20 and the tension members 40, 70 are coupled to the frame 100.

In the illustrated embodiment, the frame 100 includes a rear frame portion 110 and a front frame portion 140, which are coupled together by upper side support bars 130, 132 and lower side support bars 134, 136.

Each of the support members 130, 132, 134, 136 are pivotally coupled to the front and rear frame portions 110, 140. Upper side support member 130 is pivotally coupled to lower side support member 134 proximate their midpoints. Similarly, upper side support member 132 is pivotally coupled to lower side support member 136.

In one embodiment, the upper ends of lower side support members 134, 136 are bent with respect to the remainder of the support members 134, 136. The bent portions of the lower side support members 134, 136 are located proximate to the seat portion 20. When the frame 100 is in its expanded configuration, the upper ends of the lower side support members 134, 136 do not extend into the seat portion 20 and engage the user on the support 10.

In the illustrated embodiment, the rear frame portion 110 includes support members 112, 114, and a coupler 120. The support members 112, 114 arc coupled together at their upper and lower ends by an upper coupler 16 and a lower coupler 118, respectively. Additionally, the lower coupler 118 is pivotally coupled to the ends of lower side support members 134, 136. The rear frame portion 110 has a bottom surface 128 proximate the lower coupler 118. The bottom surface 128 is adapted to rest on a supporting surface.

In the illustrated embodiment, the support members are hollow, metal tubes, such as steel tubes. Support members can be formed of any material and configured in any cross-sectional shape that provides sufficient structural strength to support a user. For example, the support members can be aluminum tubes, plastic tubes, solid metal or plastic bars, etc.

Figure 3:
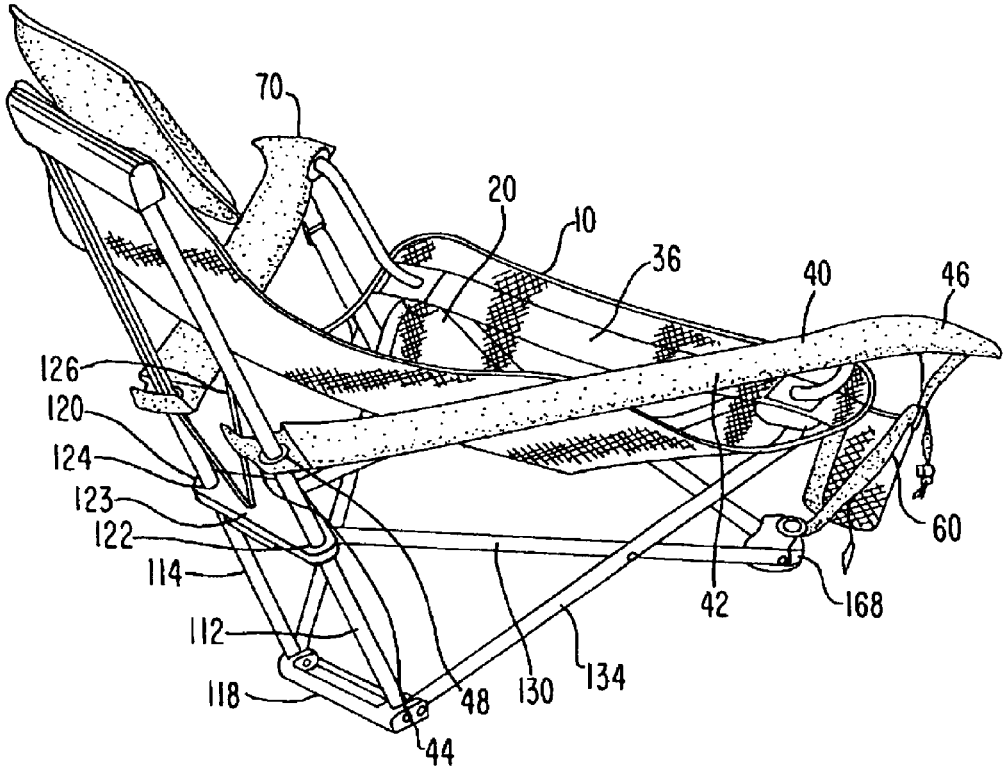
FIG. 3 illustrates a rear perspective view of the support of FIGS. 1 and 2.

In one embodiment, the coupler 120 is a plate that includes holes 122, 124 and is slidably mounted to support members 112, 114. As shown in FIG. 3, support members 112, 114 extend through holes 122, 124, respectively. The holes 122, 124 are sized to slide along the length of support members 112, 114. Slide plate 120 is pivotally coupled to the upper ends of the upper side support members 130, 132.

Figure 2:
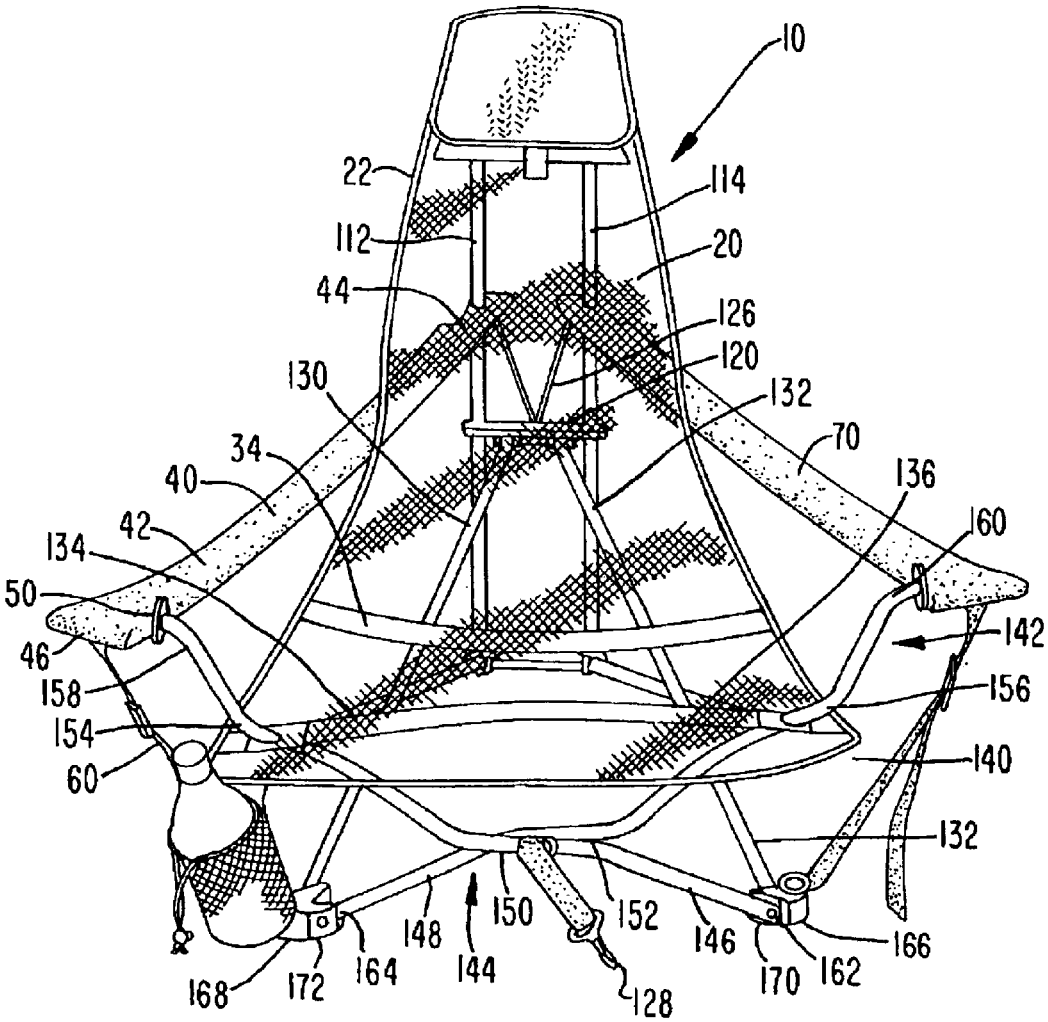
FIG. 2 illustrates a front view of the support of FIG. 1.

As shown in FIGS. 2 and 3, the support 10 includes an extension member 126 coupled to the slide plate 120. In one embodiment, the extension member 126 is a cord. The cord 126 is used to collapse the support 10 from its expanded configuration. The cord 126 is threaded through apertures (not shown) in the upper coupler 116 and connected to the plate 120. The function of the extension member is discussed in further detail below.

While the slide plate is formed of plastic in the disclosed embodiment, any suitable material may be used. Similarly the shape of the slide plate may be varied so long as the slide plate can move along the rear frame portion.

In the illustrated embodiment, the front frame portion 140 includes elongated support members or support members 146, 148 that are pivotally coupled to each other. Support members 146, 148 include upper ends 158, 160 and lower ends 162, 164 and form an "X" structure.

In one embodiment, support members 146, 148 include portions 154, 156 as illustrated in FIG. 2. Portions 154, 156 are substantially linear. When the frame 100 is in its expanded configuration, portions 154, 156 are oriented substantially horizontal and are positioned beneath the membrane 22 to provide support.

In one embodiment, support members 146, 148 include portions 150, 152 as illustrated in FIG. 2. Portions 150, 152 are substantially linear. In this embodiment, the support members 146, 148 are pivotally coupled together at portions 150, 152.

The lower ends 162, 164 of the support members 146, 148 are pivotally coupled to front feet 166, 168, respectively. Each of the front feet 166, 168 has a bottom surface 170, 172 that can engage the surface on which the support 10 is placed. Front feet 166, 168 are pivotally coupled to upper side support members 130, 132.

Support members 146, 148 are coupled to the seat portion 20 and to the lower side support members 134, 136. The seat portion 20 includes apertures or holes 30, 32 through which the support members 146, 148 can be inserted. The upper end of lower side support member 134 is pivotally coupled to the second planar portion 154 of support member 146. Similarly, lower side support member 136 is pivotally coupled to the second planar portion 156 of support member 148.

The front frame portion 140 has an upper portion 142 and a lower portion 144. The upper front frame portion 142 includes the front frame portion 140 located above the seat portion 20. The lower front frame portion 140 includes the front frame portion 140 located below the seat portion 20 in FIG. 2.

In the illustrated embodiment, the frame 100 is a self-supporting structure. When the frame 100 is in its expanded configuration, the weight of the components of the frame 100 hold the frame 100 in its expanded configuration. The frame 100 does not need the seat portion 20 or one of the tension members 40, 70 to remain in its expanded configuration.

In the illustrated embodiment, the seat or seat portion 20 includes a membrane 22 that is supported on the frame 100. The seat portion 20 includes a strip 24 along the perimeter of the membrane 22. The membrane 22 has ends 26, 28 and holes 30, 32 that are located proximate to end 28. End 26 of the membrane 22 is coupled to the rear frame portion 110. End 28 is releasably coupled to the front frame portion 140.

As shown in FIG. 2, the upper end 158 of the support member 146 is inserted through hole 30. Similarly, the upper end 160 of support member 148 is inserted through hole 32. Membrane 22 is supported on the second planar portions 154, 156 of each support member 146, 148.

In the illustrated embodiment, the membrane 22 is darted at regions 33 on either side of the seat portion 20. A triangular notch is cut in membrane 22 in each region 33. The membrane 22 is collected together to close the notch, thereby causing the membrane 22 to form a cup-like shape as illustrated in FIG. 1. The straps 34, 36 are secured to the membrane 22 in regions 33 to cover up the notch and to reinforce regions 33. The straps 34, 36 are also coupled to the membrane 22 to provide support to the seat portion 20. In the illustrated embodiment, strip 24 and straps 34, 36 are sewn to the membrane 22. However, the components of seat portion 20 can be coupled together using any known method of coupling items.

The term "membrane" is used herein to include, but is not limited to a layer of material. For example, the membrane can be a piece of fabric such as nylon or neoprene.

In the illustrated embodiment, the support 10 includes tension members 40, 70 that are coupled to the frame 100. While the tension members 40, 70 are illustrated as substantially similar, the tension members do not have to be similar. Similarly, it is not necessary that the support has two tension members. Only one tension member will be discussed in detail below to simplify the description of the invention.

In the illustrated embodiment, the tension member is an elongated fabric strap. Alternatively, the strap can be a rope, cord, webbing, or any other structure that can provide a tensile force.

In the illustrated embodiment, the tension member includes a padded portion 42, and a strap portion 60. Tension member 40 is coupled to the rear frame portion 110 and the front frame portion 140.

Tension member can be coupled to the frame at any number of locations. Tension member 40 can be coupled to the rear frame portion 110 at one or more locations. Similarly, tension member 40 can be coupled to the front frame portion 140 at one or more locations. For example, tension member can be coupled to the rear frame portion at two locations and to the front frame portion at one location. In one embodiment, tension member can be coupled to the rear frame portion at one location and to the front frame portion at two locations. In another embodiment, tension member can be coupled to the rear frame portion at one location and to the front frame portion at one location. In another embodiment, tension member can be coupled to the rear frame portion at two locations and to the front frame portion at two locations. When the tension member is connected to the rear frame portion or to the front frame portion at multiple locations, each location can be at the same or different height relative to the other locations on the same frame portion.

Tension member 40 can be either removably or fixedly coupled to the rear frame portion 110 and/or the front frame portion 140 at each location. For example, tension member 40 can be removably coupled to the front frame portion at one location and fixedly coupled to the rear frame portion at two locations. Any combination of fixed and removable connections to the frame can be used to couple the frame and each tension member.

In alternative embodiments, tension member 40 can be coupled to the frame at locations other than on the rear frame portion and on the front frame portion.

The preceding discussion of the coupling of tension member to the rear frame portion and to the front frame portion can be applied to the various embodiments of tension members and supports described herein.

One end of tension member 40 includes a hole 48 through which support member 112 is inserted. Accordingly, the tension member 40 is slidably coupled to the support member 112 of the rear frame portion 110. The opposite end of the tension member 40 is connected to the front frame portion 140 at front foot 162.

Figure 4:
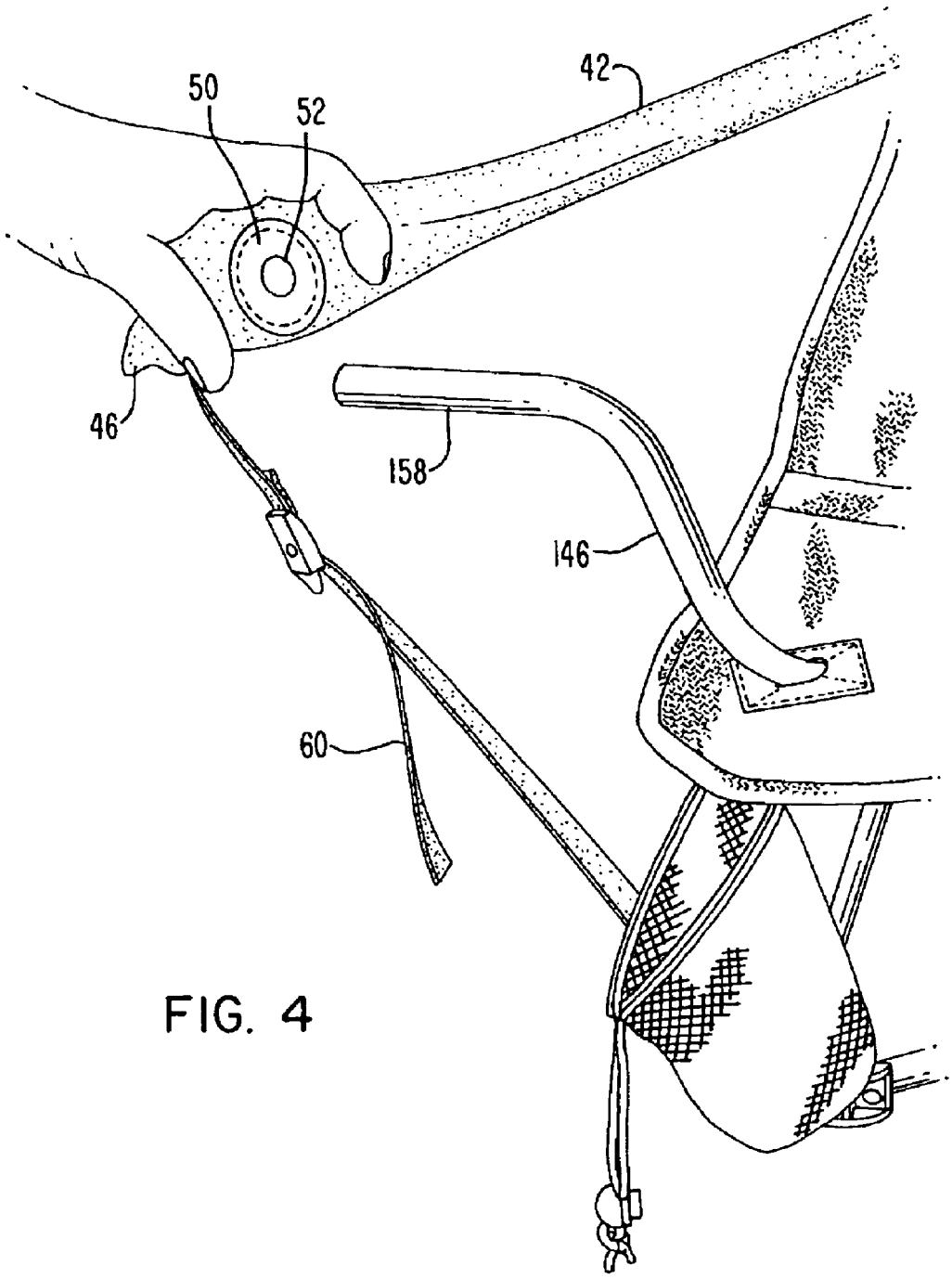
FIG. 4 illustrates a portion of a tension member of the support of FIG. 1.

In the illustrated embodiment, the tension member 40 is releasably coupleable to the front frame portion 140. As illustrated in FIG. 4, the padded portion 42 of the tension member 40 includes ends 44, 46 and a coupler 50 having an opening or hole 52 therein. Coupler 50 and hole 52 are located proximate end 46. The hole 52 is configured to receive a portion of the upper end 158 of the support member 146. Upper end 158 is inserted into and is seated in coupler 50.

Figure 5:
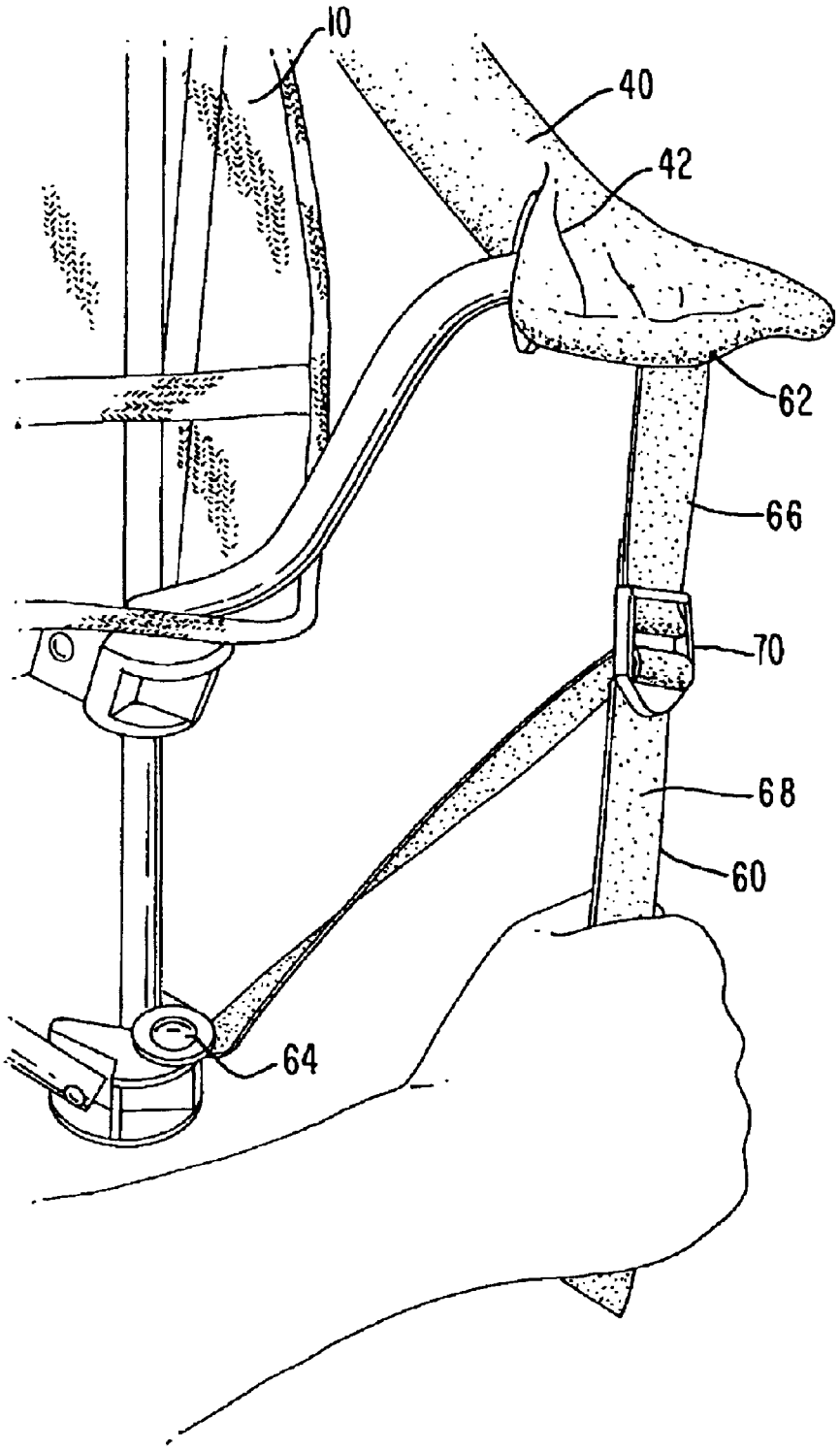
FIG. 5 illustrates a portion of a tension member of the support of FIG. 1.

As illustrated in FIG. 5, the strap portion 60 of tension member 40 includes ends 62, 64, a fixed portion 66, and an adjustable portion 68. One end 62 of the strap portion 60 is coupled to end 46 of the padded portion 42. The strap portion 60 also includes a tensioner 70 that couples the fixed portion 66 to the adjustable portion 68. Tensioner 70 can be adjusted to change the length of the strap portion 60.

In the illustrated embodiment, tensioner 70 is a buckle that is coupled to a free end of the fixed portion 66. Tensioner 70 can be any mechanism that can be used to retain two points on the strap portion together to vary the distance between the ends of the strap portion. For example, tensioner 70 can include a pair of buckles, a pair of clips, hook and loop fasteners, etc.

In an alternative embodiment, adjustment of the tension member can adjust the disposition of the frame. For example, the coupler can be sized to permit movement of the tension member relative to the upper end of the support member. Since the tension member is coupled to the rear frame portion, the tension member and the rear frame portion are pulled forwardly as the strap portion is shortened. When the rear frame portion is pulled forwardly, the angle that the rear frame portion is reclined relative to the supporting surface varies. Accordingly, the user can adjust the recline position of the support by adjusting the strap portion of the tension member.

Figure 6:
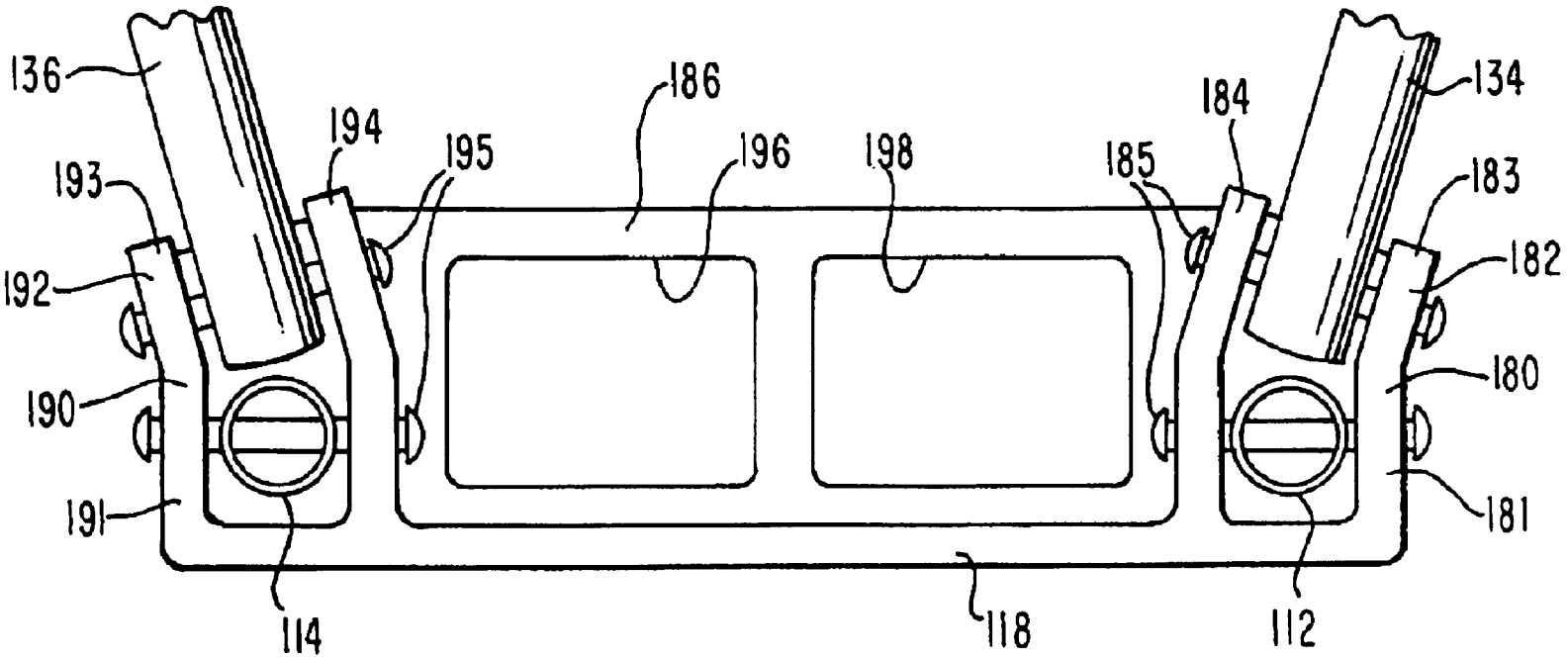
FIG. 6 illustrates a bottom coupler of the rear frame portion of the support of FIG. 1.

An embodiment of a lower coupler is illustrated in FIG. 6. Lower coupler 118 includes mounting portions 180, 190 and a bottom portion 186. In the illustrated embodiment, the mounting portions 180, 190 and the bottom portion 186 are integrally formed.

Mounting portions 180, 190 include side walls 183, 184 and 193, 194, respectively. Mounting portion 180 includes coupling portions 181, 182. Coupling portion 181 can be referred to as straight section or portion 181. Coupling portion 182 can be referred to as angled section or portion 182. As illustrated in FIG. 6, coupling portion 181 is oriented at an angle relative to coupling portion 182. Similarly, mounting portion 190 includes coupling portions or straight section 191 and angled section 192.

As illustrated in FIG. 6, rear support members 112, 114 are coupled to mounting portions 180, 190 by fasteners 185, 195, respectively. Fasteners 185, 195 can be any type of fastener that allows relative movement between the rear support members and the lower coupler.

Side support members 134, 136 are coupled to mounting portions 180, 190 by fasteners 185, 195. In the illustrated embodiment, the side support members 134, 136 are coupled to the angled sections 182, 192 of the mounting portions 180, 190. Rear support members 112, 114 are coupled to the straight sections 181, 191 of the mounting portions 180, 190.

When the frame is moved from its expanded configuration to its collapsed configuration, side support members 134, 136 pivot about fasteners 185, 195 in different planes. Since the angled sections 182, 192 are oriented at angles with respect to the coupler 118 as shown in FIG. 6, the planes in which the side support members 134, 136 move intersect each other.

Since the connections of the side support members 134, 136 to the lower coupler 118 are in front of and at angles to the connections of the rear support members 112, 114 to the lower coupler 118, the torque on the connections at the lower coupler 118 generated by the collapsing of the frame 100 is lower than the torque generated in conventional supports. Similarly, since the fasteners connecting a side support member and a rear support member to a particular mounting portion are not parallel, the torque generated in the fasteners during the collapsing or expanding of the frame is reduced.

The bottom portion 186 of the lower coupler 118 includes openings 196, 198. When the support 10 is placed on a surface with loose material, such as sand or dirt, the loose material can pass through openings 196, 198.

Figure 7:
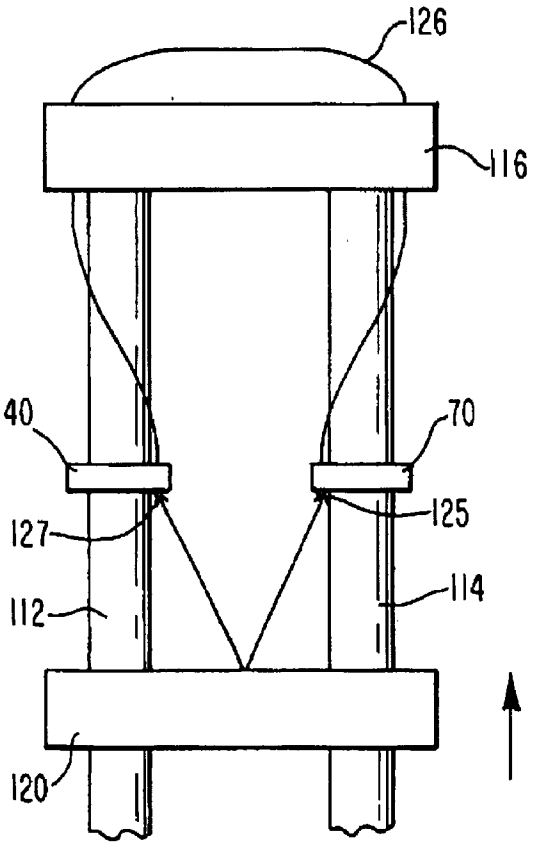
FIG. 7 illustrates a front view of a portion of the rear frame portion of the support of FIG. 1.

FIG. 7 illustrates a front view of an embodiment of the upper portion of the rear frame portion. The extension member 126 is coupled to the slide plate 120 and extends through openings in the upper coupler 116. The extension member 126 also passes through openings in the tension members 40, 70 behind the holes through which the rear support members 112, 114 extend.

In one embodiment, the extension member 126 includes two knots 125, 127. Each knot 125, 127 is positioned below and provides support for the end of one of the tension members 40, 70. Above the tension members 40, 70, the extension member 126 warps around each of the rear support members 112, 114 and passes through openings in the upper coupler 116 on the outside of the support members 112, 114. The operation of the extension member is discussed in greater detail below in FIGS. 16–18.

Figure 8:
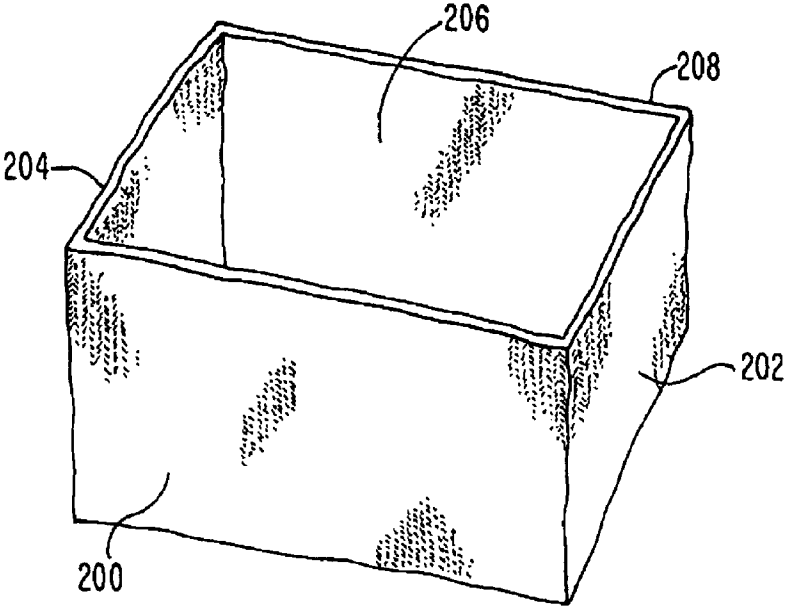
FIG. 8 illustrates a cover according to an embodiment of the invention.

An embodiment of a cover is illustrated in FIG. 8. Cover 200 includes a membrane 202 having an edge 204 that defines an opening 206. An elastic band 208 is sewn along edge 204. In the illustrated embodiment, the membrane is a nylon material.

FIGS. 9–15 illustrate a process, in ascending order, according to an embodiment of the present invention, by which a collapsible support can be changed or transformed from an expanded configuration to a collapsed configuration. It should be understood that the process can be reversed to transform the support from its collapsed configuration to its expanded configuration by following FIGS. 9–15 in reverse order.

Figure 9:
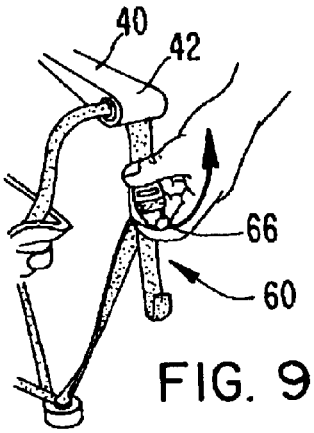
FIGS. 9–15 illustrate a process, according to an embodiment of the present invention by which the support can be transformed from an expanded configuration to a collapsed configuration.
Figure 10:
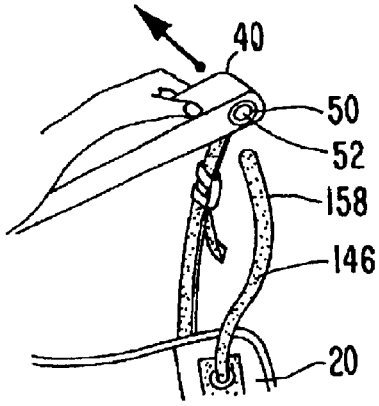

As shown in FIG. 9, the user releases the tension in the tension member 40 by increasing the length of the strap portion 60. The user then removes or decouples the upper end 158 of the support member 146 from the tension member 40 as illustrated in FIG. 10. These steps, releasing the tension and removing the tension member 40, are repeated for the second tension member 70.

Figure 11:
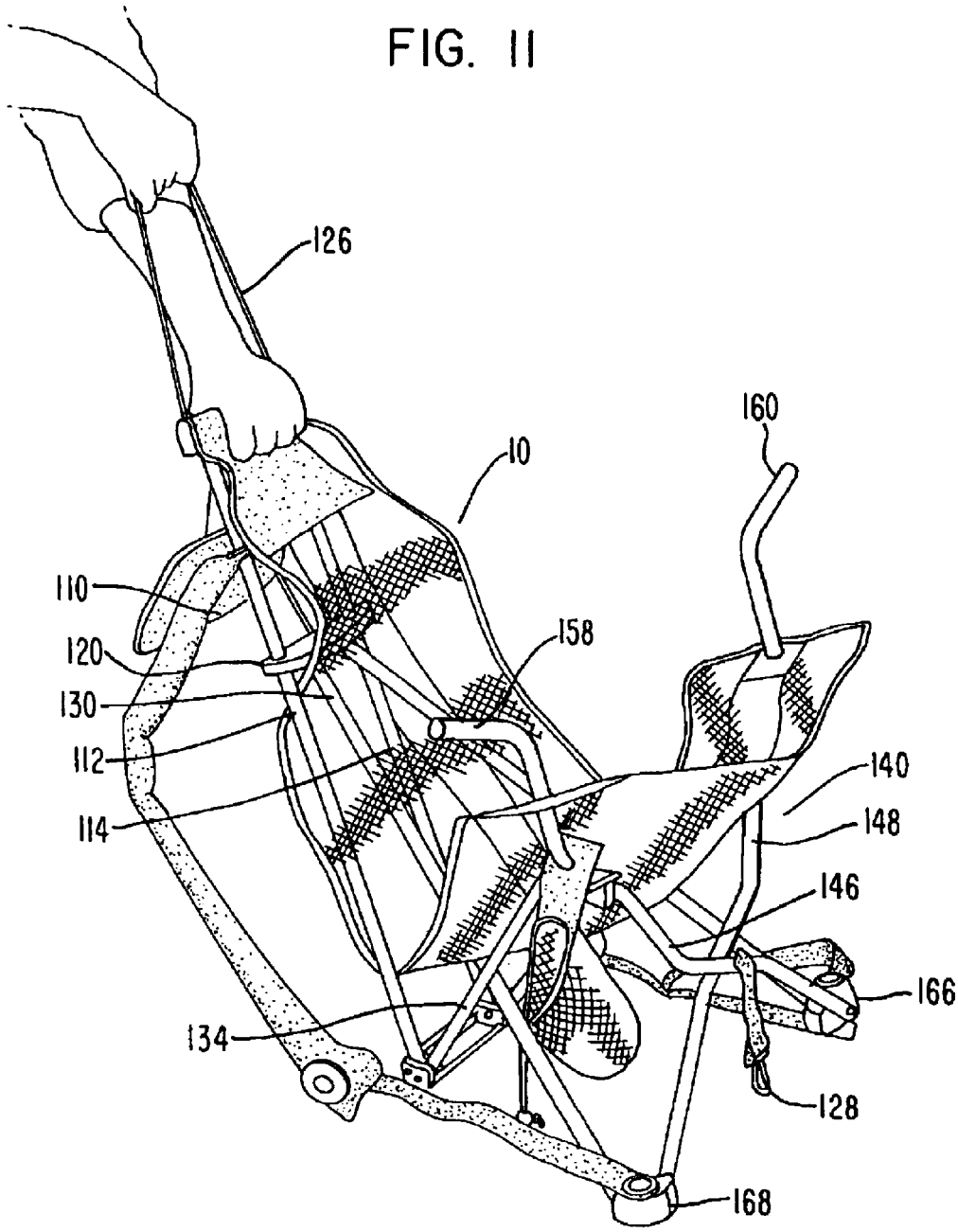
Figure 12:
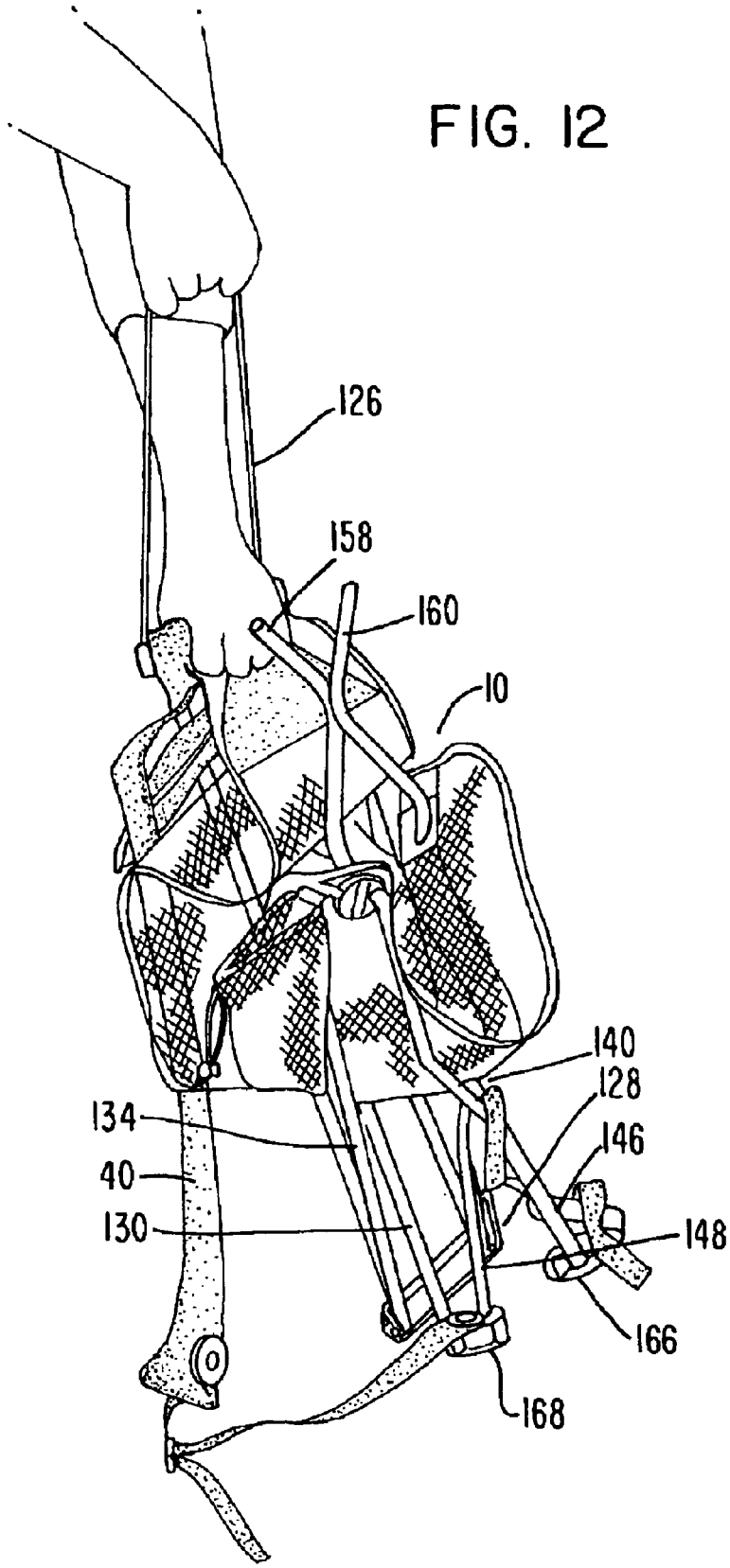

As shown in FIGS. 11–12, the user grasps and pulls upwardly on the cord 126 while holding onto the upper coupler 116. When the user pulls the cord 126, the slide plate 120 slides upwardly along support members 112, 114. As the slide plate 120 moves upwardly, the ends of the support members 130, 132 connected to the slide plate 120 move upwardly. As a result, the lower ends of the upper side support members 130, 132 are drawn toward the rear frame portion 110 and the lower side support members 134, 136 pivot about their lower ends. The scissor-like movement of the side support members 130, 132, 134, 136 draws the front frame portion 140 towards the rear frame portion 110. The movement also causes the front feet 162, 164 to move together and the upper ends 158, 160 to move together.

Figure 13:
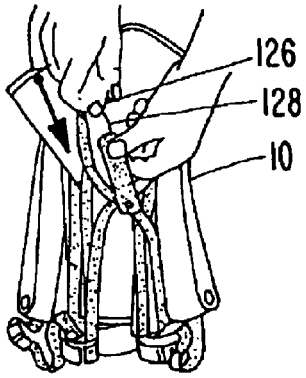

Once the frame 100 is collapsed, the user then secures the support 10 in its collapsed configuration by fastening the clip 128 that is coupled to the front frame portion 140 to cord 126 as illustrated in FIG. 13.

Figure 14:
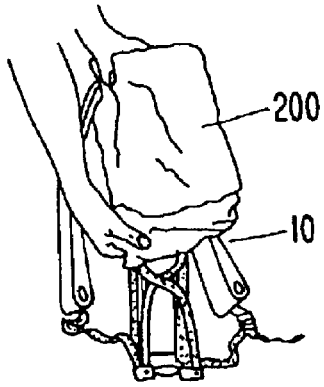
Figure 15:
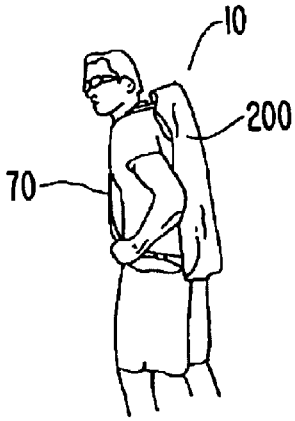
Figure 16:
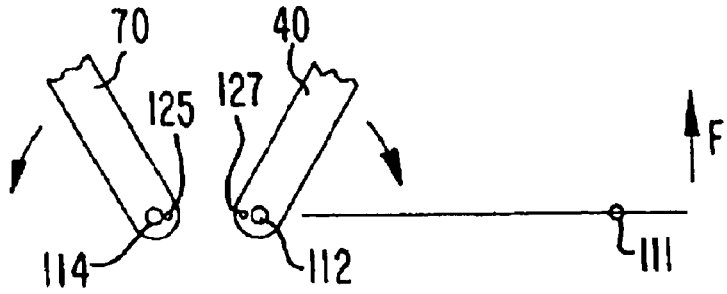
FIGS. 16–18 illustrate the movement of the tension members relative to the rear frame portion.
Figure 17:
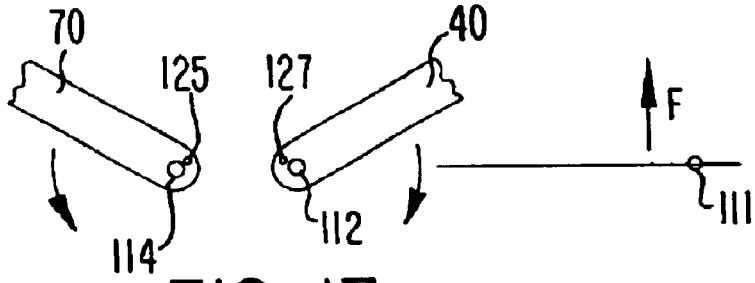
Figure 18:
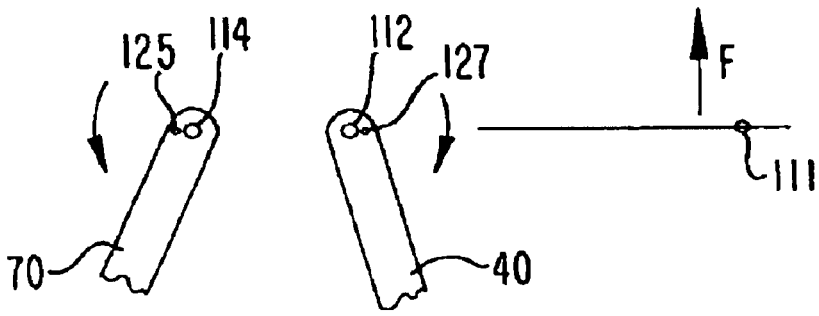

Cover 200 can be placed over the collapsed support 10 as illustrated in FIGS. 13–14. The cover 200 is configured to receive a portion of the collapsed support 10. In particular, the cover 200 encloses a portion of the frame 100. The tension members 40, 70, however, are not enclosed by and extend from the cover 200. As illustrated in FIG. 15, the tension members 40, 70 can be supported on the shoulders of the user. FIGS. 16–18 illustrate the rotation of the tension members during the collapsing of the frame. Line 111 represents a plane defined by the rear support members 112, 114. The direction in which the support 10 is facing is illustrated by the arrow F.

In FIG. 16, the support 10 is illustrated in its expanded configuration. As the user grasps the extension member 126 and pulls it upwardly, the tension members 40, 70 and the location of the knots 125, 127 rotate around the rear frame member 110. As illustrated in FIGS. 17 and 18, tension member 40 rotates around rear support member 112. Tension member 70 rotates in an opposite direction about rear support member 114. The rotation of the tension members 40, 70 is caused by the wrapping of the extension member 126 around each rear support member 112, 114.

Referring to FIG. 7, as the extension member 126 is pulled higher and advances upwardly along the rear frame portion 110, the relative positions of the knots 125, 127 move around the rear support members 112, 114. The wrapping movement of the extension member 126 around members 112, 114 causes the tension members 40, 70 to move between a position in which they provide support to a user's arm and a position on the rear of the frame 100 in which they can be carried on the shoulders of a user. The positions of the tension members 40, 70 relative to the frame 110 during the collapsing process are illustrated in FIGS. 11 and 12.

Figure 19:
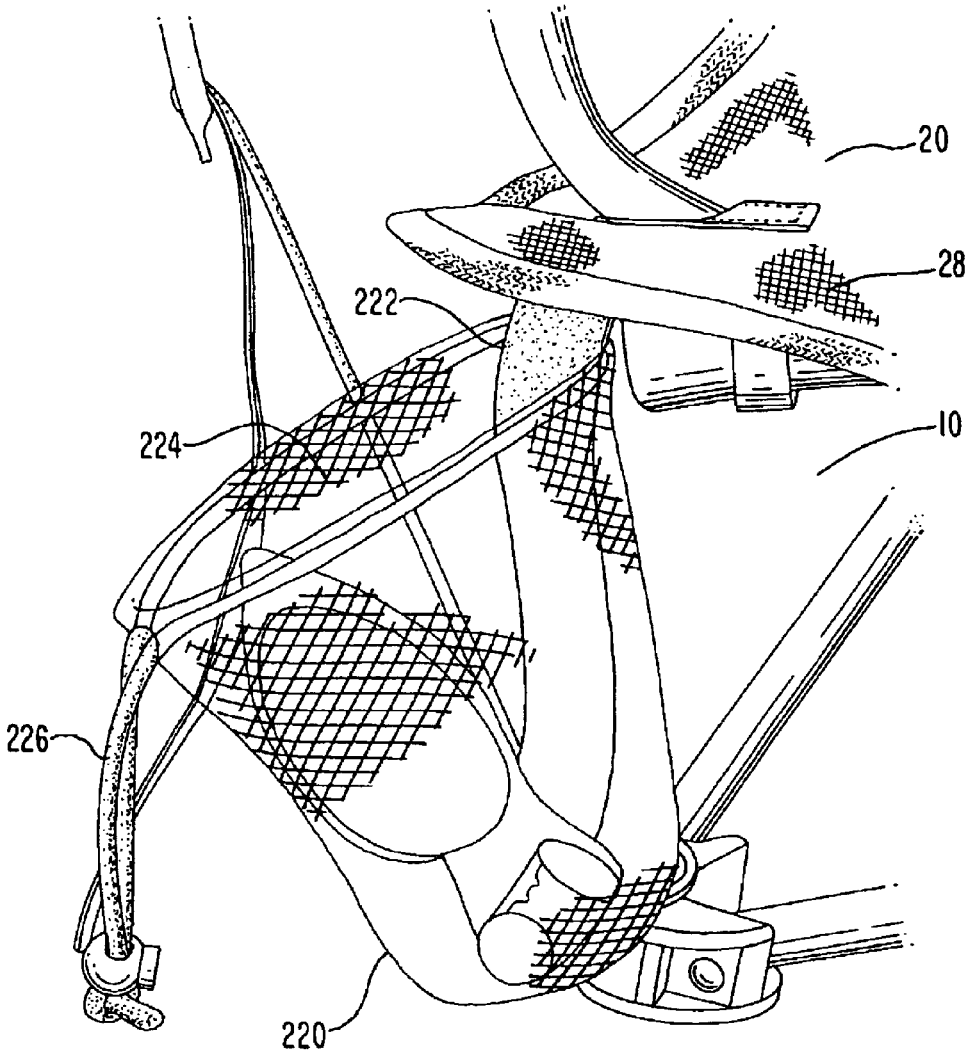
FIG. 19 illustrates a storage bag of the support of FIG. 1.

In one embodiment, the support 10 can include a pouch 220 as illustrated in FIG. 19. The pouch 220 is coupled proximate to the end 28 of the seat portion 20. The pouch 220 includes an attachment strap 222, a fabric portion 224, and a draw string 226. The attachment strap 222 is coupled to the seat portion 20 and supports the fabric portion 224 of the pouch 220. A draw string 226 is provided at the upper surface of the fabric portion 224 to close the opening 228.

While the illustrated fabric portion is made from a mesh material, the fabric portion can be any material that can be used to support and retain an article. Similarly, the fabric portion can be any size or shape that enables the pouch to hold articles.

Figure 20:
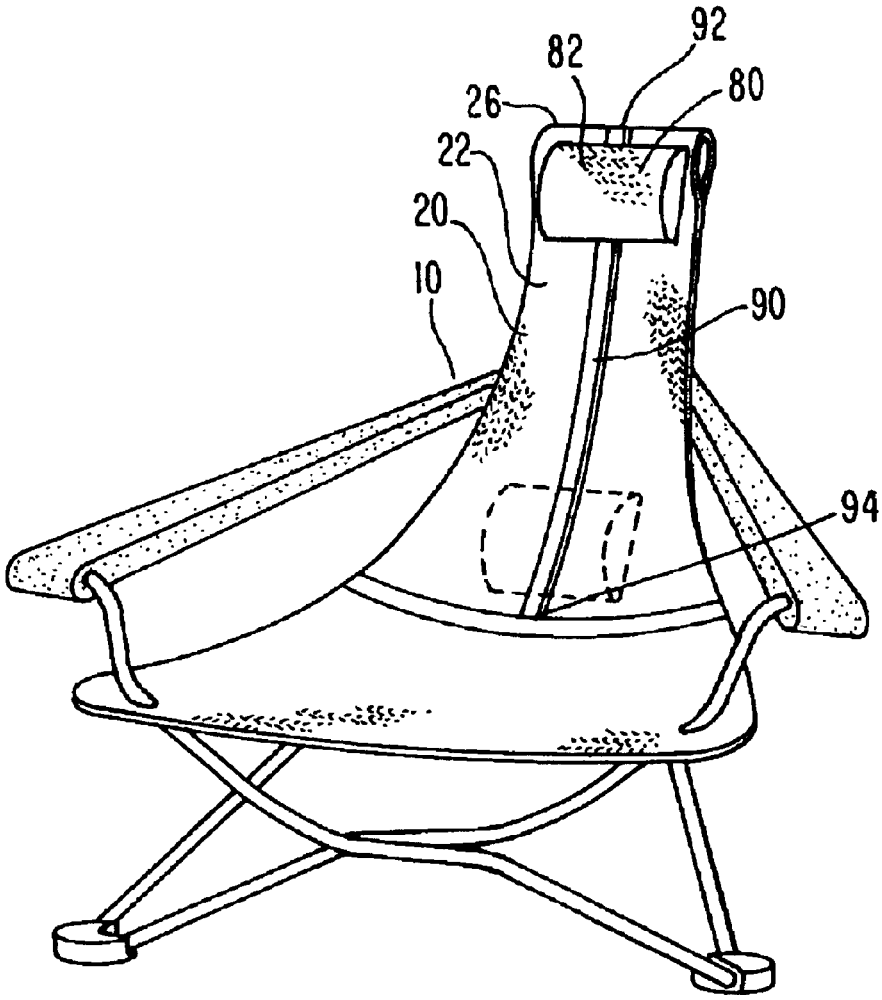
FIGS. 20–21 illustrate a support and a pillow according to an embodiment of the invention.
Figure 21:
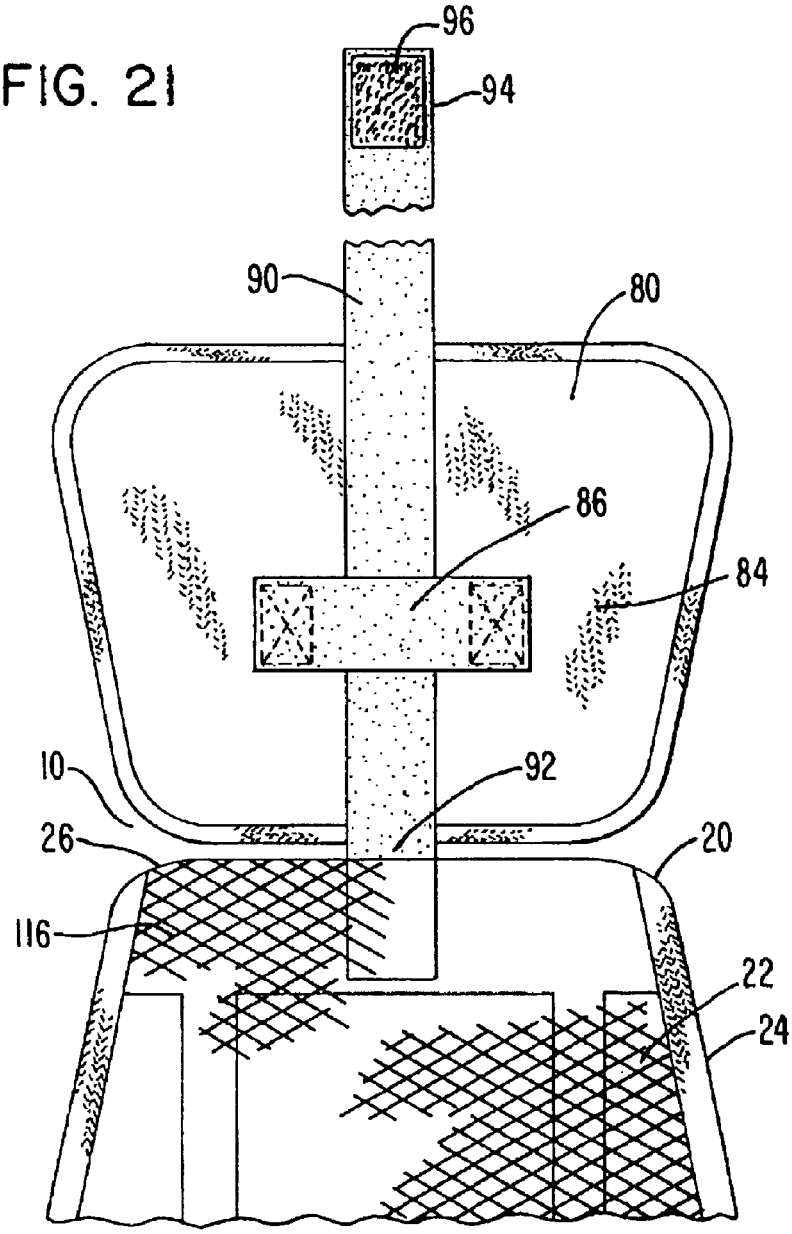

In one embodiment, the support 10 includes a pillow 80. As illustrated in FIGS. 20–21, the pillow 80 includes a body with a front surface 82 and a rear surface 84. The front surface 82 of the pillow 80 can be used to support a portion of a user's body, such as a head, neck, or back. The pillow 80 includes a fabric loop 86 mounted on its rear surface 84.

The pillow 80 is slidably coupled to an elongated strap 90 that extends along the back portion of the seat portion 20. Strap 90 is inserted into loop 86, thereby allowing the pillow 80 to slide along strap 90. The pillow 80 can slide between upper and lower position as illustrated in FIG. 20. In the upper position, the pillow 80 is a head cushion for the support 10.

The strap 90 includes ends 92, 94. End 92 is coupled to end 26 of the membrane 22. The other end 94 of the strap 90 includes a fastener 96 and can be selectively attached to the membrane 22. In the illustrated embodiment, fastener 96 is a hook fastener that can be coupled to the membrane 22 of the seat portion. Thus, the pillow 80 can be disposed in a plurality of positions on the membrane 22 as determined by the strap 90.

In one embodiment, the strap 90 can be flipped over the upper coupler 116 and rest against or be secured to the back of the support 10. When the support 10 is collapsed, the pillow 80 can be positioned along strap 90 so that it is positioned between the frame 100 and the user when the support 10 is carried on the user's back.

Figure 22:
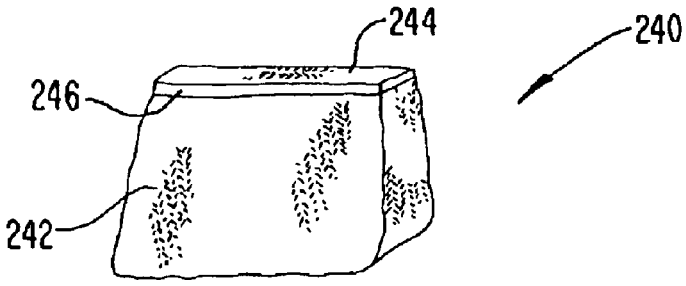
FIG. 22 illustrates an alternative embodiment of a pillow according to the present invention.

In the illustrated embodiment, the pillow is filled with a stuffing material. In an alternative embodiment, the pillow can be a pouch with a sealable opening into which material can be inserted. As illustrated in FIG. 22, pillow 240 may include a flexible membrane 242 that defines an opening 244. The pillow 240 can include a closing mechanism 246, such as a zipper or a hook and loop fastener, to close the opening 244. When the support 10 is in its expanded configuration, the cover 200 can be stuffed into the pillow 240 to enable the pillow 240 to be used as a support.

FIGS. 23–28 illustrate several alternative embodiments of shades that can be used with a support according to the present invention. Shades can be utilized with any type of support, including the support illustrated in FIGS. 1–3.

In the illustrated embodiments, each of the shades is releasably coupled to a support with tethering lines 314 and coupling elements 316. Coupling mechanisms other than tethering lines and coupling elements can be used to secure the shades to the supports. For example, straps with buckles, clips, or slide on pockets can be used. Alternatively, a shade can utilize sand anchors to position the shade relative to a chair, instead of coupling the shade to the chair.

Also, while the tethering lines are illustrated as secured to the shades via holes, the coupling mechanisms can be clipped, adhered, sewn, or connected to the shades using any other method of coupling items. The arrangement of the coupling mechanisms, including the holes on the shades, can vary depending on the desired arrangement.

Figure 23:
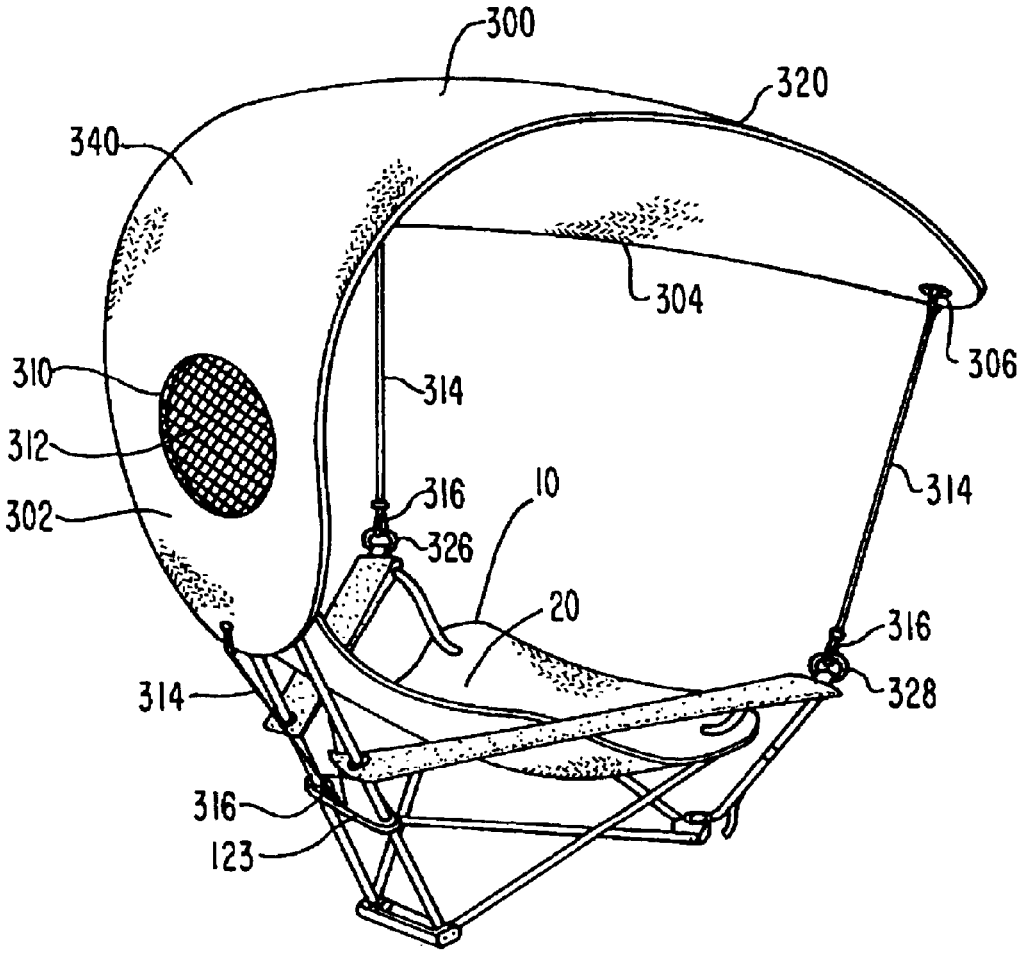
FIG. 23 illustrates a combination of a support and a shade according to the present invention.

In one embodiment, a support can include a shade 300 coupled thereto. In FIG. 23, shade 300 is coupled to the support 10 at three locations. Shade includes a membrane 340, a frame 320, and ends 302, 304. An opening 310 is formed in membrane 340 proximate to end 302. A fabric material 312, such as mesh, covers opening 310, which provides ventilation.

The membrane 340 is coupled to the frame 320 that provides support for the shade. In the illustrated embodiment, the frame 320 is a flexible band, such as a thin metal band. An example of a shade is disclosed in U.S. patent application Ser. No. 09/764,059, entitled "Collapsible Sunshade and Methods of Using the Same", filed Jan. 19, 2001, the disclosure of which is incorporated by reference herein.

The coupling mechanisms 316 are releasably secured to mounting elements that are connected to the support as illustrated. In one embodiment, the support 10 can include mounting elements 326, 328 located on the front frame portion 140.

Figure 24:
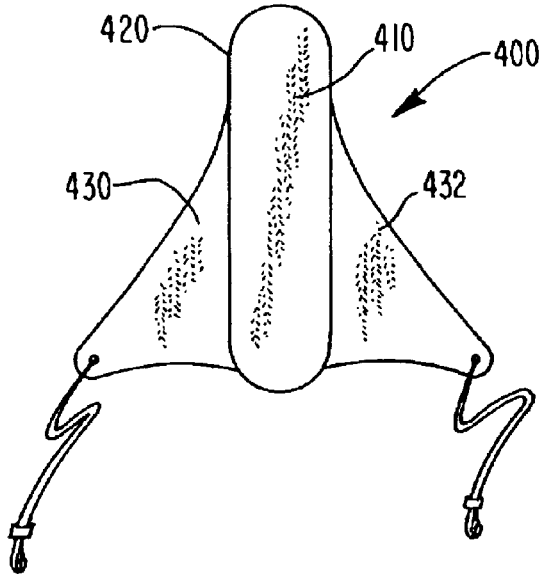
FIGS. 24–28 illustrate alternative embodiments of a shade according to the present invention.

As shown in FIGS. 23–28, the shape and features of the shade embodiments can vary. In FIG. 24, shade 400 includes a membrane 410, a frame member 420, and flaps 430, 432. The frame member 420 is a flexible metal band that provides support to the membrane 410. In this embodiment, the frame member 420 does not extend around the perimeter of the shade 400. The flaps 430, 432 are provided on the side of the center portion of the membrane 410.

Figure 25:
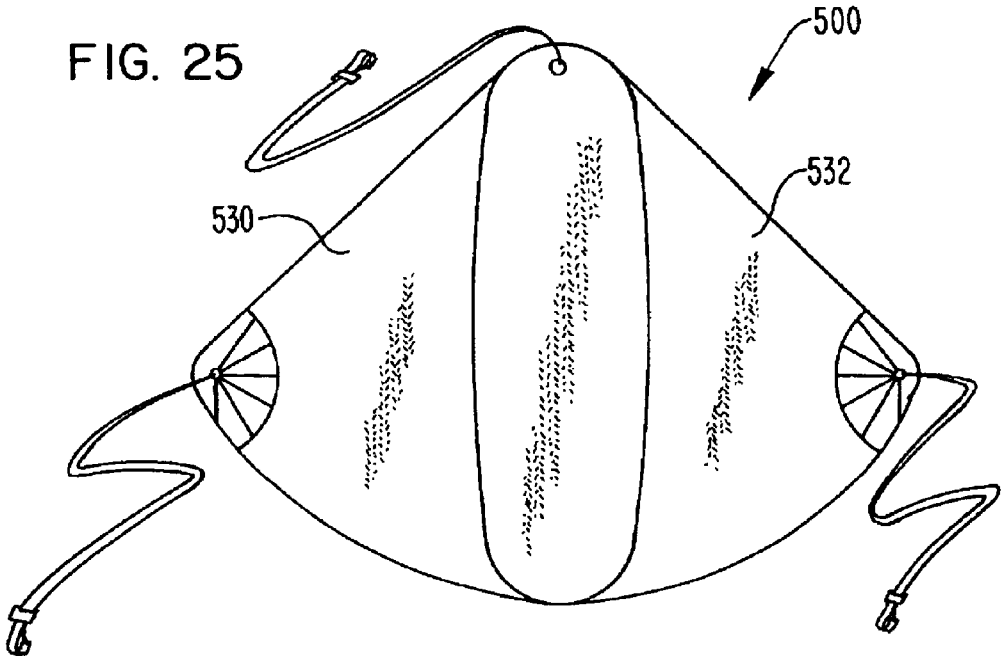
Figure 26:
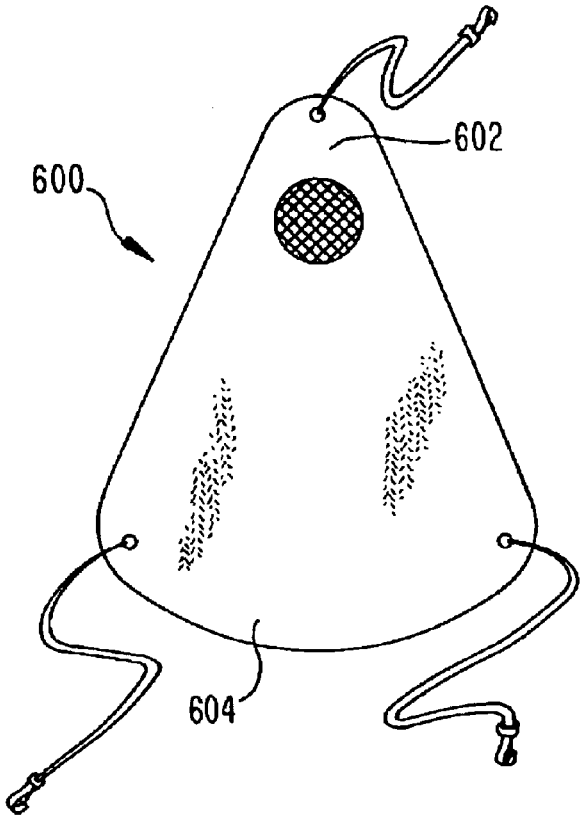
Figure 27:
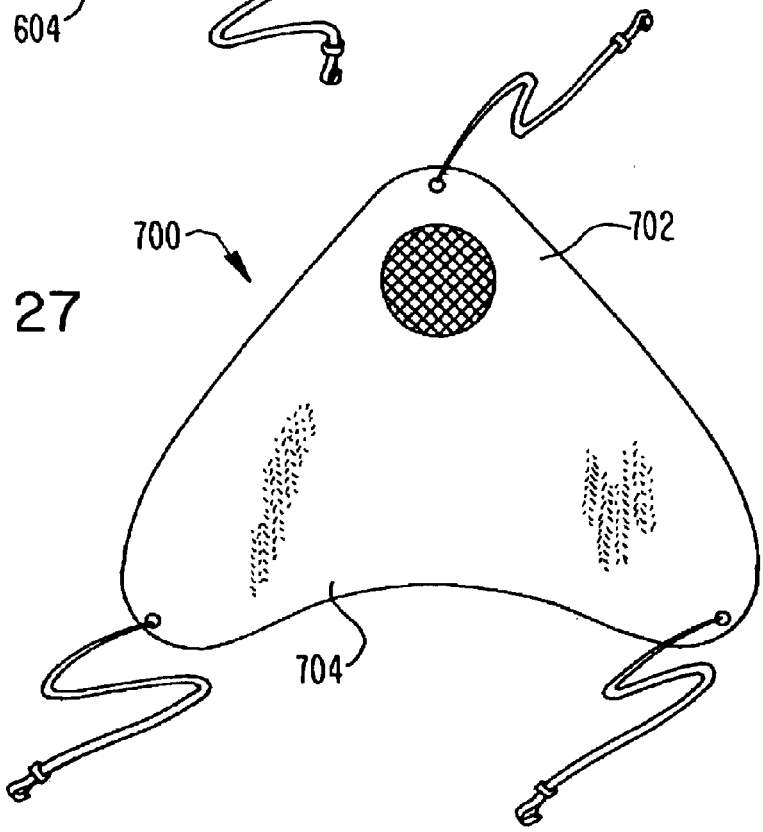

Additional embodiments of a shade are illustrated in FIGS. 25–28. In FIG. 25, shade 500 includes flaps 530, 532. Shade 500 is substantially similar to shade 400, which is shown in FIG. 19, with the exception of the shapes of the flaps. In FIG. 26, shade 600 includes ends 602, 604, one of which has an inwardly curved shape. In FIG. 27, shade 700 includes ends 702, 704, one of which has an outwardly curved shape.

Figure 28:
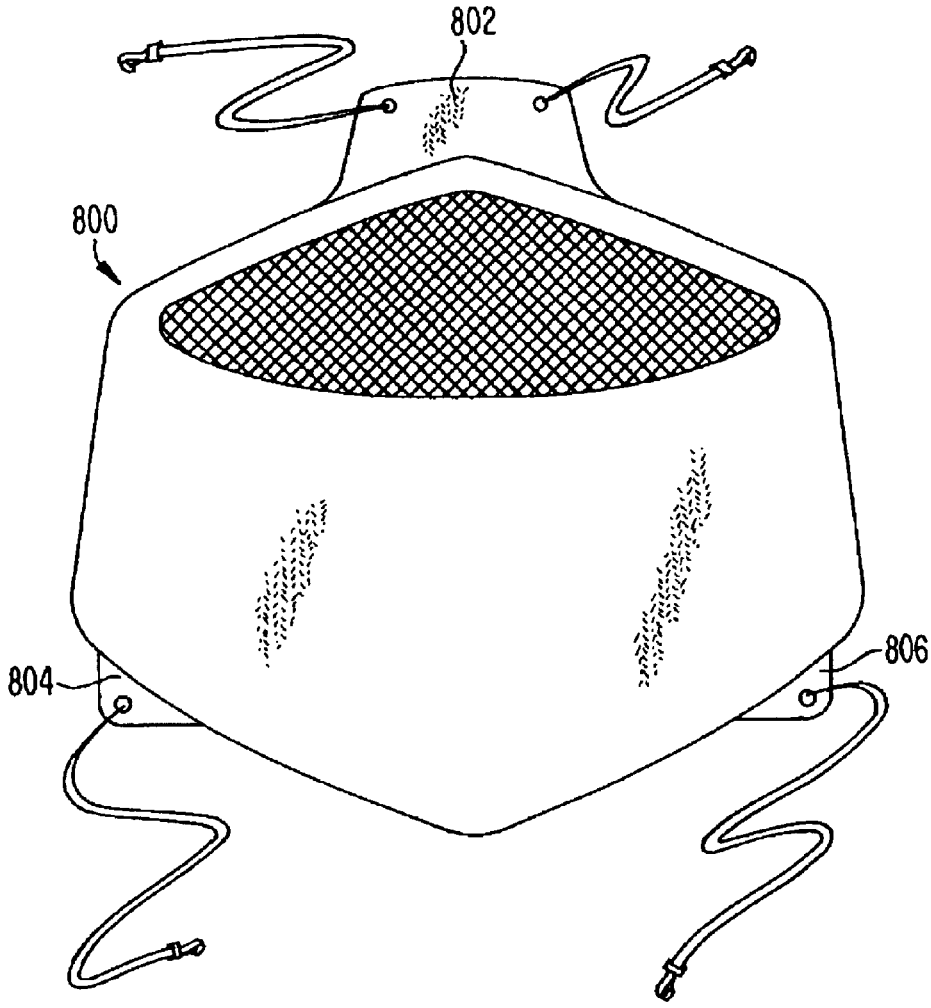

In FIG. 28, shade 800 has a hexagonal shape with several flaps 802, 804, 806 located on its perimeter.

The shapes of the shades, including the flaps, can be varied depending on the desired amount of protection from the sun, rain, etc. The frame member of a shade provides support and can be located in different portions of the shade, depending on the desired flexibility of the shade.

Figure 29:
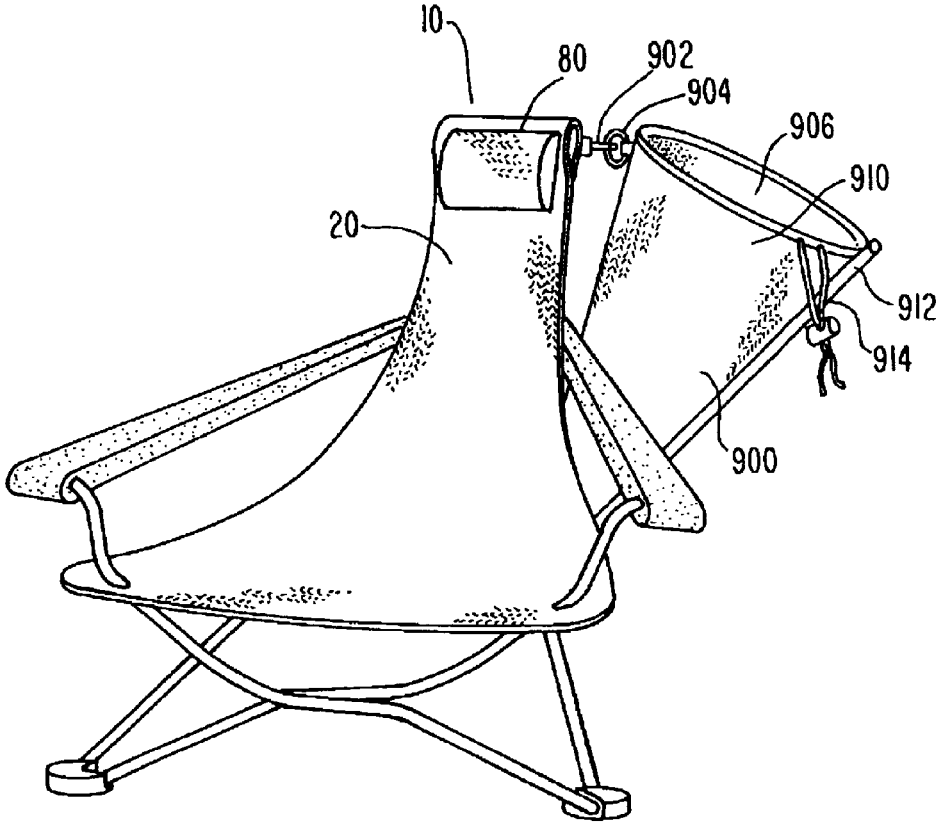
FIG. 29 illustrates an alternative embodiment of a support according to the present invention.

The support 10 can also include a storage bag 900 as illustrated in FIG. 29. The bag 900 includes a wall 910 that defines an opening 906 into which articles can be inserted. The opening 906 can be adjusted using a drawstring 914. The bag 900 includes a rod 912 along a portion of the wall 910. When the support 10 is in its expanded configuration the weight of the rod 912 causes the bag 900 to lean to one side of the support 10 to bias the bag 900 into an open position.

The support 10 is releasably coupled to the frame 100. In the illustrated embodiment, the support includes mounting element 904 that can be coupled to coupler 902 on the frame 100.

Alternatively, the support 10 can include a storage device 1000 as illustrated in FIGS. 30–33. The storage device 1000 includes mounting elements 1010, 1012, 1014, 1016, a mesh compartment 1030, a cooler compartment 1034, and pockets 1040, 1042, 1044. The support 10 includes couplers 1020, 1022, 1024, 1026 that can interact with the mounting elements 1010, 1012, 1014, 1016 to releasably couple the storage device 1000 to the support 10. For example, the storage device 1000 can be supported on the frame 100 when it is connected to primary mounting elements 1010, 1012, and one or both of the secondary mounting elements 1014, 1016.

Figure 30:
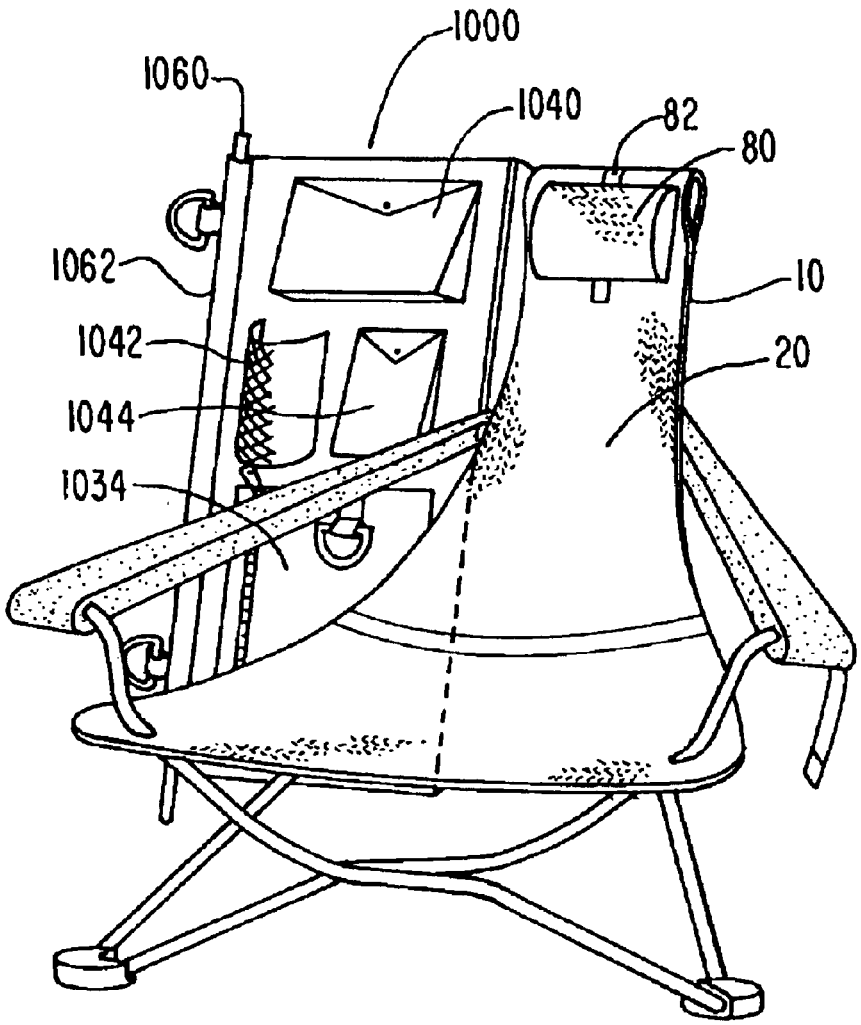
FIGS. 30–32 illustrate a combination of a support and a storage device according to the present invention.

As illustrated in FIG. 30, when the support 10 is in its expanded configuration, the storage device 1000 can be positioned on one side of the support 10 to allow for easy access to the cooler compartment 1034 and the pockets 1040, 1042, 1044.

Figure 31:
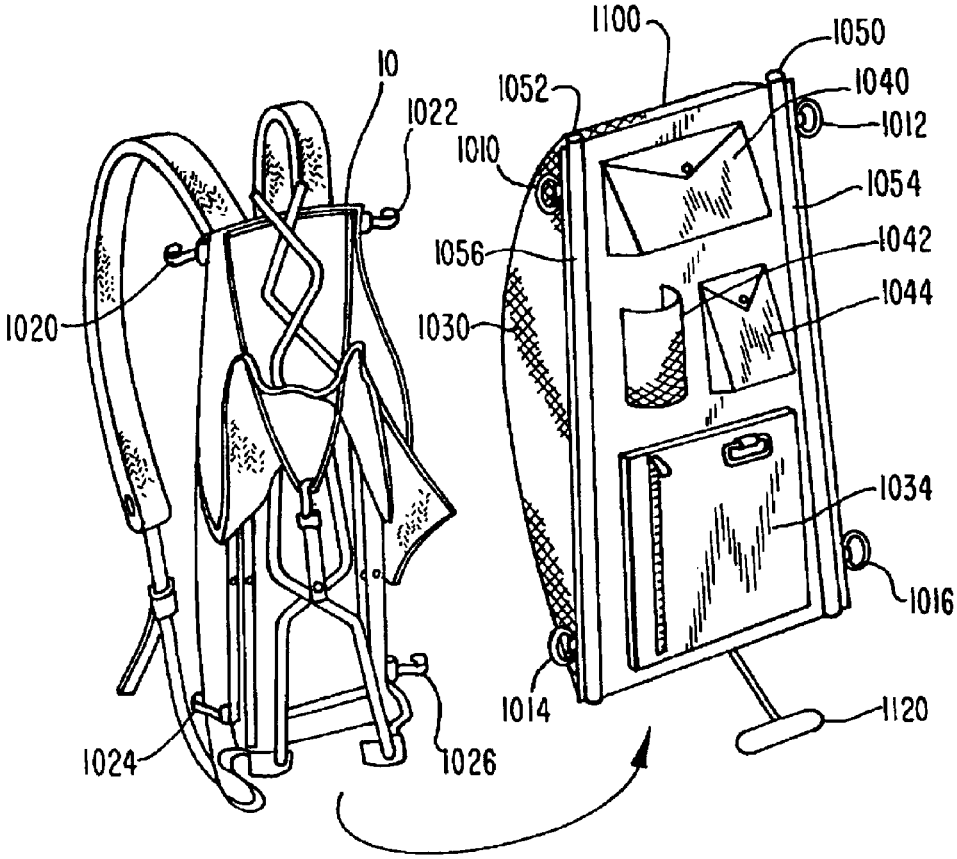
Figure 32:
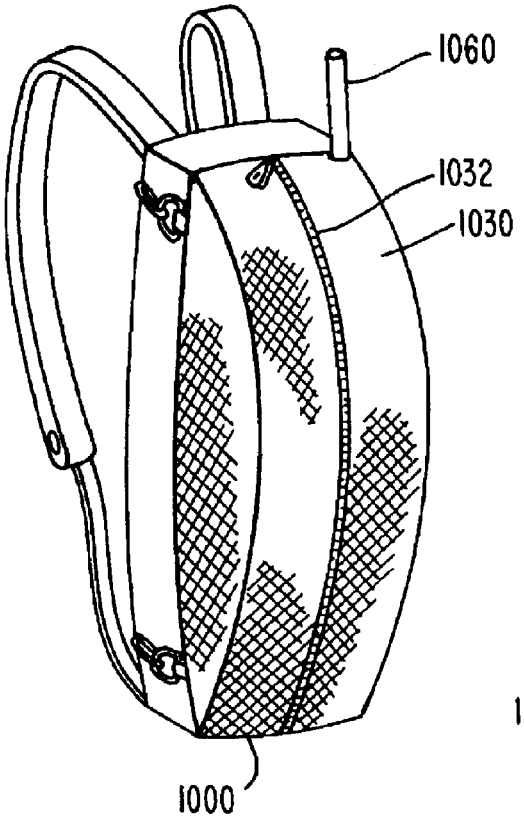
Figure 33:
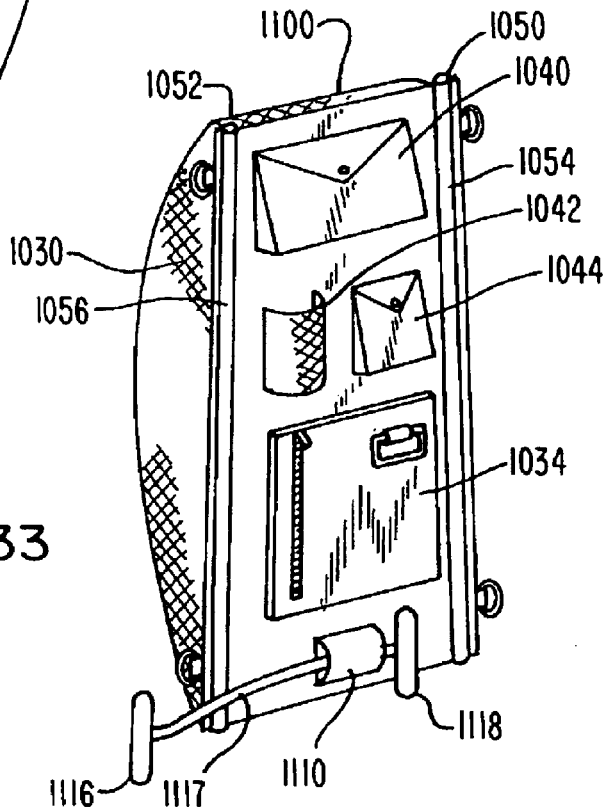
FIG. 33 illustrates an alternative embodiment of a storage device according present invention.

As illustrated in FIGS. 31–32, when the support 10 is in its collapsed configuration, the storage device 1000 can be coupled to the support 10 opposite the tension members 40, 70. The connection of the storage device 1000 and the support 10 allows for easy transportation of the storage device 1000 with the support 10.

In one embodiment of the storage device 1000, as illustrated in FIGS. 30 and 32, the storage device 1000 includes a stake 1060 and a sleeve 1062. The stake 1060 is stored in the sleeve 1062 when the support 10 is in its collapsed configuration.

The stake 1060 can extend through the sleeve 1062 when the support 10 is in its expanded configuration. When the stake 1060 extends from the sleeve 1062, the stake 1060 engages a support surface to provide support for the storage compartment 1000.

As illustrated in FIG. 31, storage device 1100 includes frame members 1050, 1052 and an anchor 1120. The frame members 1050, 1052 are mounted in sleeves 1054, 1056 and provide rigidity to the storage device 1110. The anchor 1120 can be used to support the storage device 1100 when the support 10 is in its expanded configuration.

The anchor 1120 can be releasably coupled to the frame members as illustrated in FIG. 31, or can be coupled at any point along the bottom or side of the storage device 1100.

In one embodiment, two anchors 1116, 1118 can be coupled to a single strap 1117 that is slidably threaded through loop 1110. In one embodiment, the storage device can include two or more loops through which the strap is threaded. Depending on the orientation of the storage device 1100, anchor 1116 or anchor 1118 can be pulled out to one side to be engaged with a supporting surface and to secure the storage device 1100. Strap 1117 can be any flexible, elongated member that can be positioned along the storage device 1110.

Many possible variations on the particular embodiments described above would be consistent with the principles of the invention. Several additional variations are described below.

Figure 34:
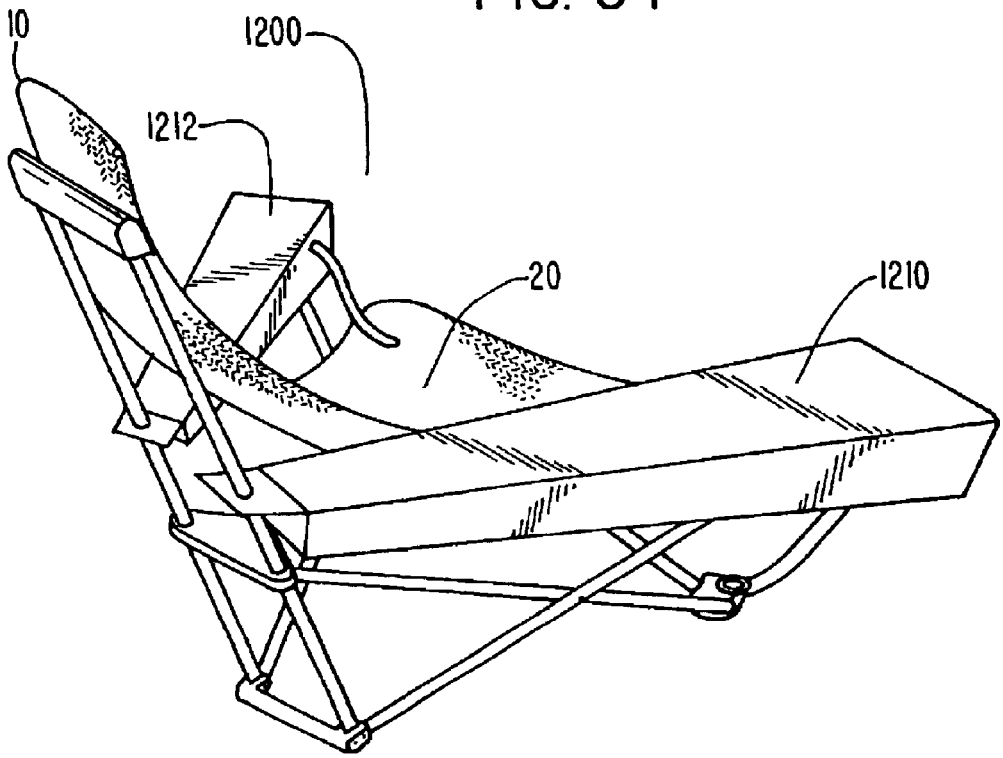
FIG. 34 illustrates an alternative embodiment of a support according to the present invention.

In one embodiment, the support 1200 can include floatation devices. As illustrated in FIG. 34, support 1200 includes floatation devices 1210, 1212 coupled to the tension members 40, 70. Additional floatation devices can be coupled to the support 10 at different locations to increase the buoyancy of the support 1200. For example, a floatation device can be positioned beneath part of the seat portion.

In the illustrated embodiment, floatation devices are inflatable members that are coupled to the tension members. The floatation devices can be any device that can float (i.e., has a density less than that of water).

Figure 35:
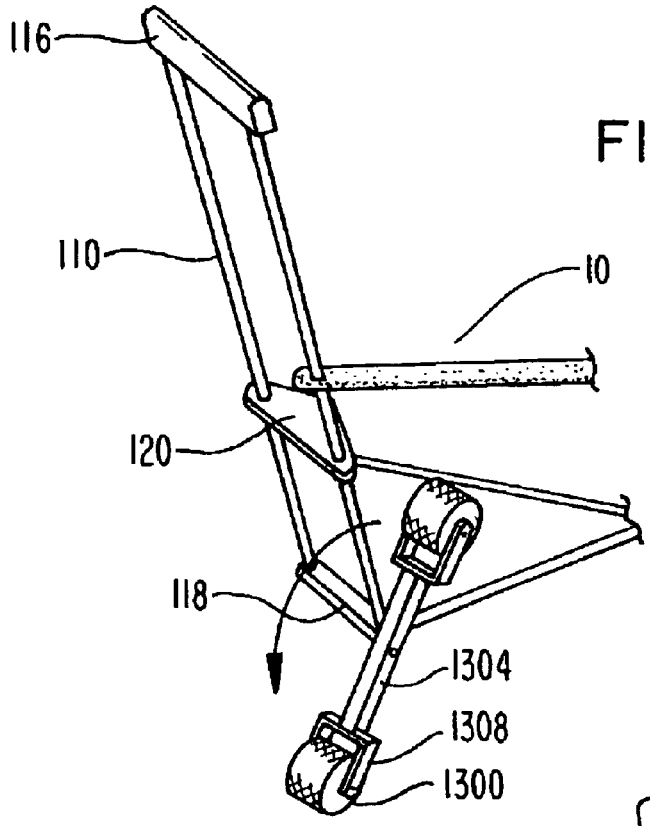
FIGS. 35–36 illustrate alternative embodiments of a support according to the present invention.

In one embodiment, the support 10 can also include wheels coupled to support members that are pivotally coupled to the frame. As illustrated in FIG. 35, a wheel 1300 is rotatably mounted to a wheel support member 1310 that is coupled to the frame. The wheel support member 1310 can be moved between an upper position and a lower position as represented by the arrow in FIG. 35. Thus, when the support 10 is in its expanded configuration the wheel 1300 can be pivoted into and out of contact with the support surface. A user can lift up the front frame portion of the support so that only the wheels contact the support surface. Accordingly, the user can easily pull the support to a different location.

Figure 36:
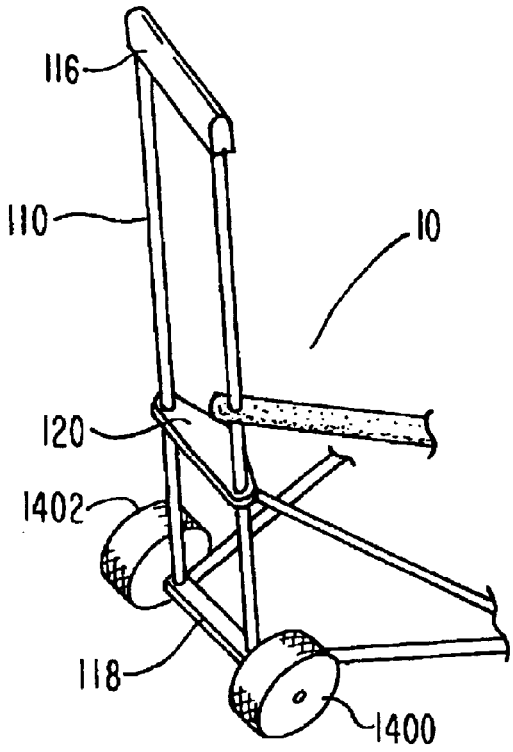

In another embodiment, the support 10 can include wheels 1400, 1402 as illustrated in FIG. 36. In this embodiment, the wheels 1400, 1402 are rotatably mounted to an axle positioned proximate to the lower coupler 118. A locking mechanism (not shown) can be provided to lock the wheels 1400, 1402.

Figure 37:
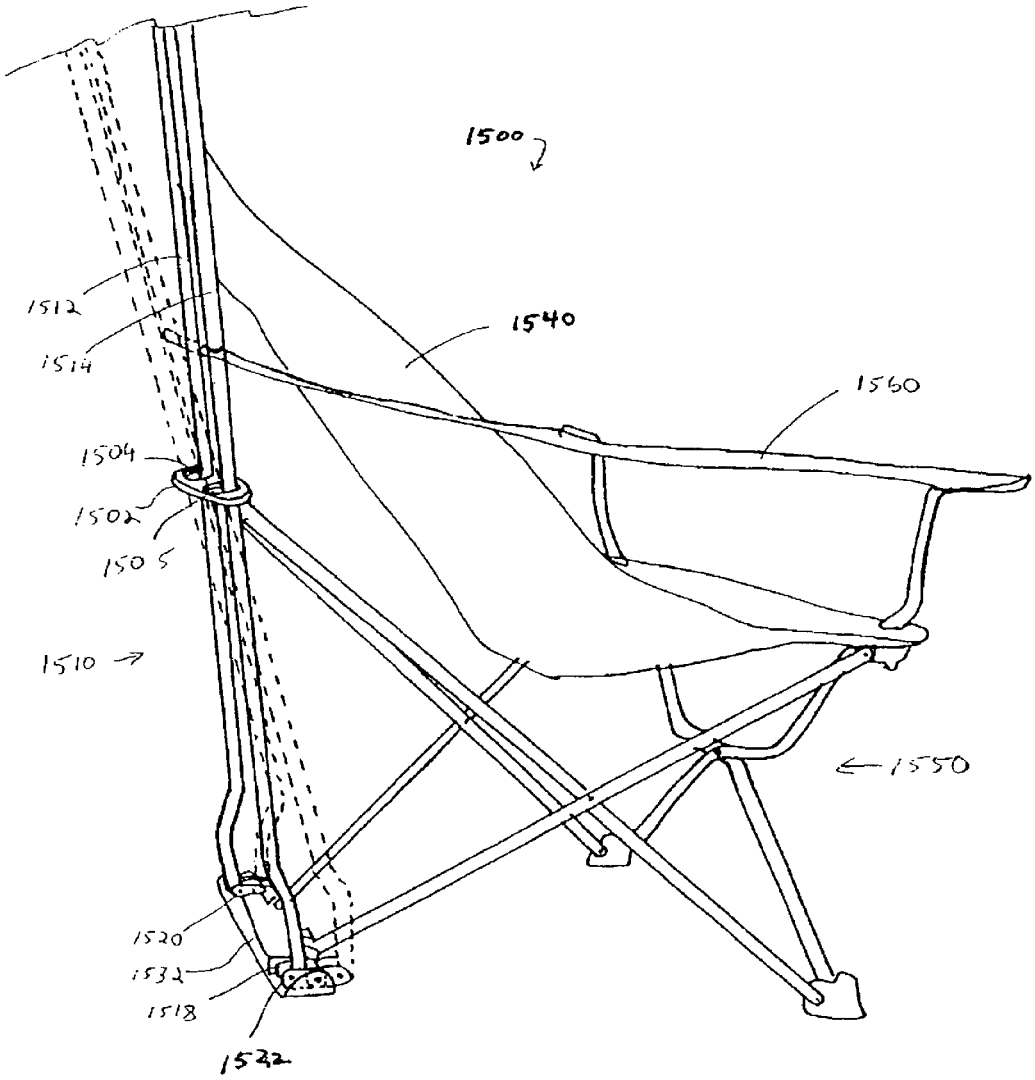
FIG. 37 illustrates a side view of a support according to an alternative present of the invention.
Figure 38:
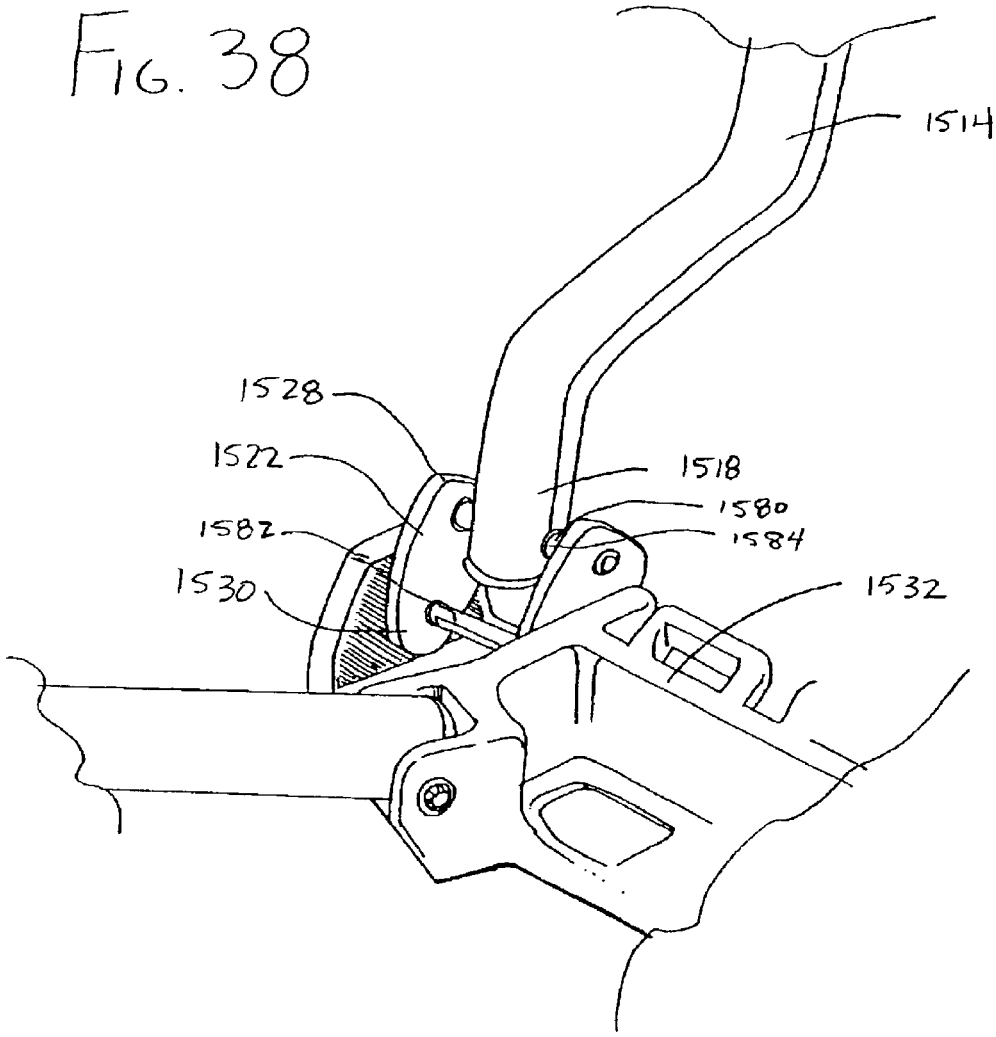
FIG. 38 illustrates a perspective view of a rear portion of the support of FIG. 37.
Figure 39:
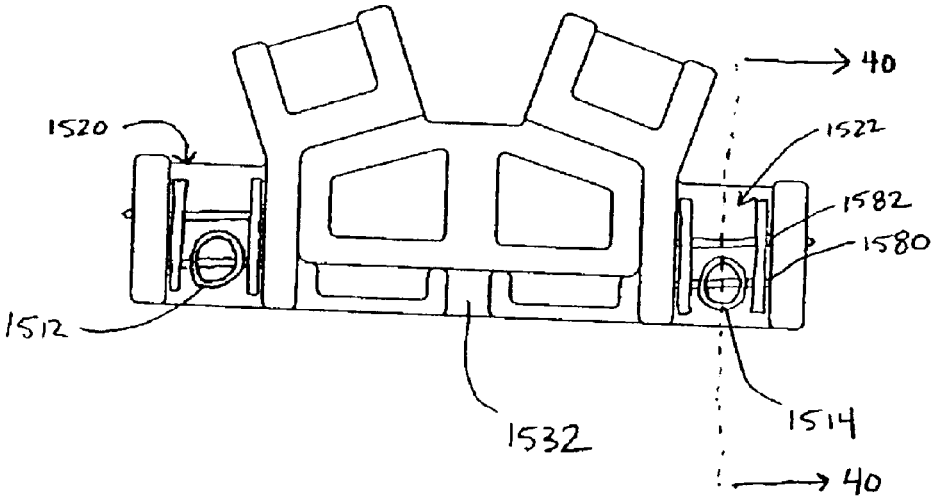
FIG. 39 illustrates a top view of a rear portion of the support of FIG. 37.
Figure 40A:
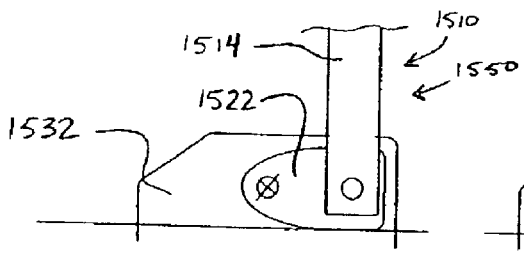
FIGS. 40*a*–40*d* illustrate cross-sectional views of a rear portion of the support of FIG. 37.
Figure 40B:
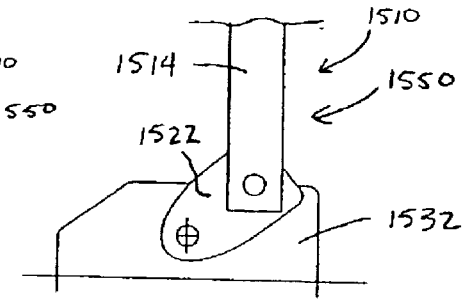
Figure 40C:
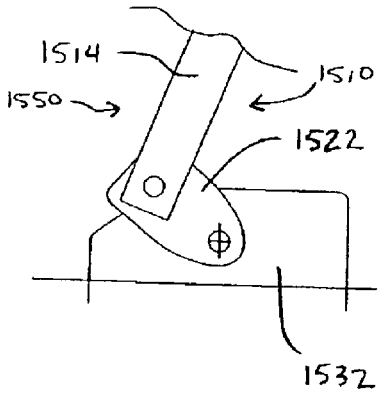
Figure 40D:
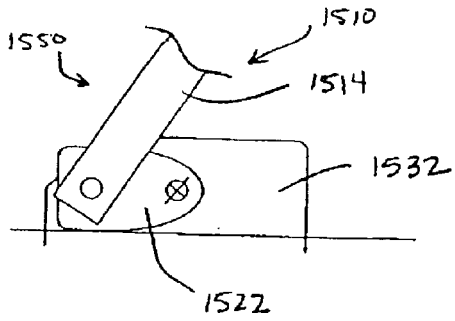

Another embodiment of the invention is illustrated in FIGS. 37–40. In this embodiment, a support 1500 has a frame 1550, a seat 1540, and tension members 1560 (although two are present only one is shown in FIG. 37). Similar to the above-described embodiments, the frame 1550 can be placed in an expanded configuration and in a collapsed configuration. The frame 1550, while in an expanded configuration, can be placed in an upright position and in a reclined position. The frame 1550 has a rear frame portion 1510 that includes a pair of support members 1512 and 1514, a pair of extension members 1520 and 1522, a coupler 1532 and guide plate 1502.

In the illustrated embodiment, the support members are hollow metal tubes, but as described above for support members 112 and 114, the support members 1512 and 1514 can be made of different materials and have different cross-sectional shapes.

The extension members 1520 and 1522 are similar in structure and function, thus only extension member 1522 will be discussed in detail. The extension member 1522 is elongated in shape. Extension member 1522 has a first end 1528 and a second end 1530. The first end 1528 of the extension member 1522 is pivotally coupled to the lower end 1518 of the support member 1514. The second end 1530 of the extension member 1522 is pivotally coupled to the coupler 1532.

In the illustrated embodiment, the extension member 1522 is pivotally coupled to support member 1514 and to the coupler 1532 via rods 1580 and 1582, respectively, that extend through the coupled components. For example, rod

1580 extends from one side of the extension member 1522, through the support member 1514 (via through holes 1584), and through another side of the extension member. In an alternative embodiment, the extension member is pivotally coupled to the support member and to the coupler via rivets, brads, or another connection device known in the art that would provide a pivotal connection between the coupled components.

As best illustrated in FIGS. 40*a*–40*d*, the rear frame portion 1510 can be pivoted with respect to the coupler 1532 to convert the frame 1550 from an upright position to a reclined position. Support member 1512 and elongate member 1520 function in a similar manner as support member 1514 and elongate member 1522, thus only the movements of support member 1514 and elongate member 1522 are illustrated and discussed in detail. To recline the frame 1550, the support member 1514 can be lifted from its initial upright position on the coupler 1532. Then the extension member 1522 can be pivoted with respect to the coupler 1532, and the support member 1514 can be pivoted with respect to the extension member 1520. These steps can then be repeated for support member 1512 and extension member 1520 to place the frame 1550 in a reclined position. The steps of this process can be reversed to convert the frame 1550 from a reclined position to an upright position.

Note that as support 1500 is moved between the upright position and the reclined position, the support members 1512 and 1514 slide through holes 1504 and 1505 of guide plate 1502. The diameters of the holes 1504 and 1505 are greater than the diameters of support members 1512 and 1514, respectively. Consequently, as the support 1500 is moved between the upright position and the reclined position, the incline of support members 1512 and 1514 can change while still allowing the support members 1512 and 1514 to be capable of slidely moving within guide plate 1502. For example, support members 1512 and 1514 can slide within guide plate 1502 when moving support 1500 into a collapsed configuration.

Figure 41:
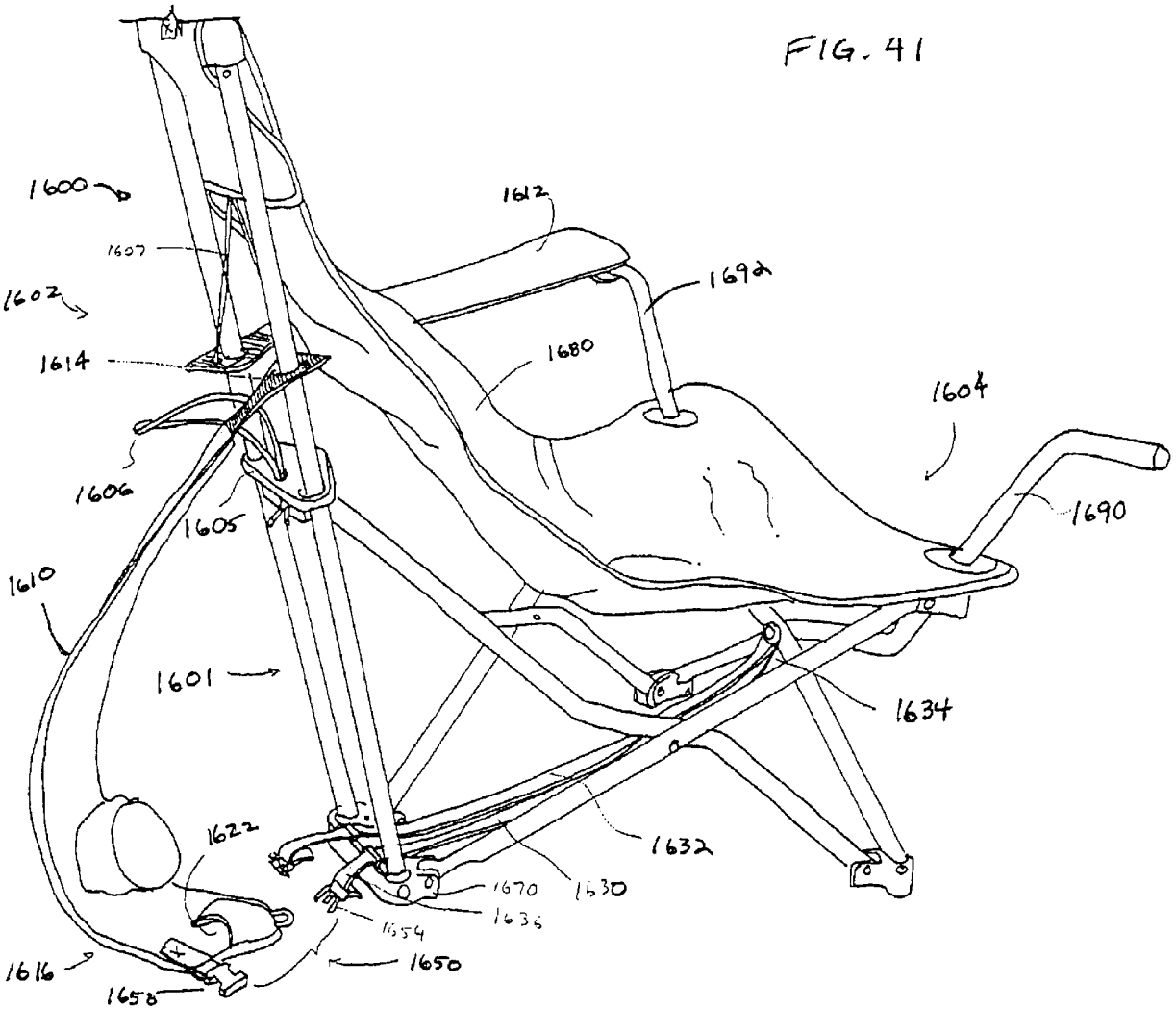
FIG. 41 illustrates a rear perspective view of a support according to an alternative embodiment of the invention.
Figure 42:
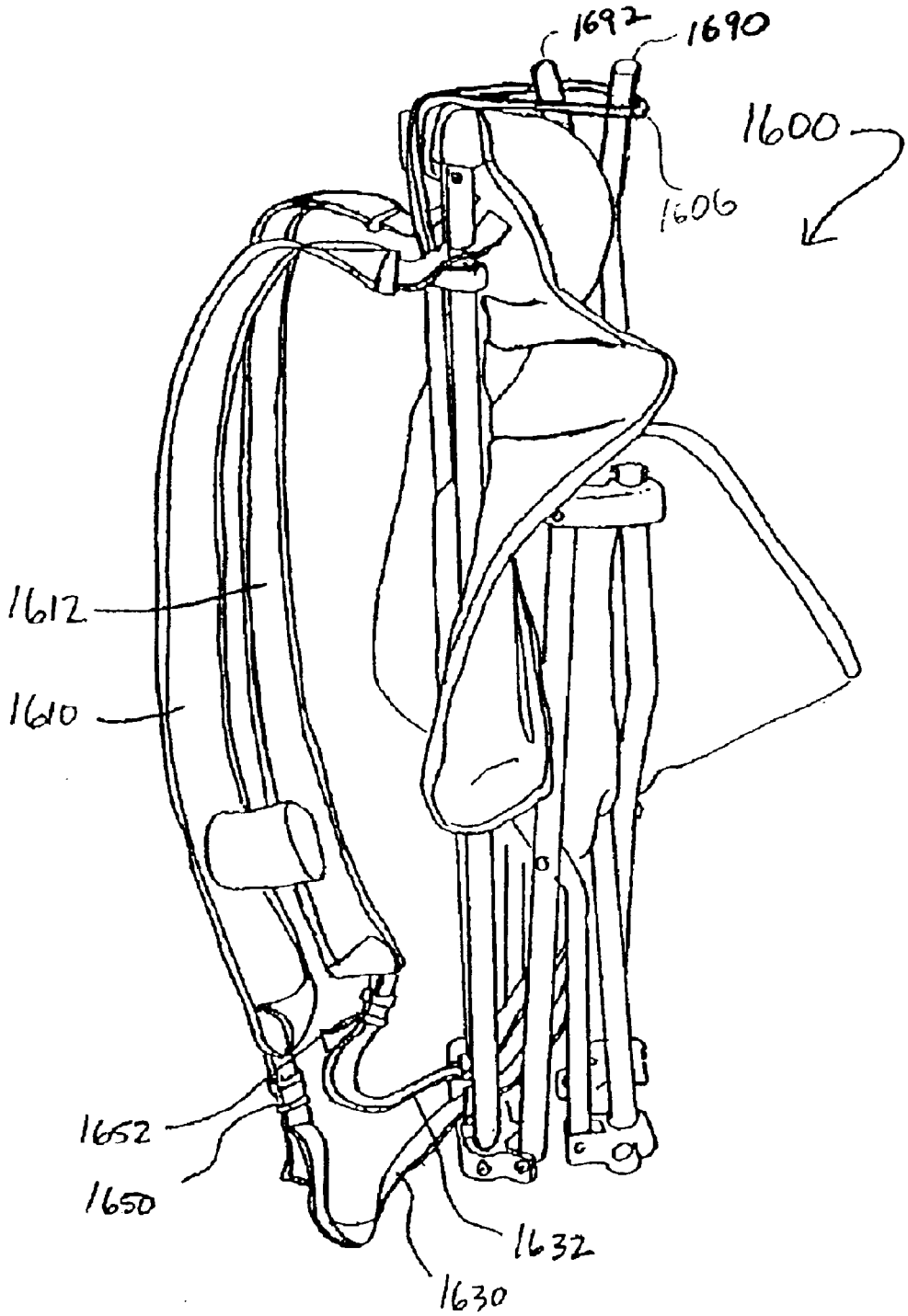
FIG. 42 illustrates a side view of the support of FIG. 41 in a collapsed configuration.

Another embodiment of the invention is illustrated in FIGS. 41–42. In this embodiment, a support 1600 has a frame 1601, a coupler 1670, a seat 1680, tension members 1610 and 1612, elongate members 1630 and 1632, guide plate 1605 and guide-plate member 1606. Frame 1601 also includes members 1690 and 1692. Similar to the above-described embodiments, the frame 1601 can be placed in an expanded configuration and in a collapsed configuration. Also similar to the above-described embodiments, each of the tension members 1610 and 1612 can be placed in two positions. The tension members 1610 and 1612 can be placed in a first position when the frame 1601 is in its expanded configuration to provide supports for the arms of a user. In addition, the tension members 1610 and 1612 can be placed in a second position when the frame is in its collapsed configuration to serve as shoulder straps while support 1600 is being transported on the user's back.

Tension members 1610 and 1612 are functionally and structurally similar. Thus, although only tension member 1610 is discussed in detail, the same features are present for tension member 1612. Tension member 1610 has a first end 1614 that is coupled to a rear frame portion 1602 of the frame 1601 and a second end 1616. The vertical position of first end 1614 of tension member 1610 can be maintained by support 1607. In other words, the extent to which the first end 1614 of tension member 1610 slides down its respective the support member is defined by the support 1607. Tension member 1610 also has a sleeve 1622 that is located near the second end 1616 of the tension member. The sleeve 1622 is configured to selectively couple the second end 1616 of the tension member 1610 to a front frame portion 1604 of the frame 1601 when the frame is its expanded configuration. In this position, tension member 1612 provides support for an arm of a user. In an alternative embodiment, the tension member does not include a sleeve, but rather includes another coupling device, such as a strap or a clip, that can be used to selectively couple the second end of the tension member to the front frame portion.

Elongate members 1630 and 1632 can be structurally similar. Thus, although only elongate member 1630 is discussed in detail, the same features are present for elongate member 1632. Elongate member 1630 has a first end 1634 and a second end 1636. The first end 1634 of the elongate member 1630 is coupled to the front frame portion 1604. The second end 1636 of the elongate member 1630 is configured to be selectively coupled to the second end 1616 of the tension member 1610. Thus, when the frame 1601 is in its collapsed configuration, the second end 1636 of the elongate member 1630 can be coupled to the second end 1616 of the tension member 1610 to form a strap that can be placed over a shoulder of a user to retain the support 1600 on the user.

Because the first end 1634 of elongate member 1630 is coupled the front frame portion 1604, the second end 1636 of elongate member 1630 is drawn inwardly when the support 1600 is moved from the collapsed configuration to the expanded configuration. This allows the connector 1654 also to be drawn inwardly so that it is disposed close to the support 1600 and out of the way of the user when in the expanded configuration. When the support 1600 is moved from an expanded configuration to a collapsed configuration, the elongate member 1630 can be drawn outwardly to provide a greater overall length to the strap formed by tension member 1610 coupled to elongate member 1630.

Note that although the elongate members 1630 and 1632 are shown as straps, elongate members can be cables, cords or any appropriate type of material that can be slidably coupled to coupler 1670 and can be used to form a shoulder strap. In an alternative embodiment, the elongate members are not coupled to the front frame portion, but rather are fixedly coupled to the rear frame portion; the particular length of the elongate members can be selected so that distance from the rear frame portion is minimized while optimizing the shoulder strap length when the support is in a collapsed configuration.

In the illustrated embodiment, a coupling mechanism 1650 is used to selectively couple the second end 1636 of the elongate member 1630 to the second end 1616 of the tension member 1610. The coupling mechanism has a female portion 1658 coupled to the second end 1616 of the tension member 1610 and a male portion 1654 coupled to the second end 1636 of the elongate member 1630. The female portion 1658 and the male portion 1654 can be coupled to the respective ends of the members via any known method, such as by sewing or gluing the portion to the member.

In an alternative embodiment, the coupling mechanism 1650 is a hook and loop device, a lock and key mechanism, a fastener, a clip, a button or another item by which the tension member 1610 can be removably coupled to the elongate member 1630.

A coupling mechanism 1652, which is similar to coupling mechanism 1650, is used to couple tension member 1612 to elongate member 1632.

In the illustrated embodiment, the elongate members 1630 and 1632 are slidably coupled to the coupler 1670, however the elongate members need not be slidably coupled to the coupler or to any other portion of the support 1600. In an alternative embodiment, the elongate members are slidably coupled to the frame of the support.

FIG. 42 shows the support in a collapsed configuration. As shown in FIG. 42, the guide-plate member 1606 can be pulled over the end of the frame member 1690 and 1692 to maintain the support in the collapsed configuration and prevent it from unfolding.

Figure 43:
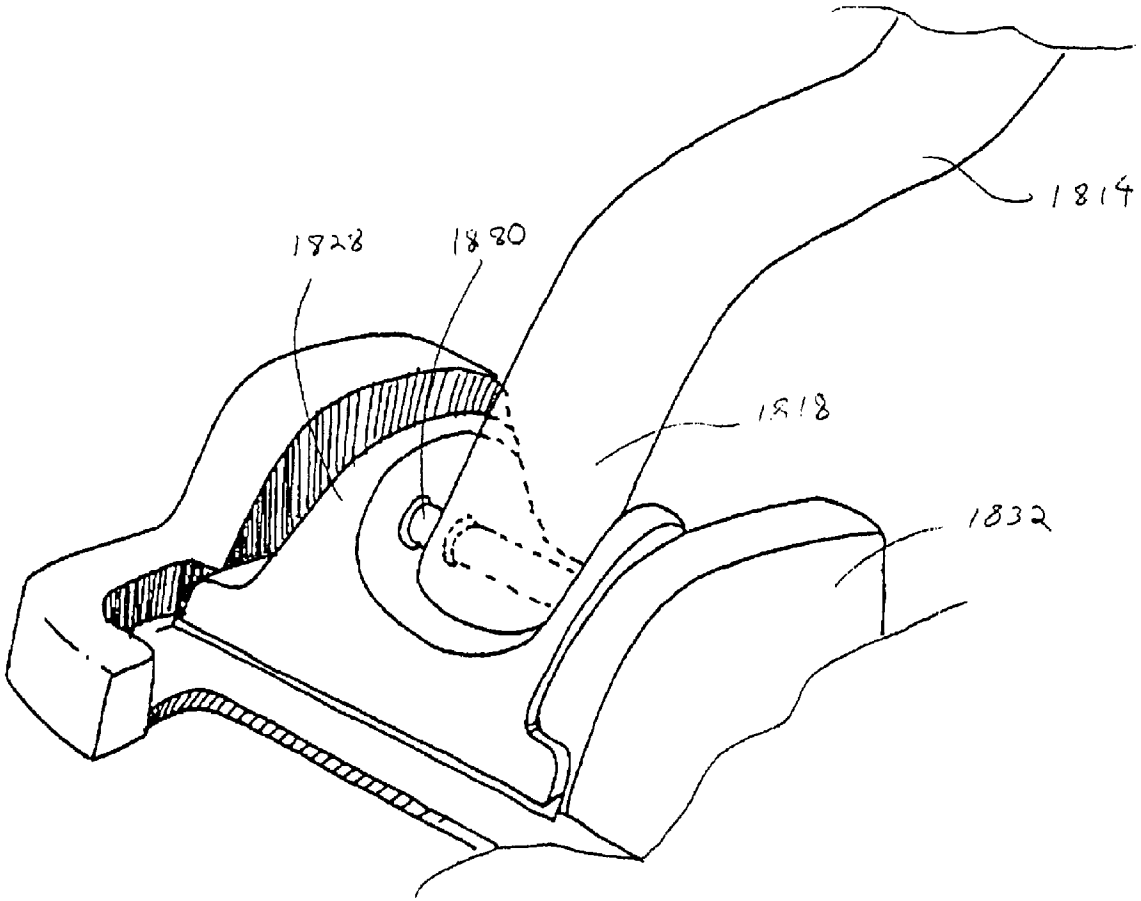
FIG. 43 shows a perspective view of a rear portion of a support in an upright position, according to an embodiment of the invention.
Figure 44:
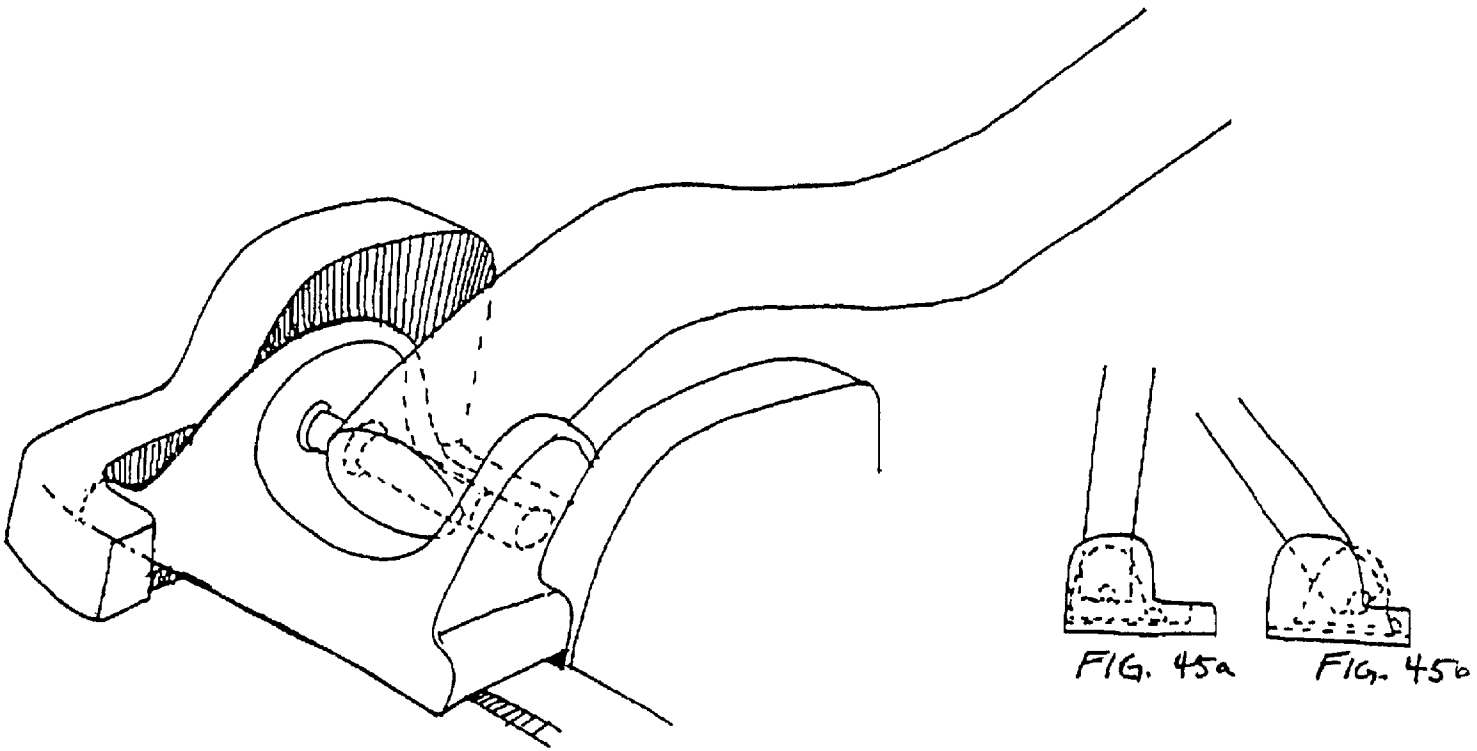
FIG. 44 shows a perspective view of the rear portion of the support shown in FIG. 43 in a reclined position.

An alternative embodiment of the support is shown FIGS. 43–45. In the shown embodiment, the support member 1814 is pivotably coupled to collar 1828 by rod 1880. Collar 1828 is slidably attached to coupler 1832. The support is in an upright position when the collar 1828 is positioned as shown in FIGS. 43 and 45*a*. The support is in a reclined position when the collar 1828 is positioned as shown in FIGS. 44 and 45*b*. As the support moves between the upright position and the reclined position, member 1814 has a range of motion pivoting around rod 1880.

Figure 46:
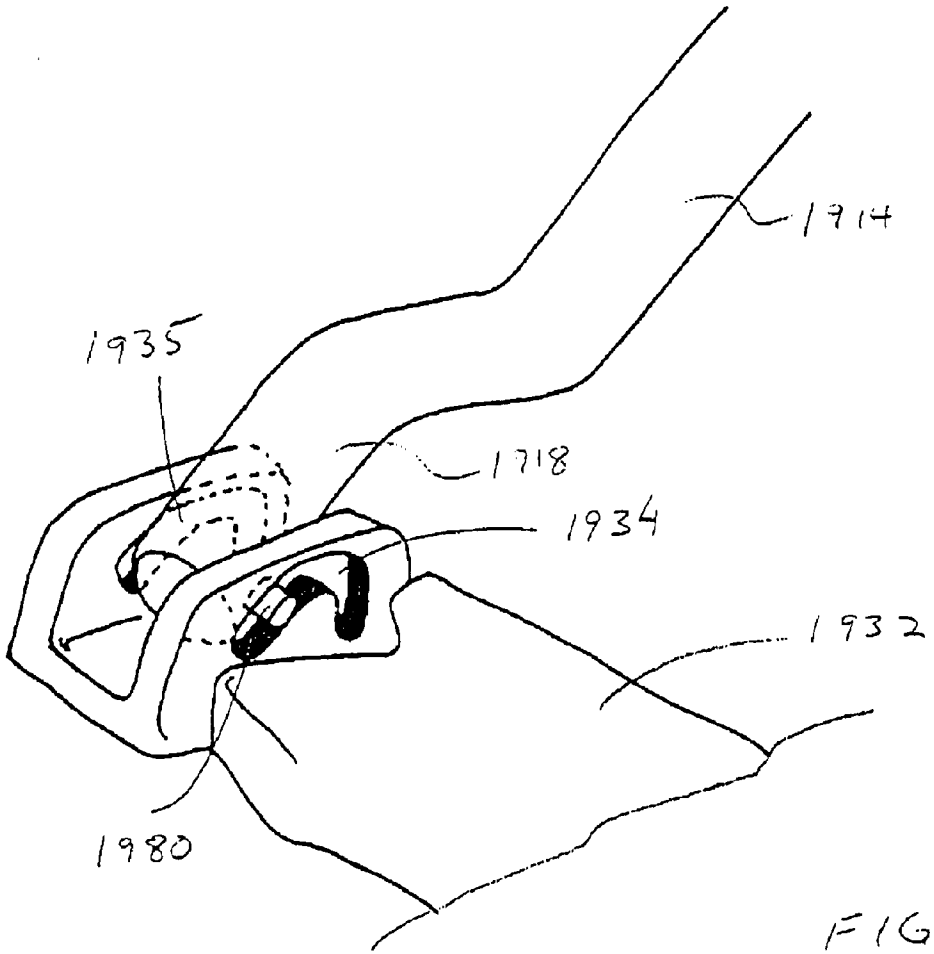
FIG. 46 shows a perspective view of a rear portion of a support in an upright position, according to another embodiment of the invention.
Figure 47:
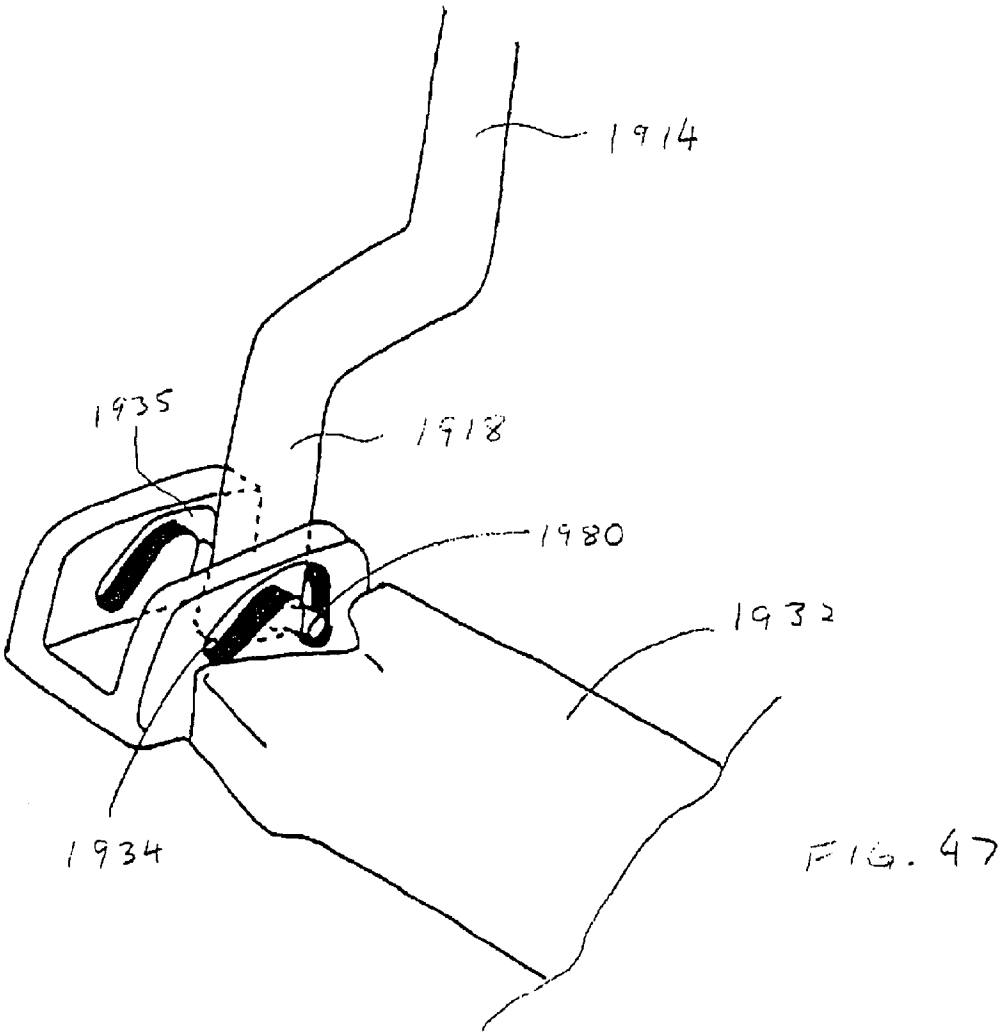
FIG. 47 shows a perspective view of the rear portion of the support shown in FIG. 46 in a reclined position.

Yet other alternative embodiment of the support is shown FIGS. 46–47. In the shown embodiment, the support member 1914 includes rod 1980. Coupler 1932 includes grooves 1934 and 1935. Rod 1980 is slidably coupled to coupler 1932 and has a range of motion within grooves 1934 and 1935. The support is in an upright position when the rod 1980 is in the rear position within grooves 1934 and 1935, as shown in FIG. 47. The support is in a reclined position when the rod 1980 is in the front position within grooves 1934 and 1935. FIG. 46 shows the rod 1980 in an intermediate position near the front position.

Another embodiment of the invention is illustrated in FIGS. 48–52. In this embodiment, a support 1700 has a frame 1702, a seat 1704, tension members 1706 and 1708, and a shade 1710. The shade 1710 includes a first end 1711, a second end 1713, a membrane portion 1712, a frame portion 1714, and a resilient or shape-retention portion 1716. The frame portion 1714 is a flexible band that provides support to the membrane portion 1712 to keep the membrane portion relatively taut within the interior area defined by the frame portion. In the illustrated embodiment, the frame portion 1714 extends around the entire perimeter of the membrane portion 1712. In an alternative embodiment, the frame portion extends around only a portion of the perimeter of the membrane portion.

Figure 48:
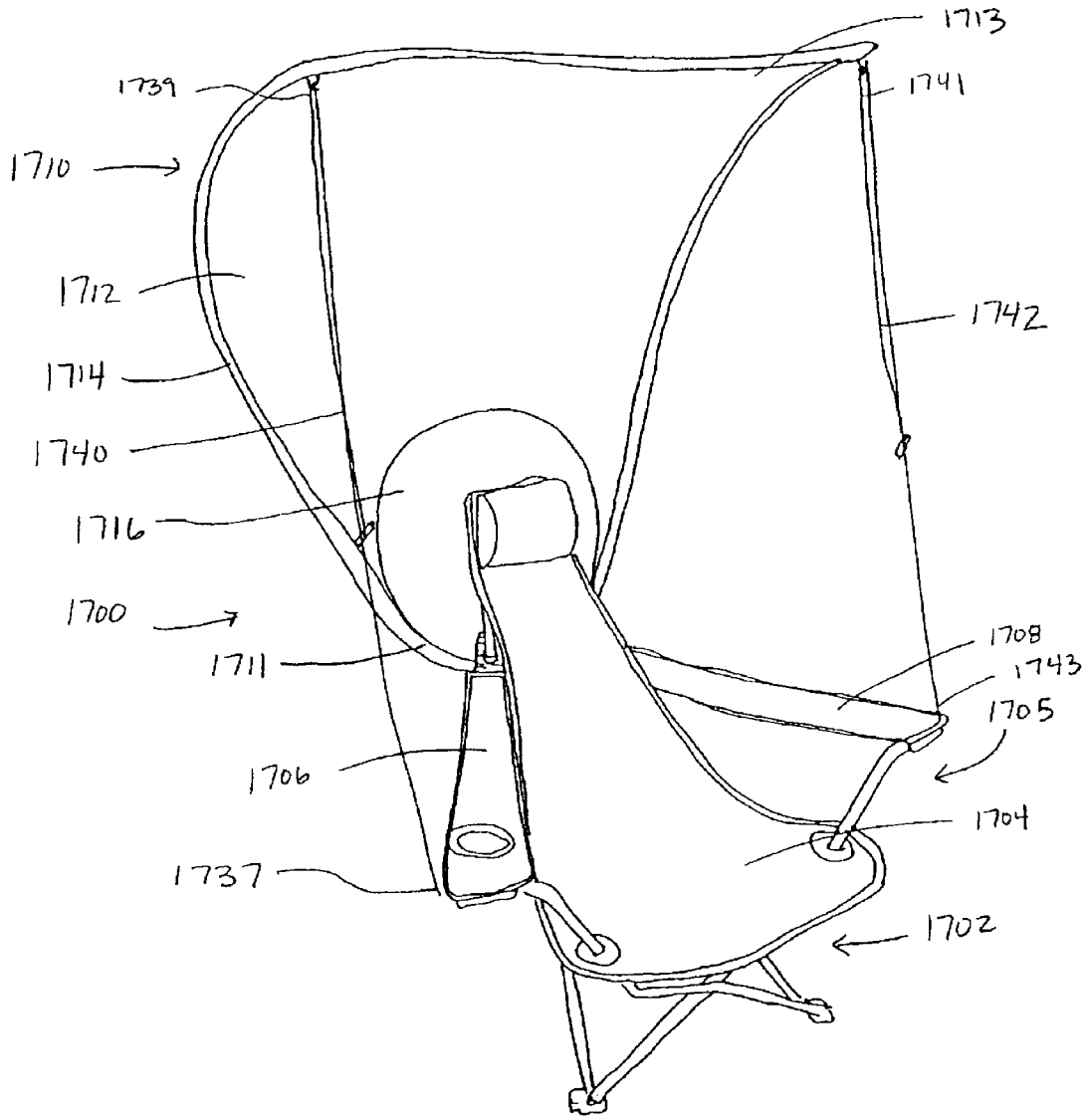
FIG. 48 illustrates a front perspective view of a combination of a support and a shade according to an alternative embodiment of the invention.
Figure 51:
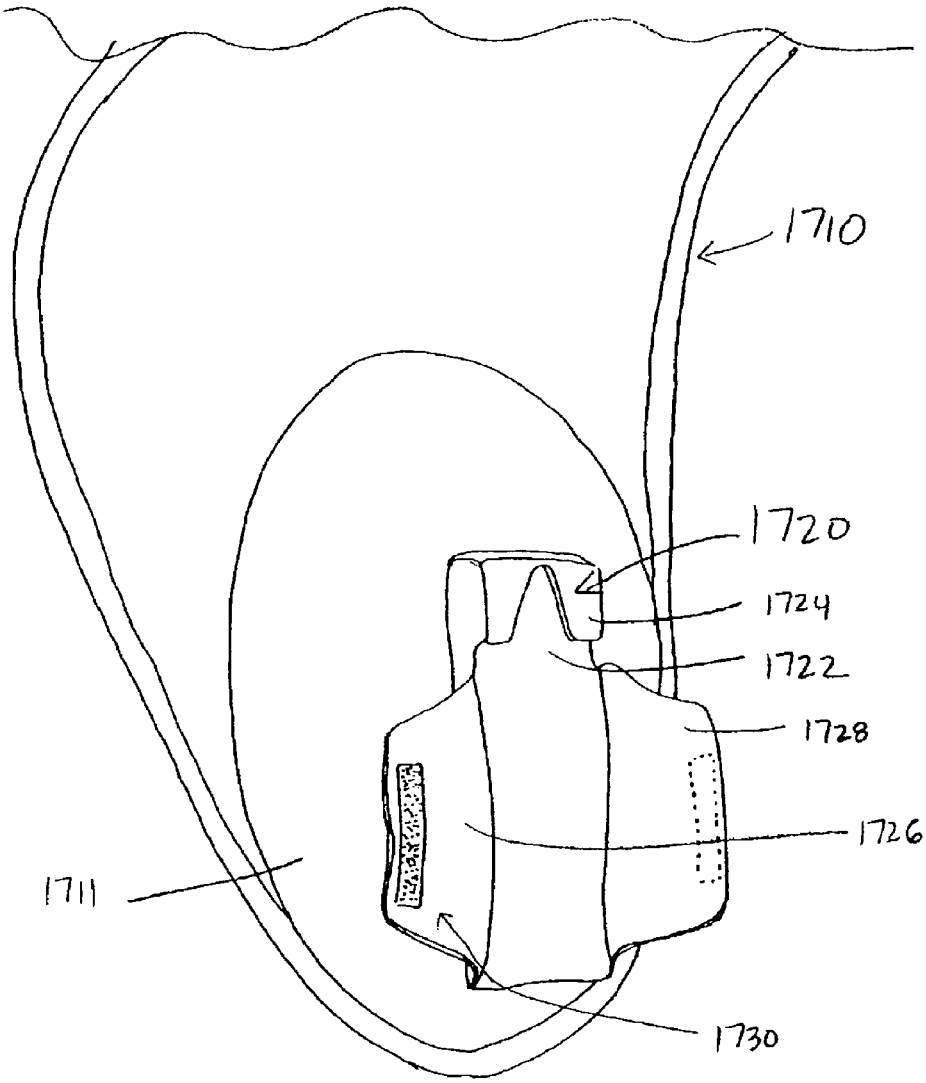
FIG. 51 illustrates a front perspective view of the shade of FIG. 48.
Figure 52:
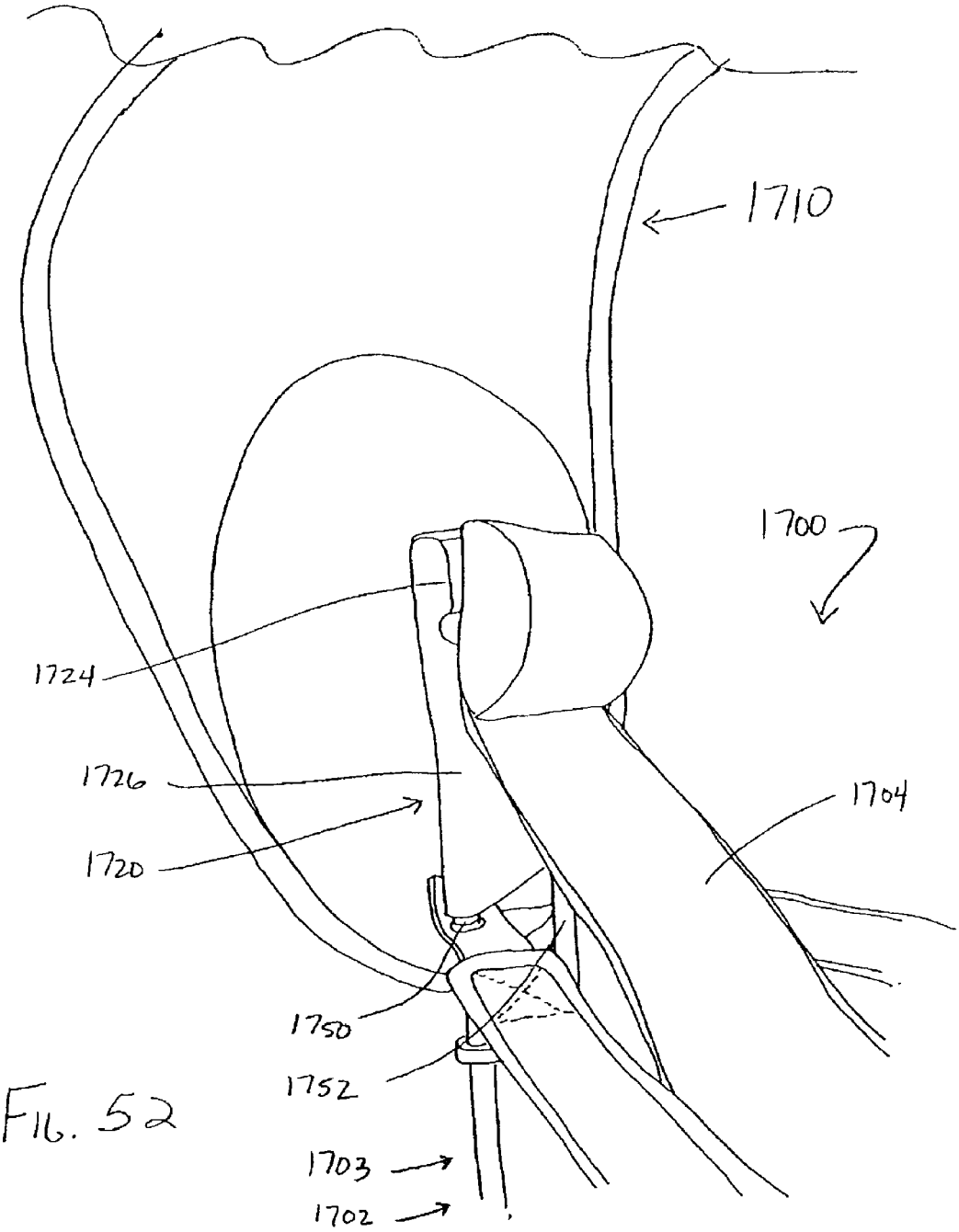
FIG. 52 illustrates a front perspective view of the combination of FIG. 48.

The shade can be placed in an expanded configuration and in a collapsed configuration. Similar to the shade disclosed in U.S. patent application Ser. No. 09/764,059, entitled "Collapsible Sunshade and Methods of Using the Same," filed on Jan. 19, 2001, when the shade 1710 is in its collapsed configuration, the frame portion 1714 forms a plurality of concentric, substantially circular rings. As shown in FIGS. 48, 49, and 50, the shade 1710 can be releasably coupled to the support 1700 when the shade is in its expanded configuration.

The shade 1710 includes a coupling sleeve 1720 (shown in FIG. 51) and a pair of tethering lines 1740 and 1742 to releasably couple the shade to the support 1700. The coupling sleeve 1720 is coupled to the first end 1711 of the shade 1710. Any known method can be used to couple the coupling sleeve 1720 to the shade 1710. In one embodiment, the coupling sleeve 1720 is sewn to the shade 1710.

The coupling pocket 1720 is configured to receive and couple to a portion of the frame 1702. The coupling pocket 1720 has an upper cap 1724 and a pair of retention flaps 1726 and 1728 that define a cavity 1722 into which a portion of the rear frame portion 1703 can be inserted. In the illustrated embodiment, support members 1750 and 1752 are inserted into the cavity 1722. The retention flaps 1726 and 1728 include a coupler 1730 that is configured to releasably couple one of the retention flaps to the other, thereby securing the coupling sleeve 1720 to the rear frame portion 1703. In the illustrated embodiment, the coupler 1730 is a hook and loop type coupler, where hook type material is coupled to one of the retention flaps and loop type material is coupled to the remaining retention flap.

In an alternative embodiment, the retention flaps are coupled together via another releasable coupling device, such as a snap, a button, or a hook. In another alternative embodiment, the retention flaps are coupled together via a more permanent method, such as adhesive, or stitching. In yet another alternative embodiment, the retention flaps are integrally formed by a single piece of material. In yet another embodiment, the upper cap can be a strap configured to define a top portion of the cavity in which the frame is retained. Alternatively, each retention flap can be one or more straps or cords that individually wrap around a respective support member of the frame to maintain the position of the shade relative to the frame.

The tethering lines 1740 and 1742 are configured to couple the shade 1710 to the front frame portion 1705 of the support 1700. First ends 1739 and 1741 of each of the tethering lines 1740 and 1742, respectively, are coupled to the second end 1713 of the shade 1710. Any known method can be used to couple the first ends 1739 and 1741 of the tethering lines 1740 and 1742 to the shade 1710. In one embodiment, the tethering lines 1740 and 1742 are sewn to the shade 1710. In another embodiment, the tethering lines 1740 and 1742 are removably coupled to the shade 1710.

In the illustrated embodiment, second ends 1737 and 1743 of the tethering lines 1740 and 1742, respectively, are releasably coupled to the support 1700. Any known method can be used to couple the tethering lines 1740 and 1742 to the support 1700. In one embodiment, the tethering lines 1740 and 1742 are tied to the support 1700. In another embodiment, the tethering lines 1740 and 1742 include couplers, such as clips or hooks, that releasably fasten the tethering lines to the support 1700. In an alternative embodiment, the tethering lines 1740 and 1742 extend to a support surface on which the support 1700 rests, and the second ends 1743 and 1737 include devices, such as anchors, that releasably couple the tethering lines to the support surface.

As illustrated in FIG. 49, the shade 1710 has a longitudinal line 1780 that extends between ends 1711 and 1713. The shade 1710 also has a lateral line 1782 that extends substantially perpendicularly to the longitudinal line 1780. When the shade 1710 is in an expanded configuration, the shade has a surface that is defined by the longitudinal and lateral lines 1780 and 1782. The shade 1710 can have a shape defined so that the shade 1710 is maintained off the user's head while the user is sitting in the support.

In the illustrated embodiment, the resilient portion 1716 provides support to the shade 1710 and stiffens the shade 1710 so as to increase the resistance of the shade 1710 to bending or sagging out of its expanded configuration surface. In particular, the resilient portion 1716 increases the stiffness of the shade 1710 along the longitudinal line 1780. The resilient portion 1716 can increase the stiffness along all or only a portion of the shade 1710 along the longitudinal line 1780. Similarly, the resilient portion 1716 increases the stiffness of the shade 1710 along the lateral line 1782. The resilient portion 1716 can increase the stiffness along all or only a portion of the shade 1710 along the horizontal line 1782.

In the illustrated embodiment the resilient portion 1716 is made from a different material than the membrane portion of the shade 1710. In one embodiment, the resilient portion 1716 made of a flexible material, such as rubber. In other embodiments, the resilient portion is made of a semi-rigid or rigid material, such as plastic or metal. In other embodiments, the resilient portion can be a metal frame, flexible hoop or multiple separate components (e.g., batten-like rods). While the resilient portion is illustrated as being substantially circular, the resilient portion can have any geometric shape, such as oval, rectangular, or square.

In an alternative embodiment, the resilient portion may be a separate member that can be releasably or fixedly coupled to the shade. In another alternative embodiment, the frame portion is configured to provide sufficient stiffness to the shade along the longitudinal and horizontal lines such that a resilient portion is not necessary.

Support member 1790 also supports to the shade 1710 and stiffens the shade 1710 so as to increase the resistance of the shade 1710 to bending or sagging out of its expanded con figuration surface. In particular, the support member 1790 increases the stiffness of the shade 1710 along the lateral line 1782. The resilient portion 1716 can increase the stiffness along all or only a portion of the shade 1710 along the horizontal line 1782. Support member 1790 can be, for example, a rod made of appropriate material such as plastic or metal. FIG. 50 shows an example where the support member 1790 is a collapsible rod having an elastic member inside the hollow tubing. Note that support member 1790 can be used with or without resilient member 1716. Similarly, the resilient member 1716 can be used alone without support member 1790.

Another embodiment of the invention is illustrated in FIGS. 53–56. In this embodiment, a support 2000 has a frame 2002 that can be placed in an expanded configuration and in a collapsed configuration. The frame 2002, while in an expanded configuration, can be placed in an upright position and in a reclined position. The frame 2002 has a rear frame portion 2004 that includes a pair of support members 2010 and 2012 and a coupler 2030. The frame 2002 also has two side support members 2020 and 2022 that are pivotally coupled to the coupler 2030 as described below.

In the illustrated embodiment, the support members 2010 and 2012 are hollow metal tubes with a circular cross-section, but as described above for support members 1512 and 1514, the support members 2010 and 2012 can be made of different materials and have different cross-sectional shapes.

In the illustrated embodiment, support members 2010 and 2012 are connected together by a link 2014. Link 2014 includes a lower portion 2016 that engages the coupler 2030 as described below. In one embodiment, the link 2014 and the support members 2010 and 2012 can be integrally formed. In one embodiment, the link can be a linear member.

Figure 53A:
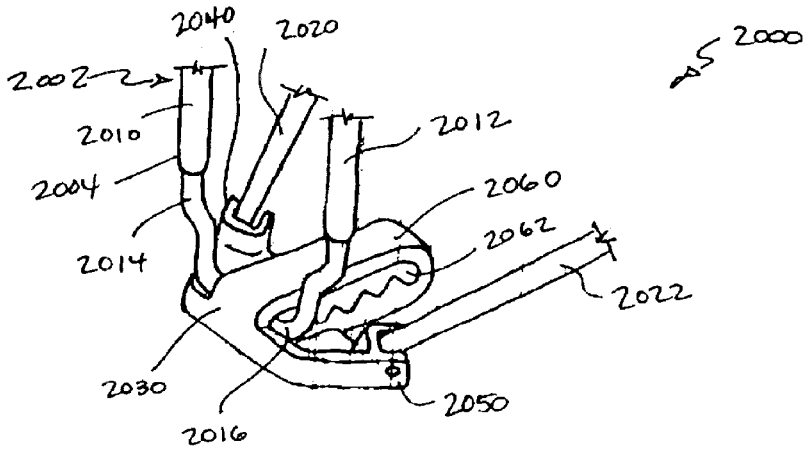
FIG. 53A illustrates a perspective view of a rear portion of a support in an upright position, according to an embodiment of the invention.
Figure 54A:
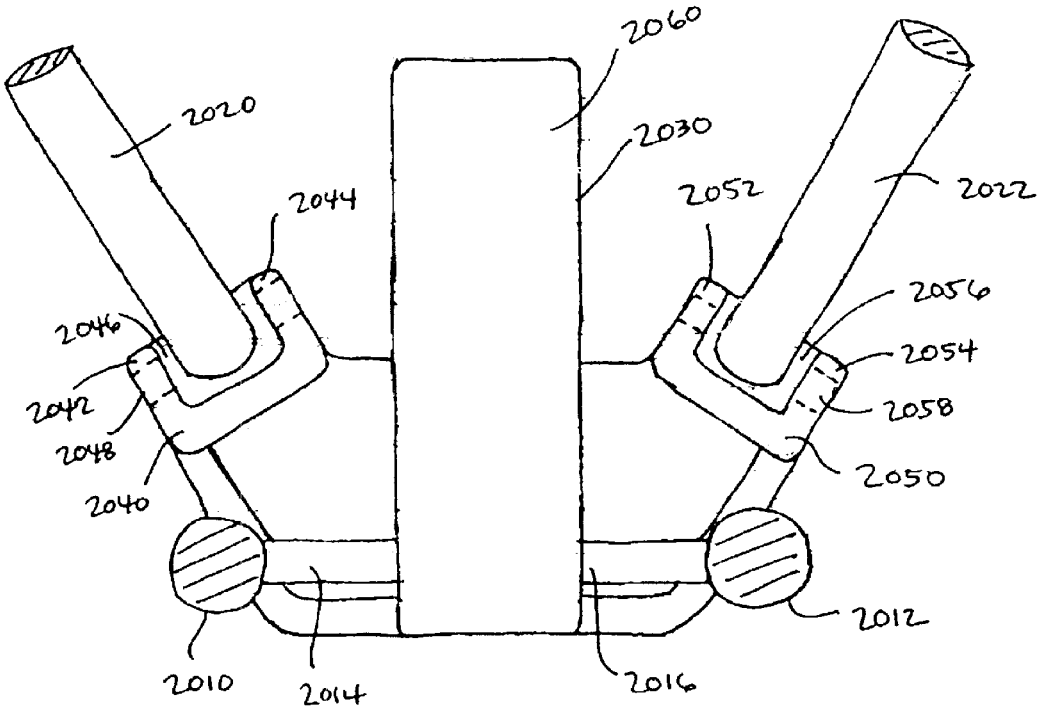
FIG. 54A illustrates a top view of a rear portion of the support of FIG. 53A.

As illustrated in FIGS. 53A and 54A, the coupler 2030 includes mounting portions 2040 and 2050 and an adjustment portion 2060. In the illustrated embodiment, the mounting portions 2040 and 2050 are mounted on opposite sides of and at an angle with respect to the adjustment portion 2060.

Mounting portion 2040 includes a pair of walls 2042 and 2044 that define a cavity 2046 therebetween. Each of the walls 2042 and 2044 includes an opening 2048 through which a connector, such as a rivet (not shown), can be inserted to couple the lower end of the support member 2020 to the mounting portion 2040.

Similarly, mounting portion 2050 includes a pair of walls 2052 and 2054 that define a cavity 2056 therebetween. Each of the walls 2052 and 2054 includes an opening 2058 through which a connector, such as a rivet (not shown), can be inserted to couple the lower end of the support member 2022 to the mounting portion 2050.

Figure 53B:
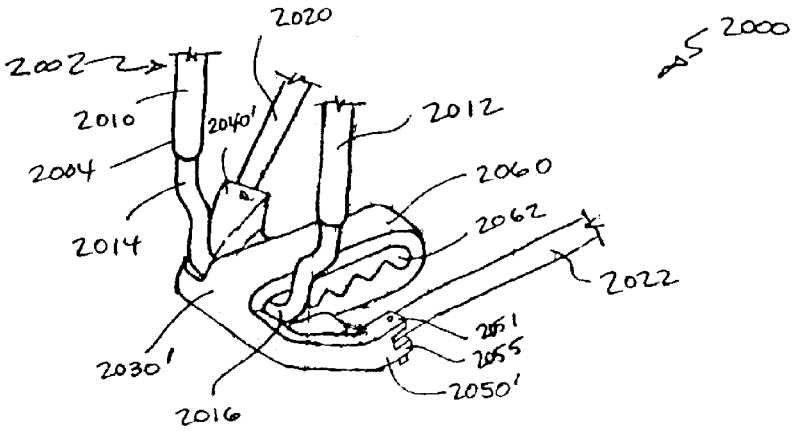
FIG. 53B illustrates a perspective view of a rear portion of a support in an upright position, according to an alternative embodiment of the invention.
Figure 54B:
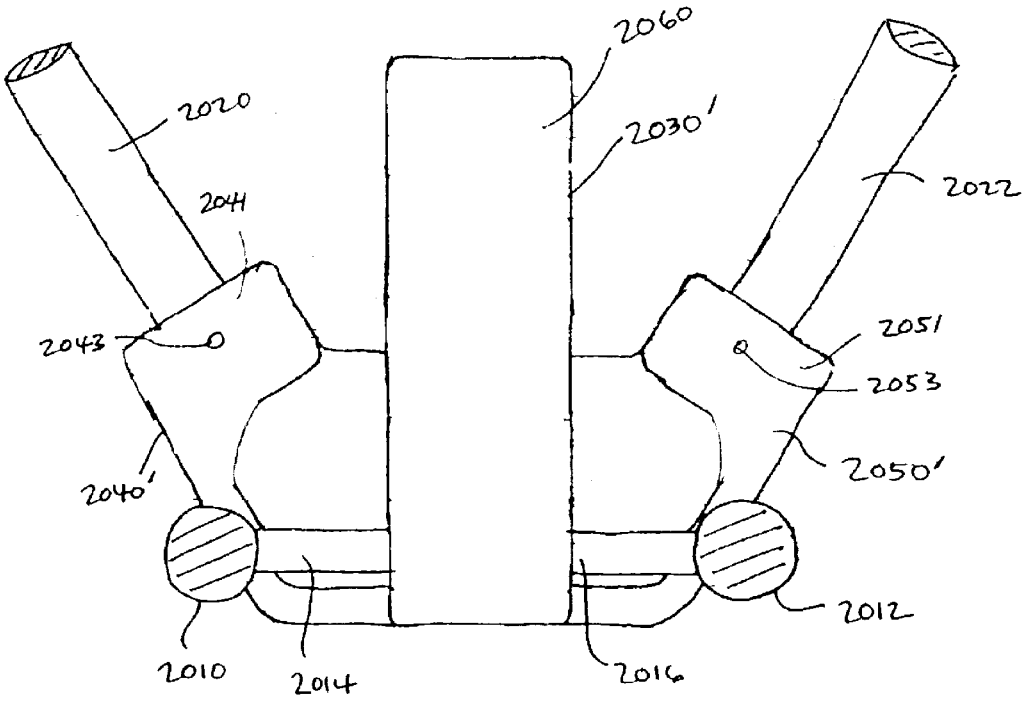
FIG. 54B illustrates a top view of a rear portion of the support of FIG. 53B.

An alternative embodiment of a coupler is illustrated in FIGS. 53B and 54B. The coupler 2030' includes the same components as coupler 2030 with the exception of the mounting portions. As illustrated, mounting portions 2040' and 2050' have a different orientation as compared to mounting portions 2040 and 2050. In this embodiment, mounting portion 2040' includes an upper wall 2041 and a lower wall (not shown) through which a fastener 2043, such as a screw or rivet, can be inserted to couple the support member 2020 to the coupler 2030'. Similarly, mounting portion 2050' includes an upper wall 2051 and a lower wall 2055 through which a fastener 2053, such as a screw or rivet, can be inserted to couple the support member 2022 to the coupler 2030'. In alternative embodiments, the mounting portions of the coupler may be oriented at angle with respect to the support surface on which the coupler is placed.

Figure 55:
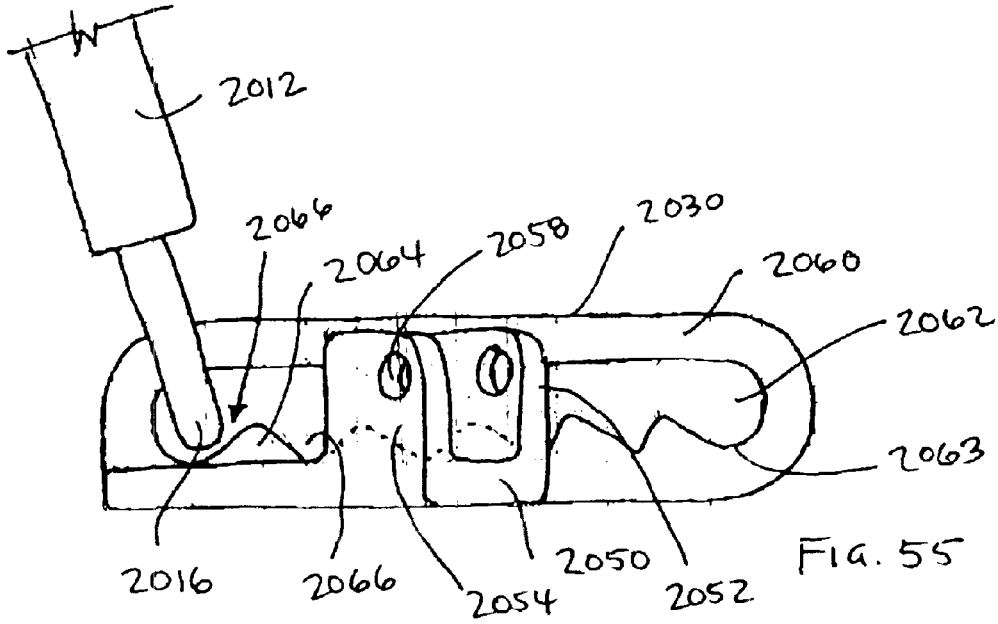
FIG. 55 illustrates a side view of a rear portion of the support of FIG. 53 in an upright position.
Figure 56:
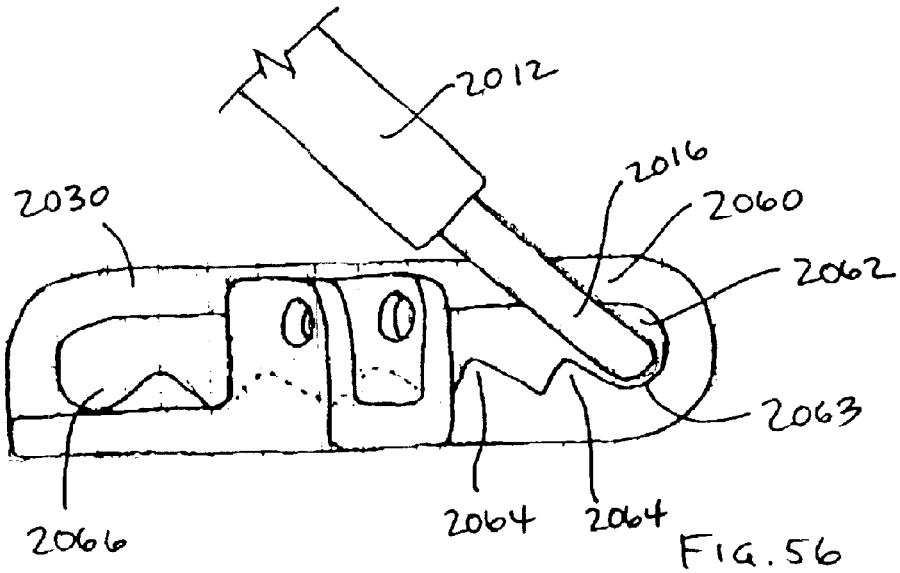
FIG. 56 illustrates a side view of a rear portion of the support of FIG. 53 in a reclined position.

As illustrated in FIGS. 55 and 56, the adjustment portion 2060 includes a central opening or slot 2062 through which the lower portion 2016 of the link 2014 passes. The opening 2062 is configured to allow the lower portion 2016 to move along the length of the adjustment portion 2060 of the coupler 2030. Side support members 2020 and 2022 are not illustrated in FIGS. 55 and 56 for reasons of simplicity only.

In the illustrated embodiment, the adjustment portion 2060 includes a lower inner surface 2063 that has several ridges or teeth 2064 that defines notches 2066 therebetween. The ridges 2064 are configured to retain the lower portion 2016 in one of the notches 2066. Each notch 2066 corresponds to a different angle of inclination of the support members 2010 and 2012 and the frame 2002. Each notch 2066 defines a retaining position in which the lower portion 2016 of the link 2014 can be retained. While the illustrated embodiment of the adjustment portion 2060 includes five ridges 2064 that define six notches 2066, any number of ridges 2064 and notches 2066 can be provided on the adjustment portion 2060. Similarly, the adjustment portion 2060 can be any length.

As best illustrated in FIGS. 55 and 56, the rear frame portion 2004 can be pivoted with respect to the coupler 2030 to convert the frame 2002 from an upright position to a reclined position. Support member 2010 functions in a similar manner as support member 2012, and thus only the movements of support member 2012 are illustrated and discussed in detail. To recline the frame 2002, the support member 2012 is lifted from its initial upright position (see FIG. 55) on the coupler 2030. The lower portion 2016 of the support member 2012 can be moved along the slot 2062 of the coupler 2030 to the desired position. The support member 2012 and link 2014 can be lowered so that lower portion 2016 of link 2014 engages a notch 2066 on the coupler 2030. The steps of this process can be reversed to convert the frame 2002 from a reclined position to an upright position.

Another embodiment of the invention is illustrated in FIGS. 57A–60. In this embodiment, a support 2100 has a frame 2101, a coupler 2150, tension members 2110 and 2112, elongate members 2130 and 2140, slide plate 2105 and slide-plate member 2106. Similar to the above-described embodiments, the frame 2101 can be placed in an expanded configuration and in a collapsed configuration. Also similar to the above-described embodiments, each of the tension members 2110 and 2112 can be placed in two positions. The tension members 2110 and 2112 can be placed in a first position when the frame 2101 is in its expanded configuration to provide supports for the arms of a user. In addition, the tension members 2110 and 2112 can be placed in a second position when the frame 2101 is in its collapsed configuration to serve as shoulder straps when support 2100 is being transported on the user's back.

Elongate members 2130 and 2140 are structurally similar to each other and to elongate members 1630 and 1632 described above. Note that although the elongate members 2130 and 2140 are shown as straps, elongate members can be cables, cords or any appropriate type of material that can be coupled to coupler 2150 and can be used to form a shoulder strap or just be used for adjustment.

Elongate member 2130 has a first end 2132 and a second end 2134. The first end 2132 of the elongate member 2130 can be formed into a loop that can be grasped by the user. The second end 2134 of the elongate member 2130 is coupled to the coupler 2150. Similarly, elongate member 2140 has a first end 2142 and a second end 2144. The first end 2142 of the elongate member 2140 can be formed into a loop that can be grasped by the user. The second end 2144 of the elongate member 2140 is coupled to the coupler 2150.

In the illustrated embodiment, the second end 2134 of elongate member 2130 includes the male portion 2136 of a buckle. The male portion 2136 can be coupled to a corresponding female portion of the buckle (not shown) on tension member 2112 when tension member 2112 is disconnected from the front frame portion. Similarly, the second end 2144 of elongate member 2140 includes the male portion 2146 of a buckle. The male portion 2146 can be coupled to a corresponding female portion of the buckle (not shown) on tension member 2110 when tension member 2110 is disconnected from the front frame portion.

As illustrated in FIGS. 57A, and 58–60, the coupler 2150 includes a front surface 2151, a rear surface 2152, an upper end 2153, and a lower end 2154. The lower end 2154 engages the support surface on which support 2100 is placed. The coupler 2150 includes mounting portions 2160 and 2162 proximate to upper end 2153 to which support members 2102 and 2104 are coupled, respectively. In one embodiment, connectors, such as bolts or rivets, can be used to couple the lower ends of support members 2102 and 2104 to the mounting portions 2160 and 2162 of the coupler 2150. In alternative embodiments, any device that can movably couple the support members 2102 and 2104 to coupler 2150 can be used.

Figure 57A:
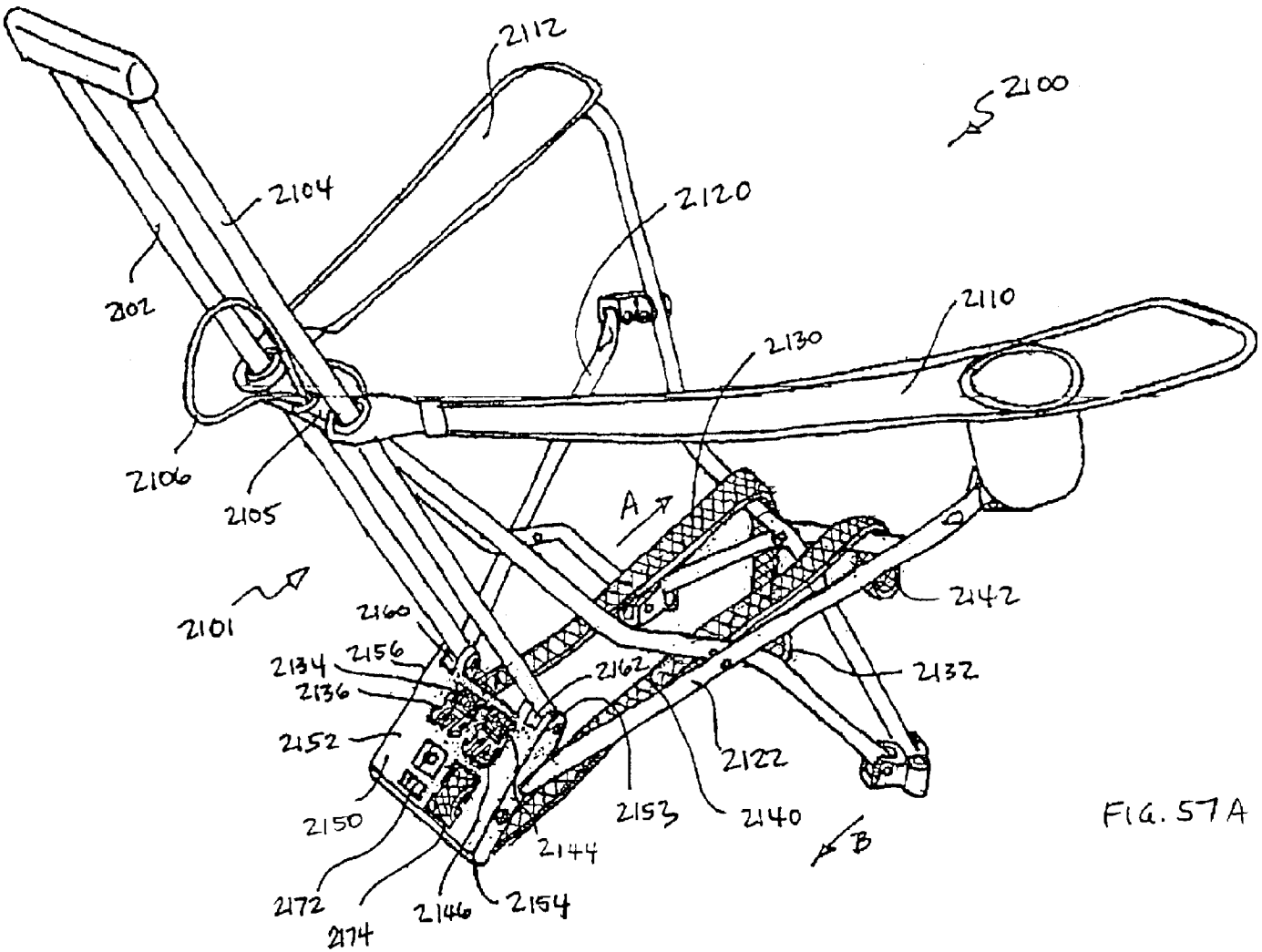
FIG. 57A illustrates a rear perspective view of a support in a reclined position according to an alternative embodiment of the invention.
Figure 59:
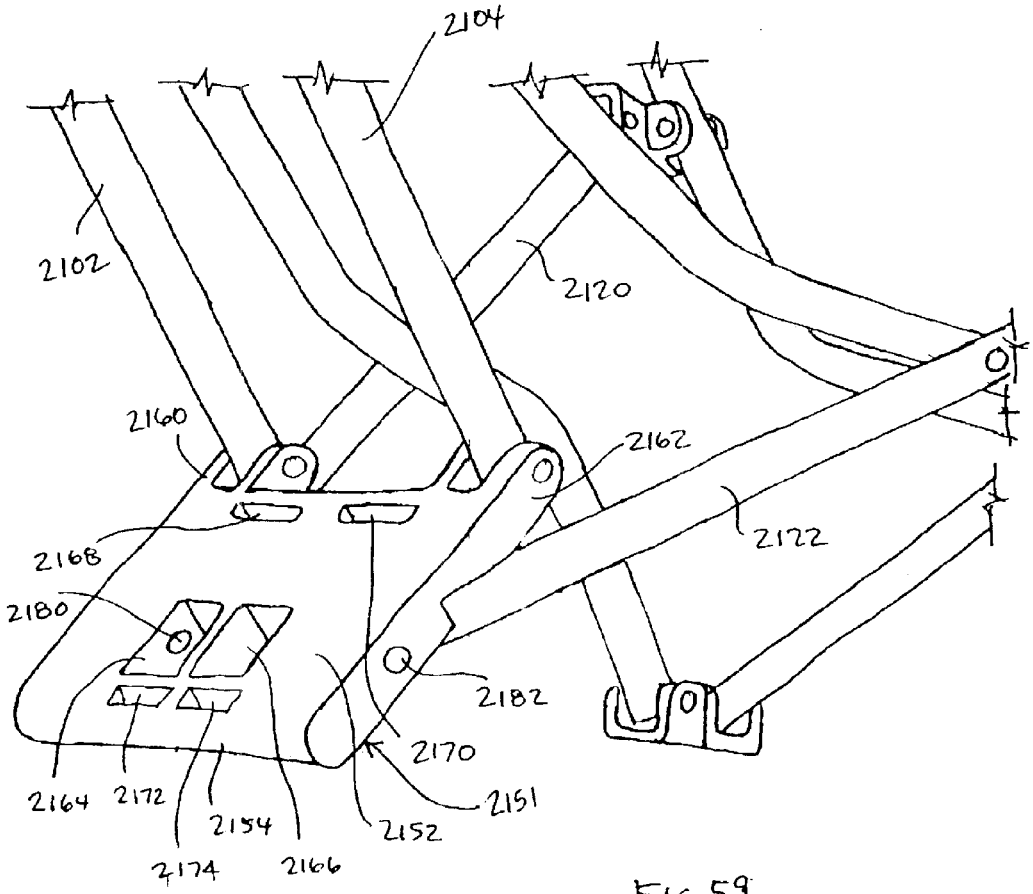
FIG. 59 illustrates a perspective view of a rear portion of the support of FIG. 57A in a reclined position.
Figure 60:
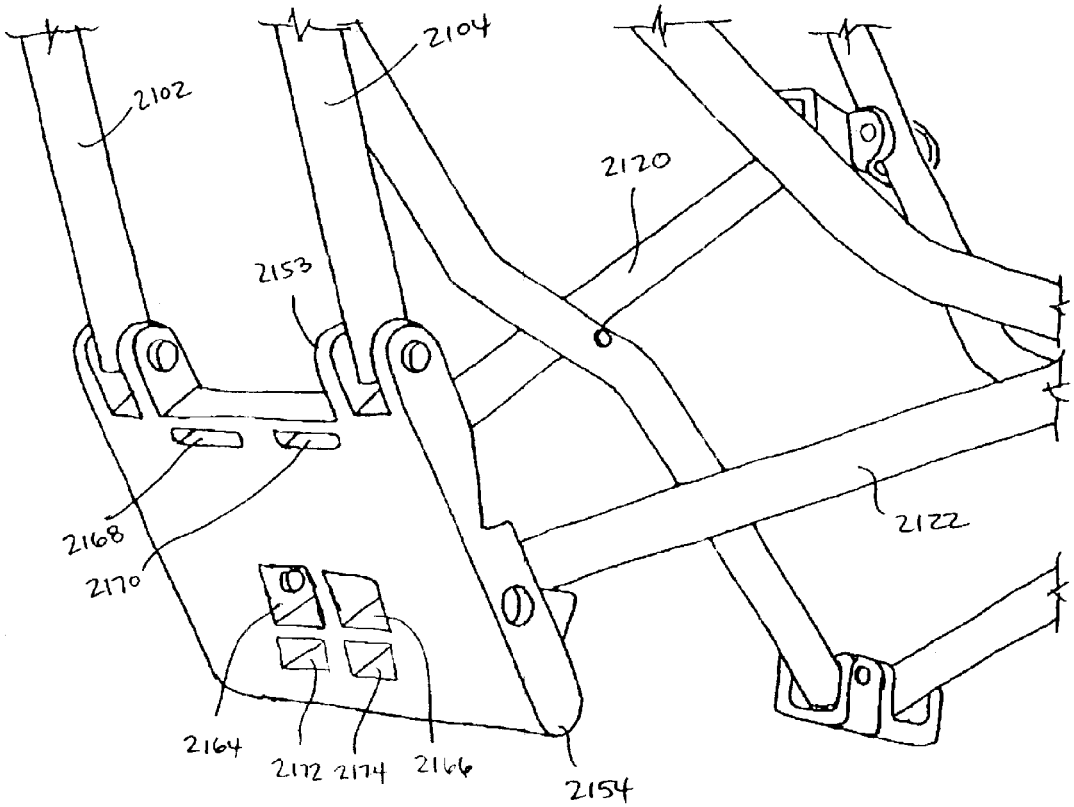
FIG. 60 illustrates a perspective view of a rear portion of the support of FIG. 57A in an upright position.

As best illustrated in FIGS. 59 and 60, coupler 2150 includes openings 2164 and 2166, a pair of slots 2168 and 2170 and a pair of slots 2172 and 2174. Openings 2164 and 2166 and slots 2168, 2170, 2172 and 2174 are configured to receive elongate members 2130 and 2140, respectively. As illustrated in FIG. 57A, elongate member 2140 passes through slot 2174, through opening 2166, and through slot 2170. Elongate member passes through slot 2168. By connecting elongate members 2130 and 2140 to different parts of the coupler 2150, movement of either of the elongate members 2130 and 2140 can cause movement of the coupler 2150. While the illustrated embodiment includes a sliding connection between the elongate members 2130 and 2140 and the coupler 2150, any type of connection between the elongate members 2130 and 2140 and the coupler 2150 can be used.

Figure 57B:
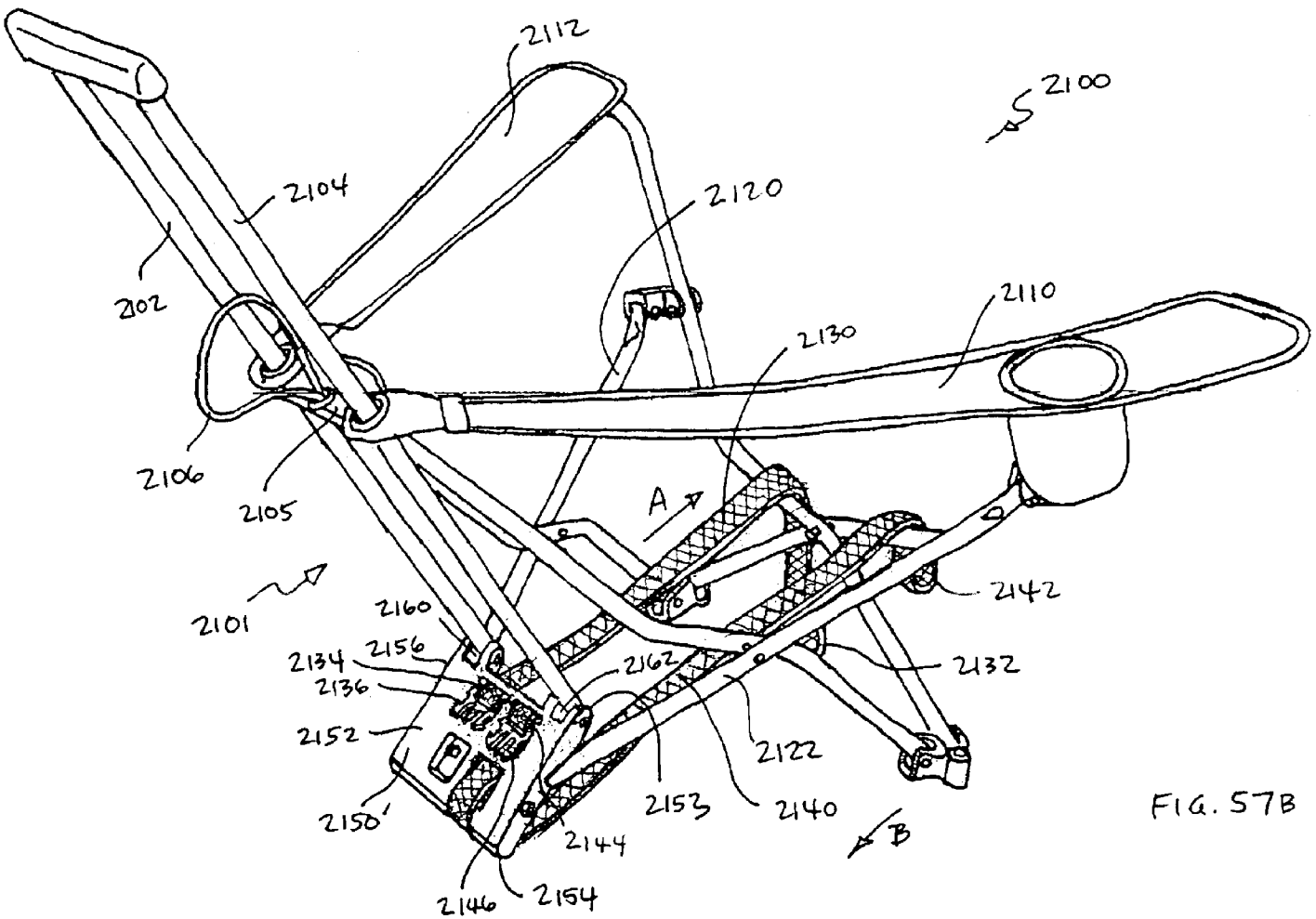
FIG. 57B illustrates a rear perspective view of a support in a reclined position according to an alternative embodiment of the invention.

An alternative embodiment of a coupler is illustrated in FIG. 57B. In this embodiment, the coupler 2150' only includes a pair of slots and a pair of openings. As illustrated, elongate member 2140 passes around the lower end 2154 of the coupler 2150', through opening 2166 and through slot 2170. Elongate member 2130 passes through slot 2168. By connecting elongate members 2130 and 2140 to different parts of the coupler 2150', movement of either of the elongate members 2130 and 2140 can cause movement of the coupler 2150'. While the illustrated embodiment includes a sliding connection between the elongate members 2130 and 2140 and the coupler 2150', any type of connection between the elongate members 2130 and 2140 and the coupler 2150' can be used.

In alternative embodiments, elongate members 2130 and 2140 can be coupled to the coupler 2150' in a variety of ways. For example, elongate member 2130 could pass through the slot 2172 near the lower end 2154 of the coupler 2150, through opening 2150, through opening 2164 and through slot 2168. Elongate member 2140 can then pass through slot 2170 only.

Returning to the illustrated embodiment, side or forwardly extending support members 2120 and 2122 are pivotally coupled to the coupler 2150. As illustrated in FIG. 59, side support member 2120 is coupled to the coupler 2150 by connector 2180. Similarly, side support member 2122 is coupled to the coupler 2150 by connector 2182. It can be appreciated that any connectors or fasteners of the supports described herein can be any type of connector, such as a rivet, screw, bolt, etc.

In alternative embodiments, the support members 2102 and 2104 and the side support members 2120 and 2122 can be coupled to various locations on the coupler 2150. For example, the support members 2102 and 2104 can be coupled proximate to the middle of the coupler 2150 and the side support members 2120 and 2122 can be coupled proximate to the upper end of the coupler 2150. Alternatively, the support members 2102 and 2104 can be coupled along the lower end 2154 of the coupler 2150 and the side support members 2120 and 2122 can be coupled to the upper end 2153 or the along the middle of the coupler 2150. In one embodiment, the support members 2102 and 2104 can be coupled to the coupler 2150 on its rear surface.

In one embodiment, elongate members 2130 and 2140 can be coupled together or formed integrally in a continuous loop that is coupled to the coupler 2150. The continuous elongate member loop can be coupled to the coupler 2150 in any manner that facilitates movement of the coupler 2150 in response to movement of any the loop. For example, when the user pulls on a first portion of the loop, the coupler 2150 is moved in a first direction. When the user pulls on a second portion of the loop, the coupler 2150 is moved in a second direction.

As illustrated in FIG. 57A, the support 2100 can be adjusted to a recline position by pulling forward on the elongate member 2130. When the user pulls elongate member 2130 along the direction of arrow "A," the upper end 2153 of the coupler 2150 moves forwardly and the lower end 2154 of the coupler 2150 moves rearwardly about pivots 2180 and 2182 of the coupler 2150. As the coupler 2150 rotates to its reclined position in FIG. 57A, the support members 2102 and 2104 pivot relative to the coupler 2150 to their reclined positions. As the coupler 2150 is moved, elongate member 2140 moves along the direction of arrow "B." In other words, because elongate member 2140 is threaded through slot 2174, through opening 2166 and through slot 2170, elongate member 2140 moves coupler 2150 in the direction of arrow "B" when elongate member 2140 is pulled in the direction of arrow "A."

Figure 58:
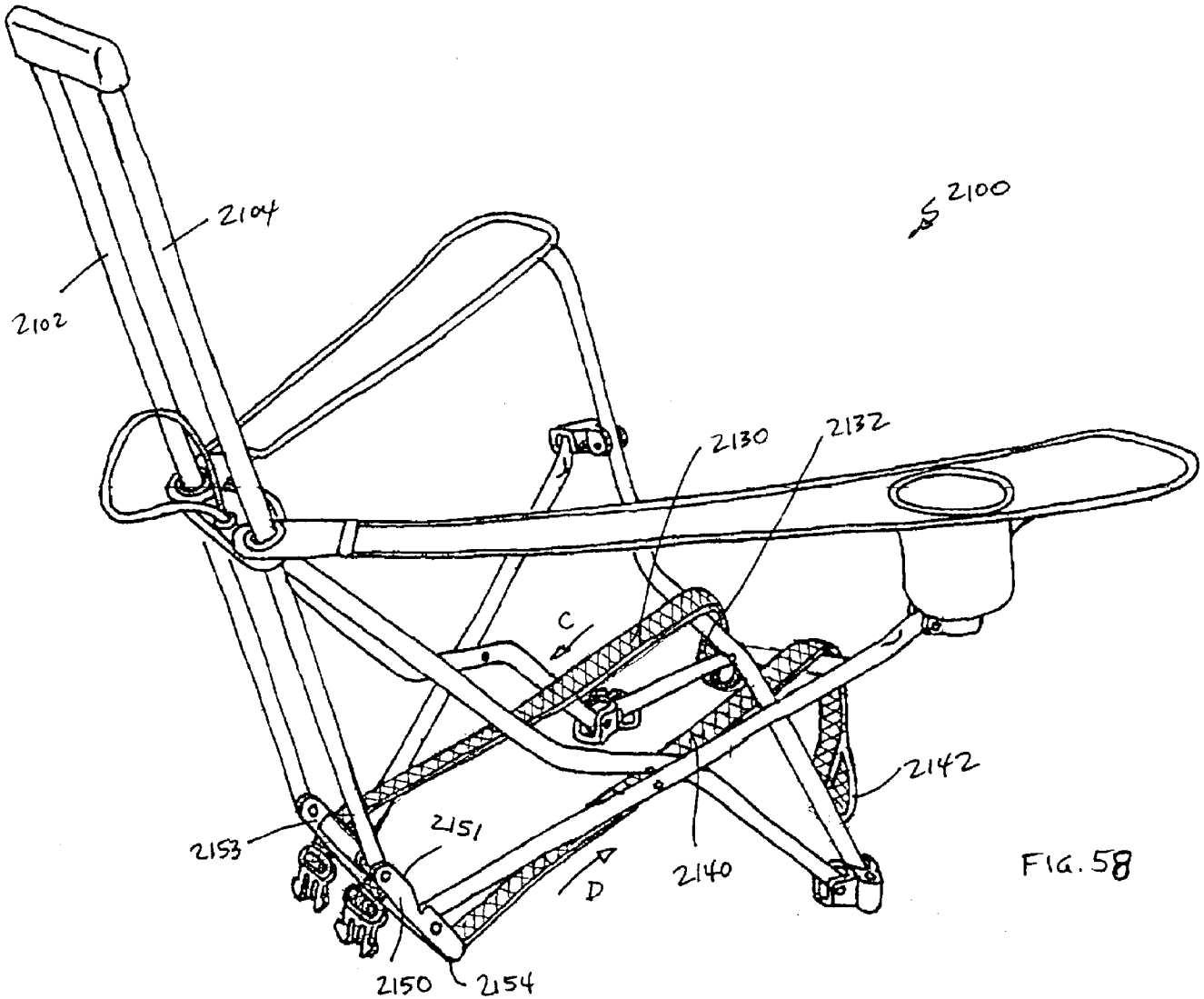
FIG. 58 illustrates a rear perspective view of the support of FIG. 57A in an upright position.

As illustrated in FIG. 58, the support 2100 can be adjusted to an upright position by pulling forwardly on the elongate member 2140. When the user pulls the elongate member 2140 along the direction of arrow "D," the lower end 2154 of the coupler 2150 moves forwardly and the upper end 2153 of the coupler 2150 moves rearwardly about pivots 2180 and 2182. As the coupler 2150 rotates to its upright position in FIG. 58, the support members 2102 and 2104 pivot relative to the coupler 2150 to their upright positions. As the coupler 2150 is moved, elongate member 2130 also moves along the direction of arrow "C." While the user can pull his weight upwardly to make the movement of the coupler 2150 easier, it is not necessary for the user to shift any weight to move the coupler 2150.

The coupler 2150 functions as a single joint to which the support members 2102 and 2104 and the side support members 2120 and 2122 are mounted. Movement of the coupler 2150 causes relative movement of the support members 2102 and 2104 and side support members 2120 and 2122 simultaneously.

In the illustrated embodiment, end 2132 of elongate member 2130 and end 2142 of elongate member 2140 are resting on part of the front frame portion. In alternative embodiments, ends 2132 and 2142 can be located anywhere along the frame 2101 as long as a user can grasp the ends 2132 and 2142 to adjust the frame 2101 and the support 2100.

In an alternative embodiment, the support can include four elongate members. For example, two elongate members can be coupled to the coupler and can be used and pull straps to change the angle of inclination of the support. Two elongate members can be coupled proximate to the upper portion and to the lower portion of the rear frame portion and can be used as carrying straps.

Figure 61:
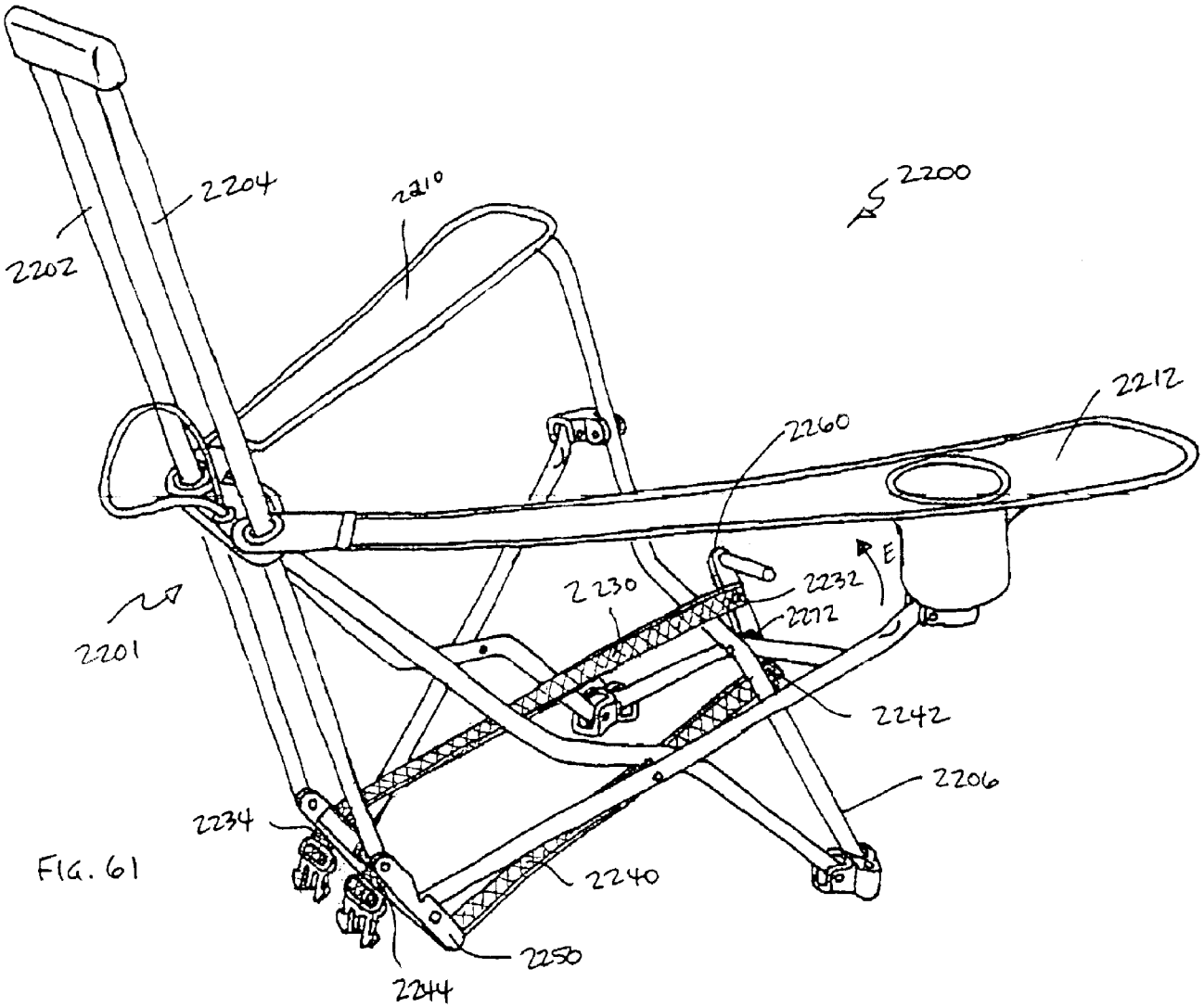
FIG. 61 illustrates a rear perspective view of a support in an upright position according to an alternative embodiment of the invention.
Figure 62:
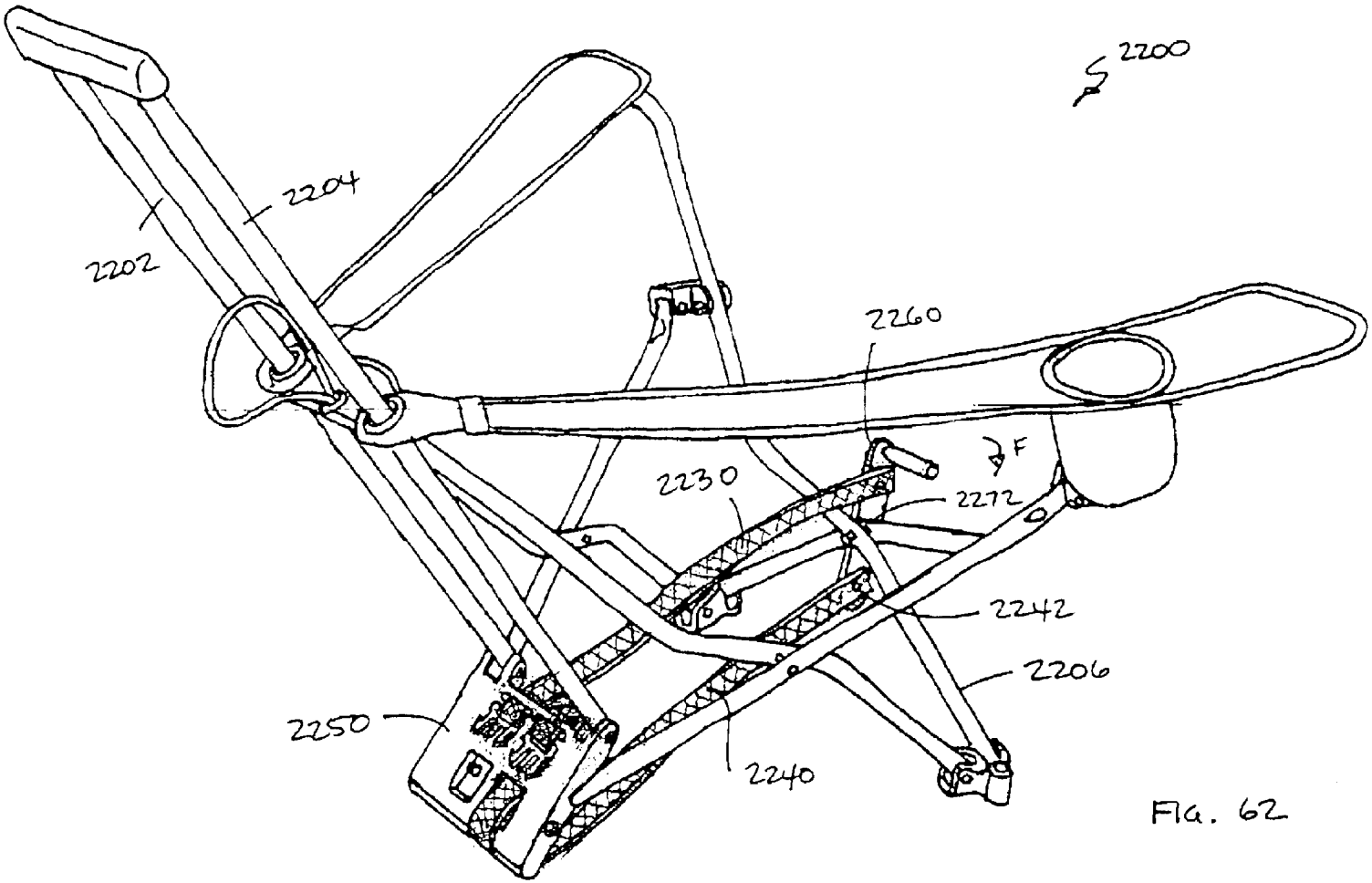
FIG. 62 illustrates a rear perspective view of the support of FIG. 61 in a reclined position.
Figure 63:
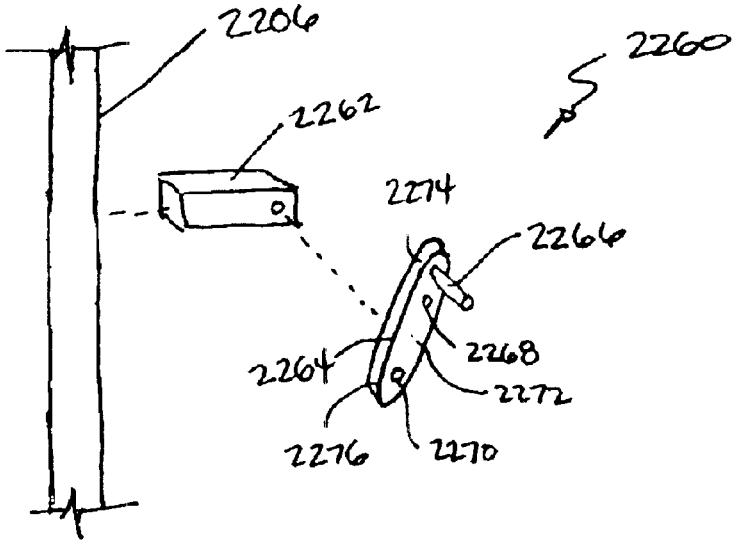
FIG. 63 illustrates a perspective view of an adjustment mechanism of the support of FIG. 61.

Another embodiment of the invention is illustrated in FIGS. 61–63. In this embodiment, a support 2200 has a frame 2201, a coupler 2250, tension members 2210 and 2212, and elongate members 2230 and 2240. Most of the components of support 2200 are similar to the corresponding components of support 2100. Similar to the above-described embodiments, the frame 2201 can be placed in an expanded configuration and in a collapsed configuration. Also similar to the above-described embodiments, each of the tension members 2210 and 2212 can be placed in two positions. The tension members 2210 and 2212 can be placed in a first position. When the frame 2201 is in its expanded configuration to provide supports for the arms of a user. In addition, the tension members 2210 and 2212 can be placed in a second position when the frame 2201 is in its collapsed configuration to serve as shoulder straps when support 2200 is being transported on the user's back.

In the illustrated embodiment, support 2200 includes an adjustment mechanism 2260. Adjustment mechanism 2260 can be used to adjust the angle of inclination of the frame 2201. As illustrated in FIG. 61, elongate member 2230 has a first end 2232 and a second end 2234. Similarly. elongate member 2240 has a first end 2242 and a second end 2244.

The first end 2232 of the elongate member 2230 is coupled to the adjustment mechanism 2260 and the second end 2234 is coupled to the coupler 2250. The first end 2242 of the elongate member 2240 is coupled to the adjustment mechanism 2260 and the second end 2244 is coupled to the coupler 2250. First ends 2232 and 2242 of elongate members 2230 and 2240 are coupled to the adjustment mechanism via connectors, such as rivets or bolts. In alternative embodiments, any type of fasteners or method of coupling different parts, such as gluing, welding, etc., can be used to couple the elongate members to the adjustment mechanism.

Adjustment mechanism 2260 is mounted for movement relative to the frame 2201. In one embodiment, adjustment mechanism 2260 is pivotally mounted to the frame 2201. While the adjustment mechanism 2260 is illustrated as coupled to the front of the frame 2201, the adjustment mechanism 2260 can be mounted at any location on the frame 2201 as long as the user of the support 2200 can manipulate the adjustment mechanism 2260. For example, the adjustment mechanism 2260 can be mounted to a rear portion of the frame 2201.

An embodiment of an adjustment mechanism is illustrated in FIG. 63. In this embodiment, the adjustment mechanism 2260 includes a mount 2262 that is coupled to the frame 2201. In one embodiment, the mount 2262 is a separate piece that can be coupled to any part of the frame 2201. For example, the mount 2262 can be coupled to the front frame portion 2206 of the frame 2201. Mount 2262 can be coupled to the front frame portion 2206 using any conventional fastener or coupling techniques. In alternative embodiments, the mount can be integrally formed on the frame or the adjustment mechanism can be directly coupled to the frame.

The adjustment mechanism 2260 includes a link 2264 that is pivotally coupled to the mount 2262 for rotation about the pivot point 2272. Link 2264 can include a handle 2266 that can be grasped by the user. In the illustrated embodiment, link 2264 includes openings 2268 and 2270 that arc configured to receive fasteners (not shown) that couple the elongate members 2230 and 2240 to the link 2264.

In the illustrated embodiment, when the adjustment mechanism 2260 is pivoted about pivot point 2272 along the direction of arrow "E," the lower end 2276 of the link 2264 moves forwardly and the upper end 2274 moves rearwardly (see FIG. 61). As the lower end 2276 moves forwardly, elongate member 2240 is pulled in the same direction and the coupler 2250 can be moved to its upright position, thereby changing the inclination of the frame 2201. While the user can pull his weight upwardly to make the movement of the coupler 2250 easier, it is not necessary for the user to shift any weight to move the coupler 2250.

When the adjustment mechanism 2260 is pivoted about pivot point 2272 along the direction of arrow "F," the upper end 2274 of the link 2264 moves forwardly and the lower end 2276 moves rearwardly (see FIG. 62). As the upper end 2274 moves forwardly, elongate member 2230 is pulled in the same direction. If the user lifts his weight up from the support 2200, the coupler 2250 can be moved to its reclined position, thereby changing the inclination of the frame 2201.

As discussed above, the movements of elongate members 2230 and 2240 relative to each other cause movement of the coupler 2250. Thus, while the adjustment mechanism 2260 is illustrated as having an elongate link, any type of structure that facilitates the movement of elongate members 2230 and 2240 relative to each other can be used. For example, any structure that can be manipulated to selectively move one elongate member with respect to the other elongate member can be used.

In an alternative embodiment, the adjustment mechanism can include one or more members. For example, the adjustment mechanism can include two independently mounted pieces. Each elongate member can be coupled to a separate piece of the adjustment mechanism and can be moved independent of the other elongate member.

In one embodiment, the coupler 2250 of support 2200 can include additional slots corresponding to slots 2172 and 2174 of coupler 2150 described above. In other embodiments, couplers 2150 and 2250 can include any number of slots and/or openings.

Figure 64:
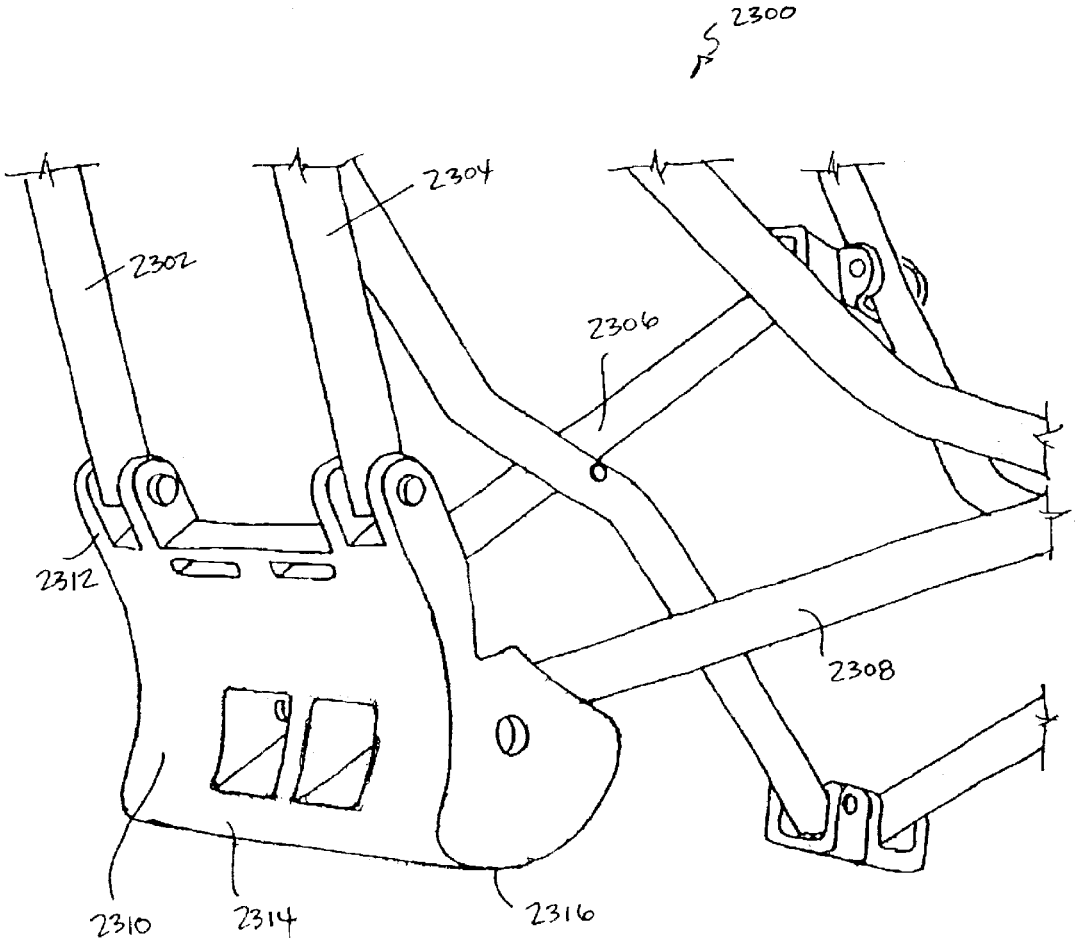
FIG. 64 illustrates a perspective view of a rear portion of a support in an upright position according to an alternative embodiment of the invention.
Figure 65:
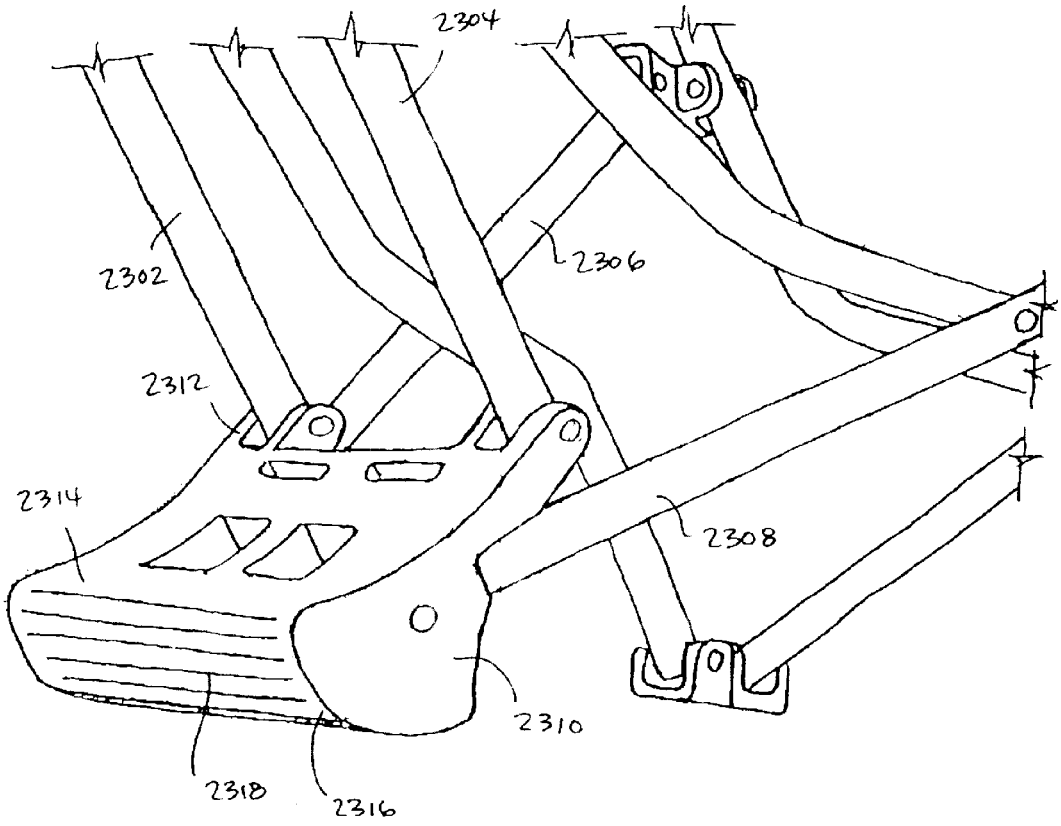
FIG. 65 illustrates a perspective view of a rear portion of the support of FIG. 64 in a reclined position.

An alternative embodiment of a support is illustrated in FIGS. 64 and 65. In this embodiment, the support 2300 includes support members 2302 and 2304, side support members 2306 and 2308, and a coupler 2310. Coupler 2310 is pivotally coupled to support members 2302 and 2304 and side support members 2306 and 2308. Coupler 2310 can be positioned in an upright position as illustrated in FIG. 64 and in a reclined position as illustrated in FIG. 65.

In this embodiment, the coupler 2310 can be used with or without elongate members. For example, the coupler 2310 can be used with one or more elongate members in a similar manner as described above with respect to coupler 2250. Also, coupler 2310 can be moved without any elongate members, as described in detail below. While this embodiment is illustrated without elongate members coupled to the coupler 2310, it can be appreciated that coupler 2310 can be used with any type of elongate members as described above.

In this embodiment, coupler 2310 includes an upper end 2312 to which support members 2302 and 2304 are coupled. Coupler 2310 has a lower end 2314 with a rounded bottom surface 2316 that engages the support surface on which support 2300 is placed. As illustrated, the lower end 2314 is larger than the upper end 2312. In the illustrated embodiment, the radius of curvature of the lower end 2314 is greater than the radius of curvature of the upper end 2312. The rounded bottom surface 2316 facilitates the movement of the coupler 2310 between the upright and reclined positions. It is not necessary that the lower end 2314 be rounded and larger than the upper end 2312 for the coupler 2350 to operate.

The bottom surface 2316 includes several ridges 2318 that facilitate the movement of the lower end 2314 and bottom surface 2316 along the support surface. For example, if the support 2300 is deployed on a sandy support surface, the ridges 2318 provide increased friction with the support surface, thereby facilitating the movement of the coupler 2310 between its upright and reclined positions.

In order to move the coupler 2310 between these positions, elongate members can be pulled to move the coupler 2310 in a particular direction. In an alternative embodiment, the coupler can be moved when the occupant shifts his weight on the support. For example, when the occupant shifts his weight from the back to the front of the support 2300, the coupler 2310 is moved from its upright position (see FIG. 64) to its reclined position (see FIG. 65). The process can be reversed to move the coupler 2310 from its reclined position to its upright position.

In an alternative embodiment, the coupler can be formed without any openings or slots. In such an embodiment, the coupler is moved in response to the shifting of the occupant's weight.

Figure 66:
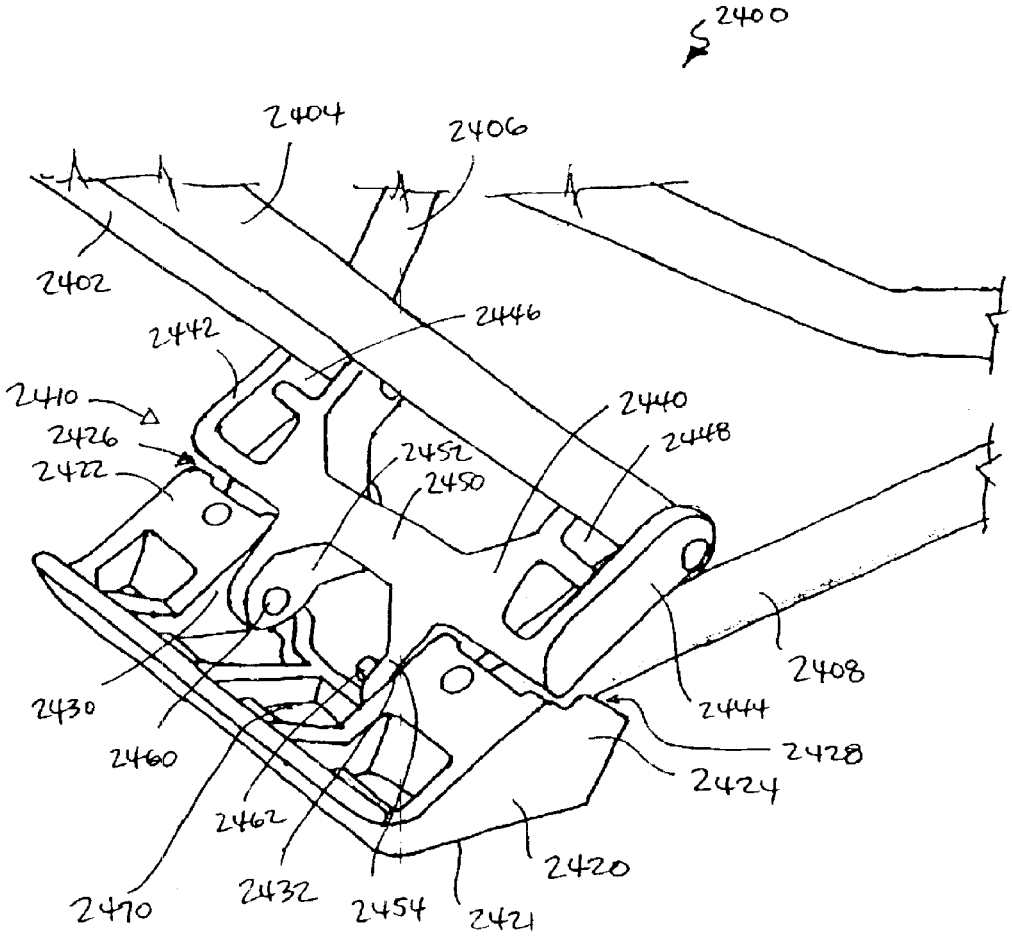
FIG. 66 illustrates a perspective view of a rear portion of a support in a reclined position according to an alternative embodiment of the invention.
Figure 67:
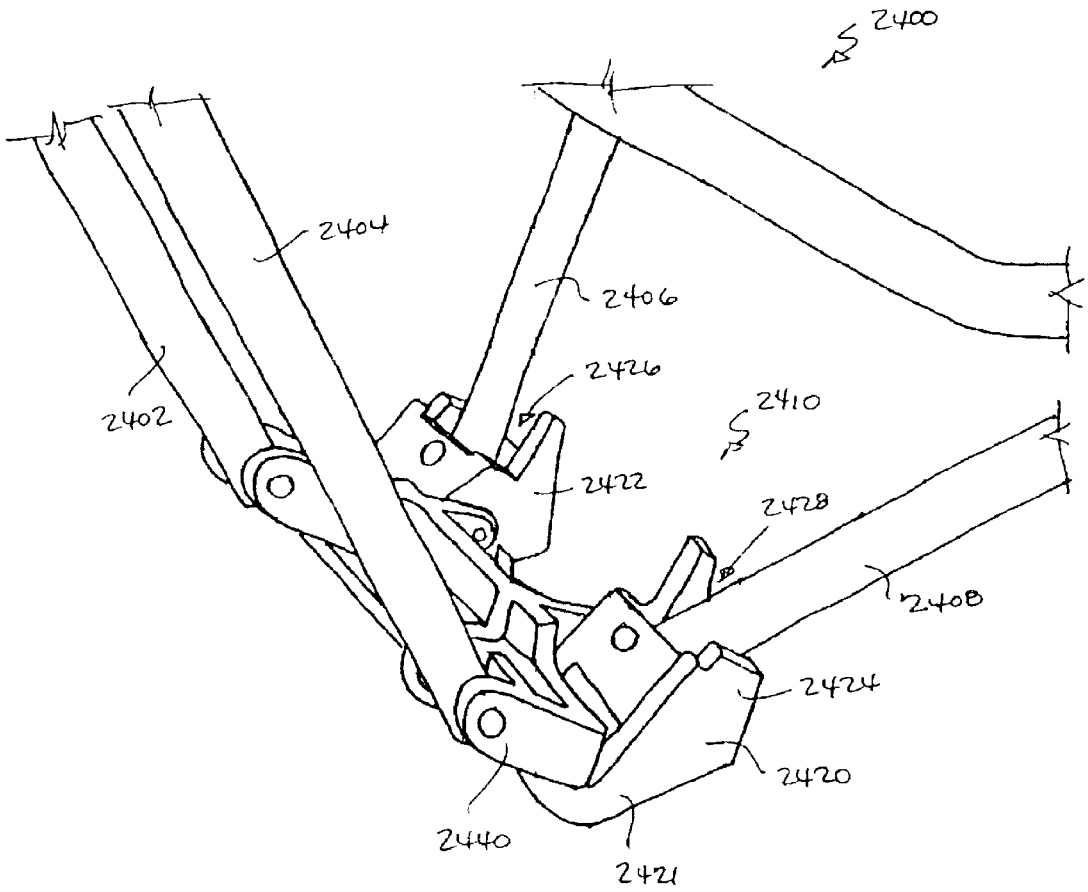
FIG. 67 illustrates a perspective view of a rear portion of the support of FIG. 66 in an upright position.

An alternative embodiment of a support is illustrated in FIGS. 66 and 67. In this embodiment, the support 2400 includes support members 2402 and 2404, side support members 2406 and 2408, and a coupler 2410.

Coupler 2410 includes a lower portion 2420 and an upper portion 2440. Upper portion 2440 is pivotally coupled to the lower portion 2420. Lower portion 2420 has a base 2421 that remains in contact with the support surface on which the support 2400 is placed. Base 2421, for example, can be in stationary, non-pivoting contact with the support surface on which the support 2400 is placed. Upper portion 2440 is movable relative to the lower portion 2420 between a reclined position (see FIG. 66) and an upright position (see FIG. 67).

Lower portion 2420 includes mounting portions 2422 and 2424 to which side support members 2406 and 2408 are coupled. Mounting portions 2422 and 2424 include cavities 2426 and 2428, respectively, into which the lower ends of side support members 2406 and 2408 are inserted. Mounting portion 2422 includes an inner wall surface 2430. Similarly, mounting portion 2424 includes an inner wall surface 2432.

Upper portion 2440 includes mounting portions 2442 and 2444. Mounting portion 2442 has an opening 2446 into which support member 2402 is inserted. Support member 2402 is pivotally coupled to mounting portion 2442, for example, via any conventional fastener, such as a rivet. Similarly, mounting portion 2444 has an opening 2448 into which support member 2404 is inserted. Support member 2404 is pivotally coupled to mounting portion 2444, for example, via any conventional fastener, such as a rivet.

Upper portion 2440 includes a connecting portion 2450 that is coupled to the lower portion 2420 of the coupler 2410. The connecting portion 2450 has extensions 2452 and 2454 that are coupled to the lower portion 2420. In the illustrated embodiment, the extensions 2452 and 2454 are coupled to the inner wall surfaces 2430 and 2432, respectively, of the lower portion 2420. Connectors 2460 and 2462, such as rivets, can be used to pivotally couple the upper portion extensions 2452 and 2454 to the lower portion 2420.

In the illustrated embodiment, the lower portion 2420 has several openings 2470 that pass through the lower portion 2420. Openings 2470 reduce the material in the lower portion 2420. Also, when the support 2400 is used on a sandy support surface, sand can pass through the openings 2470, thereby allowing the lower portion 2420 of the coupler 2410 to settle on the support surface. In alternative embodiments, the lower portion 2420 may not include any openings or the lower portion 2420 can include any number of openings 2470.

In an alternative embodiment, the upper portion of the coupler can be moved relative to the lower portion of the coupler using one or more elongate members. The elongate members can be coupled to the upper portion of the coupler to move the coupler and position the upper portion of the coupler into its reclined position (see FIG. 66) and into its upright position (see FIG. 67). For example, an elongate member can be couple to the upper portion and another elongate member can pass around a support member and then be coupled to the upper portion. Movement of either elongate member can cause movement of the upper portion.

In alternative embodiments, the couplers of the supports can be any size, shape or configuration.

In alternative embodiment, the elongate members for a support can be rigid.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

What is claimed is:

1. A combination of a shade member and a support assembly for a chair in which a user can be seated, said support assembly comprising:

a frame having a collapsed configuration and an expanded configuration, the frame being self-supporting while in the expanded configuration; and a tension member coupled to said frame and selectively disposable on said frame in:

a first position when said frame is in said expanded configuration to provide support for an arm of the user, and a second position when said frame is in said collapsed position to be carried on a shoulder of the user; and said shade member including a coupling pocket configured to selectively couple said shade member to said support assembly, said shade member includes a pair of tethering lines, said coupling pocket is located at one end of said shade member, said tethering lines are located at an opposite end of said shade member.

2. The combination of claim 1, said shade member including:

a membrane portion; and a frame portion coupled to said membrane portion.

3. The combination of claim 2, wherein said frame portion extends around at least a portion of a perimeter of said membrane portion.

4. The combination of claim 2, wherein said shade member further includes a resilient portion configured to provide support to said shade member when said shade member is coupled to said support assembly.

5. The combination of claim 4, wherein said resilient portion is substantially circular in shape.

6. A support assembly for a chair in which a user can be seated, said support assembly comprising:

a frame having a collapsed configuration and an expanded configuration, said frame including a rear frame portion having a pair of support members pivotally coupled to a coupler, when said frame is in said expanded configuration, said pair of support members being selectively disposable in:

an upright position; and a reclined position; and a tension member coupled to said frame and selectively disposable on said frame in:

a first position when said frame is in said expanded configuration to provide support for an arm of the user, and a second position when said frame is in said collapsed position to be carried on a shoulder of the user.

7. The support assembly of claim 6, wherein said frame is self-supporting while in the expanded configuration.

8. A support comprising:

a frame having an expanded configuration and a collapsed configuration;

a seat supported on said frame; and a shade member having a membrane portion and a frame portion and being configured to be coupled to said frame when said frame is in said expanded configuration, said shade member being disposable in an expanded configuration and a collapsed configuration, the frame portion forming a plurality of concentric rings when said shade member is in the collapsed configuration, an exterior side of said shade member including a coupling pocket having a cavity for receiving a portion of said frame.

9. The support of claim 8, wherein the coupling pocket of said shade member having an upper cap and a pair of retention flaps defining the cavity.

10. The support of claim 8, wherein said shade member includes a pair of tethering lines for coupling said shade member to said frame.

11. The support of claim 8, wherein said shade member further includes a resilient portion configured to provide support to said shade member when said shade member is coupled to said support assembly.

12. A support comprising:

a frame having a rear frame portion, and a seat supported on said frame, said rear frame portion including a support member pivotally coupled to an extension member, said extension member being pivotally coupled to a coupler, said rear frame portion being configured to be selectively disposable in an upright position and in a reclined position.

13. The support of claim 12, wherein said support member is a first support member and said extension member is a first extension member, said rear frame portion further including a second support member pivotally coupled to a second extension member, said second extension member being pivotally coupled to said coupler.

14. A method of reclining a support having a frame, a seat being supported on the frame, the frame including a rear frame portion having a support member pivotally coupled to an extension member which is pivotally coupled to a coupler, the method comprising:

lifting the support member from the coupler;

rotating the extension member with respect to the coupler; and pivoting the support member with respect to the extension member into a reclined position.

15. A method of transporting a collapsible chair having a frame being disposable in a collapsed configuration and an expanded configuration, a seat coupled to said frame and supported on said frame when said frame is in said expanded configuration, a tension strap having a first end coupled to the frame at a first location and a second end configured to be selectively coupled to said frame at a second location, a flexible elongate member having a first end coupled to the frame at a third location and a second end, the method comprising:

uncoupling the second end of the tension strap from the second location of the frame;

collapsing the frame;

coupling the second end of the tension strap to the second end of the flexible elongate member; and disposing the tension strap on a shoulder of a user to support the chair in the collapsed configuration on the user.

16. The method of claim 15, further comprising:

adjusting the length of the strap to fit the user.

17. A support, comprising:

a frame having a rear frame portion including a coupler, a first support member and a second support member, the first support member and the second support member being pivotably coupled at the coupler, the coupler being disposed at a rear and base location of the support, said rear frame portion being configured to be selectively disposable in an upright position and in a reclined position; and a seat supported on said frame.

18. The support of claim 17, wherein the first support member and the second support member are pivotably coupled at a first location and a second location, respectively, of the coupler, the first location and the second location of the couple being substantially adjacent.

19. The support of claim 18, wherein the first support member and the second support member are pivotably coupled at a first location and a second location, respectively, of the coupler, the first location and the second location of the couple being disposed apart from each other.

20. A frame for a support having a collapsed configuration and an expanded configuration, the frame comprising:

a front frame portion;

a rear frame portion including a coupler having a first mounting portion and a second mounting portion, said rear frame portion including first and second rear support members, said first rear support member being fixedly coupled to said first mounting portion, and said second rear support member being fixedly coupled to said second mounting portion; and first and second side support members coupled to said front frame portion, a first end portion of said first side support member being coupled to said front frame portion and a second end portion of said first side support member being coupled to said rear frame portion, the first end portion of said first side support member being at a higher elevation than the second end portion of said first side support member when said frame is in said expanded configuration, said first side support member being pivotally coupled to said first mounting portion in front of said first rear support member and being movable between a first position when said frame is in said collapsed configuration and a second position when said frame is in said expanded configuration, a first end portion of said second side support member being coupled to said front frame portion and a second end portion of said second side support member being coupled to said rear frame portion, the first end portion of said second side support member being at a higher elevation than the second end portion of said second side support member when said frame is in said expanded configuration, said second side support member being pivotally coupled to said second mounting portion in front of said second rear support member and being movable between a first position when said frame is in said collapsed configuration and a second position when said frame is in said expanded configuration.

21. The frame of claim 20 wherein said first mounting portion includes a first coupling portion and a second coupling portion oriented at an angle with respect to said first coupling portion, said first rear support member being coupled to said first coupling portion, said first side support member being coupled to said second coupling portion.

22. A frame for a support assembly, the frame being disposable in an upright position and in a reclined position, the frame comprising:

a front frame portion;

a rear frame portion, said rear frame portion disposable in a first position corresponding to the upright position of the frame and in a second position corresponding to the reclined position of the frame;

side support members extending between said front frame portion and said rear frame portion, each of said side support members being disposable in a first position corresponding to the upright position and in a second position corresponding to the reclined position; and a coupler, said rear frame portion being coupled to said coupler, said side support members being coupled to said coupler, said coupler having a range of motion corresponding to a range of motion for the frame between the upright position and in the reclined position and corresponding to a range of motion of said rear frame portion and said side portion between their respective first and second positions.

23. The frame of claim 22, further comprising:

an elongate member coupled to said coupler, movement of said elongate member causing movement of said coupler.

24. The frame of claim 22, wherein said frame comprises:

a first elongate member coupled to said coupler; and a second elongate member coupled to said coupler, movement of said first elongate member causing movement of said coupler in a first direction, and movement of said second elongate member causing movement of said coupler in a second direction, said second direction being opposite said first direction.

25. The frame of claim 22, wherein said coupler has an upper end and a lower end, said upper end being coupled to said rear frame portion, and said lower end engaging a support surface on which the frame is placed.

26. The frame of claim 25, wherein said lower end includes a rolling surface, said rolling surface including a plurality of ridges.

27. The frame of claim 22, further comprising:

an elongate member coupled to said coupler; and an adjustment mechanism, said elongate member being coupled to said adjustment mechanism, and movement of said adjustment mechanism causing movement of said elongate member and said coupler.

28. The frame of claim 27, wherein said adjustment mechanism includes a link movably mounted on said frame, said elongate member being coupled to said link.

29. The frame of claim 22, further comprising;

a first elongate member coupled to said coupler;

a second elongate member coupled to said coupler; and an adjustment mechanism, said first and second elongate members being coupled to said adjustment mechanism, and movement of said adjustment mechanism causing movement of said first and second elongate members and said coupler.

30. The frame of claim 29, wherein said adjustment mechanism is pivotally mounted on said front frame portion, said adjustment mechanism having a first end and a second end, said first elongate member being coupled proximate to said first end, and said second elongate member being coupled proximate to said second end.

31. The frame of claim 39, wherein movement of said adjustment mechanism in a first direction causes movement of said first elongate member in said first direction, and movement of said adjustment mechanism in a second direction causes movement of said second elongate member in said first direction.

32. The frame of claim 31, wherein said coupler includes an upper end and a lower end, movement of said first elongate member in said first direction causes movement of said upper end of said coupler in said first direction, and movement of said second elongate member in said first direction causes movement of said lower end of said coupler in said first direction.

33. The frame of claim 22, wherein said rear frame portion includes first and second support members, said coupler including an upper portion and a lower portion, said upper portion being pivotally coupled to said lower portion, said first and second support members being coupled to said upper portion, and said side support members being coupled to said lower portion.

34. The frame of claim 33, further comprising:

an elongate member coupled to said coupler upper portion, wherein movement of said elongate member causes movement of said upper portion relative to said lower portion.

35. The frame of claim 33, wherein said lower portion includes a plurality of openings therethrough.

36. A frame for a support assembly, the frame being disposable in an upright position and in a reclined position, the frame comprising:

a front frame portion;

a rear frame portion;

side support members extending between said front frame portion and said rear frame portion; and a coupler, said rear frame portion being coupled to said coupler, said coupler including an adjustment portion defining a plurality of retaining positions, one of said retaining positions corresponding to said upright position, and one of said retaining positions corresponding to said reclined position, said rear frame portion being selectively engageable with one of said plurality of retaining positions of said coupler.

37. The frame of claim 36, wherein said adjustment portion includes a slot and a plurality of ridges proximate to said slot, said plurality of ridges defining a plurality of notches therebetween, each of said retaining positions corresponding to one of said notches.

38. The frame of claim 37, wherein said rear frame portion includes a first support member, a second support member, and a link coupling said first and second support members, said link being selectively disposable in one of said notches.

39. The frame of claim 36, wherein said rear frame portion includes a first support member, a second support member, and a link coupling said first and second support members, said link being selectively disposable in one of said plurality of retaining positions.

40. A method of adjusting a frame for a support assembly, the frame being disposable in an upright position and in a reclined position, the frame including a front frame portion, a rear frame portion, side support members extending between the front frame portion and the rear frame portion, and a coupler, the rear frame portion being coupled to the coupler, the coupler including an adjustment portion defining a plurality of retaining positions, one of the retaining positions corresponding to the upright position, and one of the retaining positions corresponding to the reclined position, the method comprising:

moving the rear frame portion relative to the coupler; and engaging the rear frame portion with one of the plurality of retaining positions of the coupler.

* * * * *

UNITED STATES PATENT AND TRADEMARK OFFICE

CERTIFICATE OF CORRECTION

PATENT NO. : 6,820,927 B2
DATED : November 23, 2004
INVENTOR(S) : Matthew Isom et al.

It is certified that error appears in the above-identified patent and that said Letters Patent is hereby corrected as shown below:

Column 2,
Lines 28-29, replace "FIG. 37 illustrates a side view of a support according to an alternative present of the invention" with -- FIG. 37 illustrates a side view of a support according to an alternative embodiment of the invention --.

Column 4,
Line 25, replace "arc" with -- are --.

Column 5,
Line 28, replace "scat" with -- seat --.

Column 17,
Lines 20-21, replace "con figuration" with -- configuration --.

Column 22,
Line 28, replace "arc" with -- are --.

Signed and Sealed this

Sixteenth Day of August, 2005

JON W. DUDAS
*Director of the United States Patent and Trademark Office*